US009565981B2

(12) United States Patent
Conrad et al.

(10) Patent No.: US 9,565,981 B2
(45) **Date of Patent: *Feb. 14, 2017**

(54) PORTABLE SURFACE CLEANING APPARATUS

(71) Applicant: Omachron Intellectual Property Inc., Hampton (CA)

(72) Inventors: Wayne Ernest Conrad, Hampton (CA); Jason Boyd Thorne, Wellesley Hills, MA (US); Sam Liu, Suzhou (CN); Amy Kwok, Medway, MA (US)

(73) Assignee: Omachron Intellectual Property Inc., Hampton, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/871,180

(22) Filed: Sep. 30, 2015

(65) Prior Publication Data

US 2016/0066757 A1 Mar. 10, 2016

Related U.S. Application Data

(62) Division of application No. 14/335,060, filed on Jul. 18, 2014, now Pat. No. 9,314,139.

(51) Int. Cl.
*A47L 5/24* (2006.01)
*A47L 9/12* (2006.01)
(Continued)

(52) U.S. Cl.
CPC ..... *A47L 5/24* (2013.01); *A47L 5/225* (2013.01); *A47L 5/28* (2013.01); *A47L 9/0027* (2013.01);
(Continued)

(58) Field of Classification Search
CPC ..... A47L 5/24; A47L 5/225; A47L 5/28; A47L 9/0027; A47L 9/12; A47L 9/1608; A47L 9/1666; A47L 9/1683; A47L 9/1691; A47L 9/246; A47L 9/322
See application file for complete search history.

(56) References Cited

U.S. PATENT DOCUMENTS 911,258 A 2/1909 Neumann
1,600,762 A 9/1926 Hawley
(Continued)

FOREIGN PATENT DOCUMENTS

AU 112778 4/1940
CA 1077412 A1 5/1980
(Continued)

OTHER PUBLICATIONS

The international search report and written opinion. International Application No. PCT/CA2007/000380 dated Jul. 24, 2007.
(Continued)

*Primary Examiner* — Dung Van Nguyen
(74) *Attorney, Agent, or Firm* — Philip C. Mendes da Costa; Bereskin & Parr LLP/S.E.N.C.R.L., s.r.l.

(57) ABSTRACT

A hand carryable surface cleaning apparatus is disclosed. The apparatus comprises a main body housing a suction motor, and a cyclone bin assembly removably mounted to the main body. The cyclone bin assembly may be partially or wholly nested in the body when the cyclone bin assembly is mounted to the body. The cyclone bin assembly may be removably mounted to a lower surface of the main body. The cyclone bin assembly may be removably mounted as a sealed unit.

17 Claims, 36 Drawing Sheets

(51) Int. Cl.

| | |
|---|---|
| ***A47L 9/32*** | (2006.01) |
| ***A47L 9/16*** | (2006.01) |
| ***A47L 5/22*** | (2006.01) |
| ***A47L 5/28*** | (2006.01) |
| ***A47L 9/00*** | (2006.01) |
| ***A47L 9/04*** | (2006.01) |
| ***A47L 9/24*** | (2006.01) |

(52) U.S. Cl.

CPC ..... *A47L 9/0477* (2013.01); *A47L 9/12* (2013.01); *A47L 9/1608* (2013.01); *A47L 9/1666* (2013.01); *A47L 9/1683* (2013.01); *A47L 9/1691* (2013.01); *A47L 9/246* (2013.01); *A47L 9/322* (2013.01)

(56) References Cited

U.S. PATENT DOCUMENTS

| | | | |
|---|---|---|---|
| 1,797,812 | A | 3/1931 | Waring |
| 1,898,608 | A | 2/1933 | Alexander |
| 1,937,765 | A | 12/1933 | Leathers |
| 2,015,464 | A | 9/1935 | Saint |
| 2,152,114 | A | 3/1939 | Tongeren |
| 2,542,634 | A | 2/1951 | Davis et al. |
| 2,678,110 | A | 5/1954 | Madsen |
| 2,731,102 | A | 1/1956 | James |
| 2,811,219 | A | 10/1957 | Wenzl |
| 2,846,024 | A | 8/1958 | Bremi |
| 2,913,111 | A | 11/1959 | Rogers |
| 2,917,131 | A | 12/1959 | Evans |
| 2,937,713 | A | 5/1960 | Stephenson et al. |
| 2,942,691 | A | 6/1960 | Dillon |
| 2,942,692 | A | 6/1960 | Benz |
| 2,946,451 | A | 7/1960 | Culleton |
| 2,952,330 | A | 9/1960 | Winslow |
| 2,981,369 | A | 4/1961 | Yellott et al. |
| 3,032,954 | A | 5/1962 | Racklyeft |
| 3,085,221 | A | 4/1963 | Kelly |
| 3,130,157 | A | 4/1964 | Kelsall et al. |
| 3,200,568 | A | 8/1965 | McNeil |
| 3,204,772 | A | 9/1965 | Ruxton |
| 3,217,469 | A | 11/1965 | Eckert |
| 3,269,097 | A | 8/1966 | German |
| 3,320,727 | A | 5/1967 | Farley et al. |
| 3,372,532 | A | 3/1968 | Campbell |
| 3,426,513 | A | 2/1969 | Bauer |
| 3,518,815 | A | 7/1970 | Peterson et al. |
| 3,530,649 | A | 9/1970 | Porsch et al. |
| 3,543,325 | A | 12/1970 | Hamrick et al. |
| 3,561,824 | A | 2/1971 | Homan |
| 3,582,616 | A | 6/1971 | Wrob |
| 3,675,401 | A | 7/1972 | Cordes |
| 3,684,093 | A | 8/1972 | Kono |
| 3,822,533 | A | 7/1974 | Oranje |
| 3,898,068 | A | 8/1975 | McNeil et al. |
| 3,933,450 | A | 1/1976 | Percevaut |
| 3,988,132 | A | 10/1976 | Oranje |
| 3,988,133 | A | 10/1976 | Schady |
| 4,097,381 | A | 6/1978 | Ritzler |
| 4,187,088 | A | 2/1980 | Hodgson |
| 4,218,805 | A | 8/1980 | Brazier |
| 4,236,903 | A | 12/1980 | Malmsten |
| 4,307,485 | A | 12/1981 | Dessig |
| 4,373,228 | A | 2/1983 | Dyson |
| 4,382,804 | A | 5/1983 | Mellor |
| 4,409,008 | A | 10/1983 | Solymes |
| 4,486,207 | A | 12/1984 | Baillie |
| 4,494,270 | A | 1/1985 | Ritzau et al. |
| 4,523,936 | A | 6/1985 | Disanza, Jr. |
| 4,678,588 | A | 7/1987 | Shortt |
| 4,700,429 | A | 10/1987 | Martin et al. |
| 4,744,958 | A | 5/1988 | Pircon |
| 4,778,494 | A | 10/1988 | Patterson |
| 4,826,515 | A | 5/1989 | Dyson |
| D303,173 | S | 8/1989 | Hidaka et al. |
| 4,853,008 | A | 8/1989 | Dyson |
| 4,853,011 | A | 8/1989 | Dyson |
| 4,853,111 | A | 8/1989 | MacArthur et al. |
| 4,905,342 | A | 3/1990 | Ataka |
| 4,944,780 | A | 7/1990 | Usmani |
| 5,078,761 | A | 1/1992 | Dyson |
| 5,080,697 | A | 1/1992 | Finke |
| 5,090,976 | A | 2/1992 | Dyson |
| 5,129,125 | A | 7/1992 | Gamou et al. |
| 5,224,238 | A | 7/1993 | Bartlett |
| 5,230,722 | A | 7/1993 | Yonkers |
| 5,254,019 | A | 10/1993 | Noschese |
| 5,267,371 | A | 12/1993 | Solerm et al. |
| 5,287,591 | A | 2/1994 | Rench et al. |
| 5,307,538 | A | 5/1994 | Rench et al. |
| 5,309,601 | A | 5/1994 | Hampton et al. |
| 5,347,679 | A | 9/1994 | Saunders et al. |
| 5,363,535 | A | 11/1994 | Rench et al. |
| 5,481,780 | A | 1/1996 | Daneshvar |
| 5,504,970 | A | 4/1996 | Neshat |
| 5,599,365 | A | 2/1997 | Alday et al. |
| D380,033 | S | 6/1997 | Masterton et al. |
| 5,755,096 | A | 5/1998 | Holleyman |
| 5,815,878 | A | 10/1998 | Murakami et al. |
| 5,858,038 | A | 1/1999 | Dyson et al. |
| 5,858,043 | A | 1/1999 | Geise |
| 5,893,938 | A | 4/1999 | Dyson et al. |
| 5,935,279 | A | 8/1999 | Kilstroem |
| 5,950,274 | A | 9/1999 | Kilstrom |
| 5,970,572 | A | 10/1999 | Thomas |
| 6,071,095 | A | 6/2000 | Verkaar |
| 6,071,321 | A | 6/2000 | Trapp et al. |
| 6,080,022 | A | 6/2000 | Shaberman et al. |
| 6,094,775 | A | 8/2000 | Behmer |
| 6,122,796 | A | 9/2000 | Downham et al. |
| 6,210,469 | B1 | 4/2001 | Tokar |
| 6,221,134 | B1 | 4/2001 | Conrad et al. |
| 6,228,260 | B1 | 5/2001 | Conrad et al. |
| 6,231,645 | B1 | 5/2001 | Conrad et al. |
| 6,251,296 | B1 | 6/2001 | Conrad et al. |
| 6,260,234 | B1 | 7/2001 | Wright et al. |
| 6,295,692 | B1 | 10/2001 | Shideler |
| 6,345,408 | B1 | 2/2002 | Nagai et al. |
| 6,406,505 | B1 | 6/2002 | Oh et al. |
| 6,434,785 | B1 | 8/2002 | Vandenbelt et al. |
| 6,440,197 | B1 | 8/2002 | Conrad et al. |
| 6,502,278 | B2 | 1/2003 | Oh et al. |
| 6,519,810 | B2 | 2/2003 | Kim |
| 6,531,066 | B1 | 3/2003 | Saunders et al. |
| 6,536,072 | B2 | 3/2003 | Thur et al. |
| 6,553,612 | B1 | 4/2003 | Dyson et al. |
| 6,553,613 | B2 | 4/2003 | Onishi et al. |
| 6,560,818 | B1 | 5/2003 | Hasko |
| 6,581,239 | B1 | 6/2003 | Dyson et al. |
| 6,599,338 | B2 | 7/2003 | Oh et al. |
| 6,599,350 | B1 | 7/2003 | Rockwell et al. |
| 6,613,316 | B2 | 9/2003 | Sun et al. |
| 6,623,539 | B2 | 9/2003 | Lee et al. |
| 6,625,845 | B2 | 9/2003 | Matsumoto et al. |
| 6,640,385 | B2 | 11/2003 | Oh et al. |
| 6,648,934 | B2 | 11/2003 | Choi et al. |
| 6,712,868 | B2 | 3/2004 | Murphy et al. |
| 6,732,403 | B2 | 5/2004 | Moore et al. |
| 6,746,500 | B1 | 6/2004 | Park et al. |
| 6,782,583 | B2 | 8/2004 | Oh |
| 6,782,585 | B1 | 8/2004 | Conrad et al. |
| 6,810,558 | B2 | 11/2004 | Lee |
| 6,818,036 | B1 | 11/2004 | Seaman |
| 6,833,015 | B2 | 12/2004 | Oh et al. |
| 6,868,578 | B1 | 3/2005 | Kasper |
| 6,874,197 | B1 | 4/2005 | Conrad |
| 6,896,719 | B2 | 5/2005 | Coates et al. |
| 6,929,516 | B2 | 8/2005 | Brochu et al. |
| 6,968,596 | B2 | 11/2005 | Oh et al. |
| 6,976,885 | B2 | 12/2005 | Lord |
| 7,113,847 | B2 | 9/2006 | Chmura et al. |
| 7,160,346 | B2 | 1/2007 | Park |
| 7,162,770 | B2 | 1/2007 | Davidshofer |
| 7,175,682 | B2 | 2/2007 | Nakai et al. |

(56) References Cited

U.S. PATENT DOCUMENTS 7,188,388 B2 3/2007 Best et al.
7,198,656 B2 4/2007 Takemoto et al.
7,222,393 B2 5/2007 Kaffenberger et al.
7,272,872 B2 9/2007 Choi
7,278,181 B2 10/2007 Harris et al.
7,341,611 B2 3/2008 Greene et al.
7,354,468 B2 4/2008 Arnold et al.
7,370,387 B2 5/2008 Walker et al.
7,377,007 B2 5/2008 Best
7,377,953 B2 5/2008 Oh
7,386,915 B2 6/2008 Blocker et al.
7,395,579 B2 7/2008 Oh
7,429,284 B2 * 9/2008 Oh ..... A47L 9/1641 55/343
7,448,363 B1 11/2008 Rasmussen et al.
7,449,040 B2 11/2008 Conrad et al.
7,485,164 B2 2/2009 Jeong et al.
7,488,363 B2 2/2009 Jeong et al.
7,547,337 B2 6/2009 Oh
7,547,338 B2 6/2009 Kim et al.
7,563,298 B2 * 7/2009 Oh ..... A47L 9/1633 15/350
7,588,616 B2 9/2009 Conrad et al.
7,597,730 B2 10/2009 Yoo et al.
7,628,831 B2 12/2009 Gomiciaga-Pereda et al.
7,740,676 B2 6/2010 Burnham et al.
7,770,256 B1 8/2010 Fester
7,776,120 B2 8/2010 Conrad
7,779,506 B2 8/2010 Kang et al.
7,803,207 B2 9/2010 Conrad
7,805,804 B2 10/2010 Loebig
7,811,349 B2 10/2010 Nguyen
7,867,308 B2 1/2011 Conrad
7,922,794 B2 4/2011 Morphey
7,931,716 B2 4/2011 Oakham
7,938,871 B2 5/2011 Lloyd
7,979,959 B2 7/2011 Courtney
8,021,453 B2 9/2011 Howes
8,062,398 B2 11/2011 Luo et al.
8,069,529 B2 12/2011 Groff
8,117,712 B2 2/2012 Dyson et al.
8,146,201 B2 4/2012 Conrad
8,151,407 B2 4/2012 Conrad
8,152,877 B2 4/2012 Greene
8,156,609 B2 4/2012 Milne et al.
8,161,599 B2 4/2012 Griffith et al.
8,225,456 B2 7/2012 Håkan et al.
8,347,455 B2 1/2013 Dyson et al.
8,484,799 B2 7/2013 Conrad
8,671,510 B2 3/2014 Han et al.
8,673,487 B2 3/2014 Churchill
9,192,269 B2 11/2015 Conrad
9,314,139 B2 * 4/2016 Conrad ..... A47L 5/24
2002/0011050 A1 1/2002 Hansen et al.
2002/0011053 A1 1/2002 Oh
2002/0046438 A1 4/2002 Oh
2002/0062531 A1 5/2002 Oh
2002/0088079 A1 7/2002 Oh
2002/0088208 A1 7/2002 Lukac et al.
2002/0112315 A1 8/2002 Conrad
2002/0134059 A1 9/2002 Oh
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0106180 A1 6/2003 Tsen
2003/0159238 A1 8/2003 Oh
2003/0159411 A1 8/2003 Hansen et al.
2003/0200736 A1 10/2003 Ni
2004/0010885 A1 1/2004 Hitzelberger et al.
2004/0025285 A1 2/2004 McCormick et al.
2004/0216264 A1 11/2004 Shaver et al.
2005/0081321 A1 4/2005 Milligan et al.
2005/0115409 A1 6/2005 Conrad
2005/0132528 A1 6/2005 Yau
2005/0198769 A1 9/2005 Lee et al.
2005/0198770 A1 9/2005 Jung et al.
2005/0252179 A1 11/2005 Oh et al.
2005/0252180 A1 11/2005 Oh et al.
2006/0037172 A1 2/2006 Choi
2006/0042206 A1 3/2006 Arnold et al.
2006/0090290 A1 5/2006 Lau
2006/0123590 A1 6/2006 Fester et al.
2006/0137304 A1 6/2006 Jeong et al.
2006/0137306 A1 6/2006 Jeong et al.
2006/0137309 A1 6/2006 Jeong et al.
2006/0137314 A1 6/2006 Conrad et al.
2006/0156508 A1 7/2006 Khalil
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230715 A1 * 10/2006 Oh ..... A47L 9/1658 55/337
2006/0230723 A1 10/2006 Kim et al.
2006/0230724 A1 10/2006 Han et al.
2006/0236663 A1 10/2006 Oh
2006/0254226 A1 * 11/2006 Jeon ..... A47L 9/1625 55/345
2006/0278081 A1 12/2006 Han et al.
2006/0288516 A1 12/2006 Sawalski
2007/0067944 A1 3/2007 Kitamura
2007/0077810 A1 4/2007 Gogel
2007/0079473 A1 4/2007 Min
2007/0079585 A1 4/2007 Oh et al.
2007/0095028 A1 5/2007 Kim
2007/0095029 A1 5/2007 Min
2007/0209334 A1 9/2007 Conrad
2007/0209335 A1 9/2007 Conrad
2007/0271724 A1 11/2007 Hakan et al.
2007/0289089 A1 12/2007 Yacobi
2007/0289266 A1 12/2007 Oh
2008/0040883 A1 2/2008 Beskow et al.
2008/0047091 A1 2/2008 Nguyen
2008/0134460 A1 6/2008 Conrad
2008/0134462 A1 6/2008 Jansen et al.
2008/0178416 A1 7/2008 Conrad
2008/0178420 A1 7/2008 Conrad
2008/0190080 A1 8/2008 Oh et al.
2008/0196194 A1 8/2008 Conrad
2008/0301903 A1 12/2008 Cunningham et al.
2009/0100633 A1 4/2009 Bates et al.
2009/0113659 A1 5/2009 Jeon
2009/0144932 A1 6/2009 Yoo
2009/0165431 A1 7/2009 Oh
2009/0205160 A1 8/2009 Conrad
2009/0205161 A1 8/2009 Conrad
2009/0205298 A1 8/2009 Hyun et al.
2009/0209666 A1 8/2009 Hellberg et al.
2009/0265877 A1 10/2009 Dyson et al.
2009/0282639 A1 11/2009 Dyson et al.
2009/0300874 A1 12/2009 Tran et al.
2009/0300875 A1 12/2009 Inge et al.
2009/0307564 A1 12/2009 Vedantham et al.
2009/0307863 A1 12/2009 Milne et al.
2009/0307864 A1 12/2009 Dyson
2009/0308254 A1 12/2009 Oakham
2009/0313958 A1 12/2009 Gomiciaga-Pereda et al.
2009/0313959 A1 12/2009 Gomiciaga-Pereda et al.
2010/0083459 A1 4/2010 Beskow et al.
2010/0132319 A1 * 6/2010 Ashbee ..... A47L 9/1625 55/429
2010/0154150 A1 6/2010 McLeod
2010/0175217 A1 7/2010 Conrad
2010/0212104 A1 8/2010 Conrad
2010/0224073 A1 9/2010 Oh et al.
2010/0229321 A1 9/2010 Dyson et al.
2010/0229328 A1 9/2010 Conrad
2010/0242210 A1 9/2010 Conrad
2010/0243158 A1 9/2010 Conrad
2010/0293745 A1 11/2010 Coburn

(56) References Cited

U.S. PATENT DOCUMENTS

| | | | | |
|---|---|---|---|---|
| 2010/0299865 | A1 | 12/2010 | Conrad | |
| 2010/0299866 | A1 | 12/2010 | Conrad | |
| 2011/0023261 | A1* | 2/2011 | Proffitt, II | A47L 9/1608 15/347 |
| 2011/0146024 | A1 | 6/2011 | Conrad | |
| 2011/0168332 | A1 | 7/2011 | Bowe et al. | |
| 2011/0289719 | A1 | 12/2011 | Han | |
| 2012/0060322 | A1 | 3/2012 | Simonelli et al. | |
| 2012/0216361 | A1 | 8/2012 | Millington et al. | |
| 2012/0222245 | A1 | 9/2012 | Conrad | |
| 2012/0222260 | A1 | 9/2012 | Conrad | |
| 2012/0222262 | A1 | 9/2012 | Conrad | |
| 2013/0091815 | A1 | 4/2013 | Smith | |
| 2013/0185892 | A1 | 7/2013 | Walker | |
| 2014/0137362 | A1* | 5/2014 | Smith | A47L 9/1641 15/347 |
| 2014/0137363 | A1 | 5/2014 | Wilson | |
| 2014/0137364 | A1 | 5/2014 | Stickney et al. | |
| 2014/0182080 | A1 | 7/2014 | Lee et al. | |
| 2014/0208538 | A1 | 7/2014 | Visel et al. | |

FOREIGN PATENT DOCUMENTS

| | | | |
|---|---|---|---|
| CA | 1218962 | A | 3/1987 |
| CA | 2484587 | A1 | 4/2005 |
| CA | 2438079 | C | 8/2009 |
| CA | 2659212 | A1 | 9/2010 |
| CA | 2593950 | C | 1/2013 |
| CN | 1493244 | A | 5/2004 |
| CN | 1887437 | A | 1/2007 |
| CN | 202932850 | U | 5/2013 |
| DE | 875134 | C | 4/1953 |
| DE | 9216071.9 | U1 | 2/1993 |
| DE | 4232382 | C1 | 3/1994 |
| EP | 493950 | B1 | 7/1992 |
| EP | 1200196 | B1 | 6/2005 |
| EP | 1779761 | A2 | 5/2007 |
| EP | 1594386 | B1 | 4/2009 |
| EP | 1676516 | B1 | 1/2010 |
| EP | 2308360 | A2 | 4/2011 |
| EP | 1629758 | A3 | 10/2013 |
| FR | 2812531 | B1 | 11/2004 |
| GB | 700791 | A | 12/1953 |
| GB | 1111074 | A | 4/1968 |
| GB | 2163703 | B | 1/1988 |
| GB | 2268875 | A | 1/1994 |
| GB | 2282979 | B | 10/1997 |
| GB | 2365324 | B | 7/2002 |
| GB | 2441962 | B | 3/2011 |
| GB | 2466290 | B | 10/2012 |
| GB | 2508035 | | 5/2014 |
| JP | 61131720 | A | 6/1986 |
| JP | 2000140533 | A | 5/2000 |
| JP | 2010178773 | A | 8/2010 |
| JP | 2010220632 | A | 10/2010 |
| JP | 2011189132 | A | 9/2011 |
| JP | 2011189133 | A | 9/2011 |
| WO | 8002561 | A1 | 11/1980 |
| WO | 9627446 | A1 | 9/1996 |
| WO | 9809121 | A1 | 3/1998 |
| WO | 9843721 | A1 | 10/1998 |
| WO | 01/07168 | A1 | 2/2001 |
| WO | 02/17766 | A3 | 3/2002 |
| WO | 2004069021 | A1 | 8/2004 |
| WO | 2006026414 | A3 | 8/2007 |
| WO | 2008009883 | A1 | 1/2008 |
| WO | 2008009888 | A1 | 1/2008 |
| WO | 2008009890 | A1 | 1/2008 |
| WO | 2008009891 | A1 | 1/2008 |
| WO | 2008088278 | A2 | 7/2008 |
| WO | 2009026709 | A1 | 3/2009 |
| WO | 2010102396 | A1 | 9/2010 |
| WO | 2010142968 | A1 | 12/2010 |
| WO | 2010142969 | A1 | 12/2010 |
| WO | 2010142970 | A1 | 12/2010 |
| WO | 2010142971 | A1 | 12/2010 |
| WO | 2011054106 | A1 | 5/2011 |
| WO | 2012042240 | A1 | 4/2012 |
| WO | 2012117231 | A1 | 9/2012 |
| WO | 2014195711 | A1 | 12/2014 |

OTHER PUBLICATIONS

Centerline. (n.d.). 1 page; Retrieved Apr. 19, 2016, from http://www.merriam-webster.com/dictionary/centerline.

Centerline. Oxford Dictionaries. Oxford University Press, n.d. Web. 1 Page; Retrieved Apr. 19, 2016. <https://www.oxforddictionaries.com/us/definition/english/centre-line.

Weisstein, Eric W. "Projection." from MathWorld—A Wolfram Web Resource. Web. 2 pages; Retrieved Apr. 20, 2016 <http://mathworld.wolfram.com/Projection.html>.

"Projection". Encyclopedia Britannica. Encycloperdia Britannica Online. Encyclopedia Britannica Inc., 2016. Web. 1 page, Retrieved Apr. 20, 2016 <http://britannica.com/topic/projection-geometry>.

Third-Party Submission Under 37 CFR 1.290, dated Mar. 18, 2016, for U.S. Appl. No. 14/334,945.

International Preliminary Report on Patentability, dated Sep. 16, 2008 for International application No. PCT/CA2007/000380.

Supplementary European Search Report, dated Jun. 16, 2009, as received on the corresponding EP application No. 07719394.4.

The Office Action received in connection to the corresponding Chinese Patent Application No. 200880126486.6 dated Mar. 23, 2012.

The Office Action received in connection to the corresponding U.S. Appl. No. 12/720,901 dated Jun. 10, 2011.

The Office Action received in connection to the related Chinese Patent Application No. 00813438.3 issued Jul. 11, 2003.

Handbook of Air Pollution Prevention and Contriol, pp. 397-404, 2002.

Makita 4071 Handy Vac.

Makita BCL180 User Manual.

European Communication pursuant to Article 94(3) on European Patent Application No. 04078261.7, dated Apr. 24, 2012.

European Communication pursuant to Article 94(3) on European Patent Application No. 04078261.7, dated Feb. 26, 2010.

International Preliminary Examination Report on International application No. PCT/CA00/00873, dated Oct. 26, 2001.

Office Action dated Jul. 7, 2010, for Canadian Patent Application No. 2,675,714.

International Search Report and Written Opinion received in connection to International patent application No. PCT/CA2007/002211, mailed on Apr. 21, 2008.

International Search Report and Written Opinion received in connection to international patent application No. PCT/CA2015/050661, mailed on Oct. 19, 2015.

United States Office Action, dated Feb. 16, 2011, for U.S. Appl. No. 11/953,292.

United States Office Action, dated Jul. 22, 2010, for U.S. Appl. No. 11/953,292.

Euro-Pro Shark Cordless Hand Vac Owner's Manual, published in 2002.

* cited by examiner

PORTABLE SURFACE CLEANING APPARATUS

RELATED APPLICATIONS

The application is a divisional application of U.S. patent application Ser. No. 14/335,060 which was filed on Jul. 18, 2014, which is incorporated herein in its entirety.

FIELD

The specification relates to hand carryable surface cleaning apparatus. In a preferred embodiment, the hand carryable surface cleaning apparatus comprises a portable surface cleaning apparatus, such as a hand vacuum cleaner or a pod.

INTRODUCTION

The following is not an admission that anything discussed below is part of the prior art or part of the common general knowledge of a person skilled in the art.

Various types of surface cleaning apparatus are known. Surface cleaning apparatus include vacuum cleaners. Currently, a vacuum cleaner typically uses at least one cyclonic cleaning stage. More recently, cyclonic hand vacuum cleaners have been developed. See for example, U.S. Pat. No. 7,931,716 and US 2010/0229328. Each of these discloses a hand vacuum cleaner which includes a cyclonic cleaning stage. U.S. Pat. No. 7,931,716 discloses a cyclonic cleaning stage utilizing two cyclonic cleaning stages wherein both cyclonic stages have cyclone axes that extend vertically. US 2010/0229328 discloses a cyclonic hand vacuum cleaner wherein the cyclone axis extends horizontally and is co-axial with the suction motor. In each of these designs, the cyclone bin assembly is removable for emptying. The cyclone bin assembly is removed together with the dirty air inlet. Accordingly, any member attached to the cyclone bin assembly, such as a cleaning tool, is removed with the cyclone bin assembly when it is desired to empty the cyclone bin assembly or the cleaning tool must first be removed In addition, hand carriable (e.g., pod style) cyclonic vacuum cleaners are also known (see U.S. Pat. No. 8,146,201). In this design, the cyclone bin is not removable from the pod vacuum cleaner.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

According to one broad aspect, a portable surface cleaning apparatus (e.g., a hand vac or a pod vac) is provided wherein the cyclone bin assembly is removably mounted to a body thereof and at least partially nests within the body when mounted to the body of the portable surface cleaning apparatus. An advantage of this design is that the cyclone bin assembly may be removed without disconnecting any tool or accessory connected to the inlet of the portable surface cleaning apparatus. A further advantage is that the volume of the portable surface cleaning apparatus may be reduced by nesting the cyclone bin assembly.

In accordance with this aspect, there is provided a hand carryable surface cleaning apparatus comprising:

(a) a body housing a suction motor and comprising a dirty air inlet, (b) a cyclone bin assembly removably mounted to the body, the cyclone bin assembly comprising a cyclone bin assembly air inlet in air flow communication with the dirty air inlet when the cyclone bin assembly is mounted to the body, a cyclone chamber and a dirt collection chamber, and, (c) an air flow path extending from the dirty air inlet to a clean air outlet and including the suction motor and the cyclone chamber.

wherein the cyclone bin assembly is at least partially nested in the body when the cyclone bin assembly is mounted to the body.

In some embodiments, a recess may be provided in a lower side of the body in which the cyclone bin assembly is received.

In some embodiments, an upper portion of the cyclone bin assembly may be received in the recess.

In some embodiments, the cyclone bin assembly air inlet may be provided at an upper end of the cyclone bin assembly.

In some embodiments, a cyclone bin assembly air outlet may be provided at an upper end of the cyclone bin assembly.

In some embodiments, an upper portion of the cyclone bin assembly may be received in the recess, and the body may comprise a pre-motor filter positioned above the recess.

In some embodiments, a recess may be provided in a lower side of the body in which the cyclone bin assembly is received, an upper portion of the cyclone bin assembly may be received in the recess and the cyclone bin assembly air inlet may be provided at an upper end of the cyclone bin assembly.

In some embodiments, a cyclone bin assembly air outlet may be provided at an upper end of the cyclone bin assembly.

In some embodiments, the body may comprise a pre-motor filter positioned above the recess.

In some embodiments, the body may comprise a conduit extending from the dirty air inlet to a conduit air outlet and the conduit may extend linearly.

In some embodiments, the body may comprise a conduit extending from the dirty air inlet to a conduit air outlet and the conduit air outlet may extend at an angle to a direction of airflow through the conduit and the cyclone bin assembly air inlet may extend in a mating angle.

In some embodiments, the body has a carry handle and the carry handle may remain with the body when the cyclone bin assembly is removed.

According to another broad aspect, a portable surface cleaning apparatus (e.g., a hand vac or a pod vac) is provided wherein the cyclone bin assembly is removably mounted to a lower side of the body thereof. An advantage of this design is that the cyclone bin assembly may be removable while the cyclone chamber is located above the dirt collection chamber. The cyclone bin assembly is preferably removable as a sealed unit other than the air inlet and air outlet of the cyclone bin assembly.

In accordance with this aspect, there is provided, a hand carryable surface cleaning apparatus comprising:

(a) a body housing a suction motor and comprising a dirty air inlet, (b) a cyclone bin assembly removably mounted to a lower side of the body, the cyclone bin assembly comprising a cyclone bin assembly air inlet provided at an upper end of the cyclone bin assembly and in air flow communication with the dirty air inlet when the cyclone bin assembly is mounted to the body, a cyclone chamber and a dirt collection chamber, and, (c) an air flow path extending from the dirty air inlet to a clean air outlet and including the suction motor and the cyclone chamber.

In some embodiments, a cyclone bin assembly air outlet may be provided at an upper end of the cyclone bin assembly.

In some embodiments, the cyclone bin assembly may be removable as a sealed unit other than the cyclone bin assembly air inlet and the cyclone bin assembly air outlet.

In some embodiments, the body may comprise a pre-motor filter positioned above the cyclone bin assembly.

In some embodiments, the body may comprise a conduit extending from the dirty air inlet to a conduit air outlet and the conduit air outlet may extend at an angle to a direction of airflow through the conduit outlet and the cyclone bin assembly air inlet may extend in a mating angle.

In some embodiments, the body has a carry handle and the carry handle may remain with the body when the cyclone bin assembly is removed.

According to another broad aspect, a portable surface cleaning apparatus (e.g., a hand vac or a pod vac) is provided wherein the cyclone bin assembly is removably mounted to the body thereof as a sealed unit other than the air inlet and air outlet of the cyclone bin assembly. An advantage of this design is that the dirt collection chamber is closed when removed for emptying thereby avoiding spillage of collected dirt as the dirt collection chamber is moved to a garbage can or the like for emptying.

In accordance with this aspect, there is provided a hand carryable surface cleaning apparatus comprising:

(a) a body housing a suction motor and comprising a dirty air inlet, (b) a cyclone bin assembly removably mounted to the body, the cyclone bin assembly comprising a cyclone bin assembly air inlet provided at an upper end of the cyclone bin assembly and in air flow communication with the dirty air inlet when the cyclone bin assembly is mounted to the body, a cyclone chamber, a dirt collection chamber and a cyclone bin assembly air outlet provided at an upper end of the cyclone bin assembly, the cyclone bin assembly is removable as a sealed unit other than the cyclone bin assembly air inlet and the cyclone bin assembly air outlet, and, (c) an air flow path extending from the dirty air inlet to a clean air outlet and including the suction motor and the cyclone chamber.

In some embodiments, an upper portion of the cyclone bin assembly may be received in a cavity of the body.

It will be appreciated by a person skilled in the art that a surface cleaning apparatus may embody any one or more of the features contained herein and that the features may be used in any particular combination or sub-combination.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Numerous embodiments are described in this application, and are presented for illustrative purposes only. The described embodiments are not intended to be limiting in any sense. No embodiment described below limits any claimed apparatus or method and any claimed apparatus or method may cover methods or apparatuses that differ from those described herein. Those skilled in the art will recognize that any of the embodiments may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described. Any embodiment described below that is not claimed in this document may be the subject matter of another protective instrument, for example, a continuing patent application, and the applicants, inventors or owners do not intend to abandon, disclaim or dedicate to the public any such invention by its disclosure in this document The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

Figure 1:
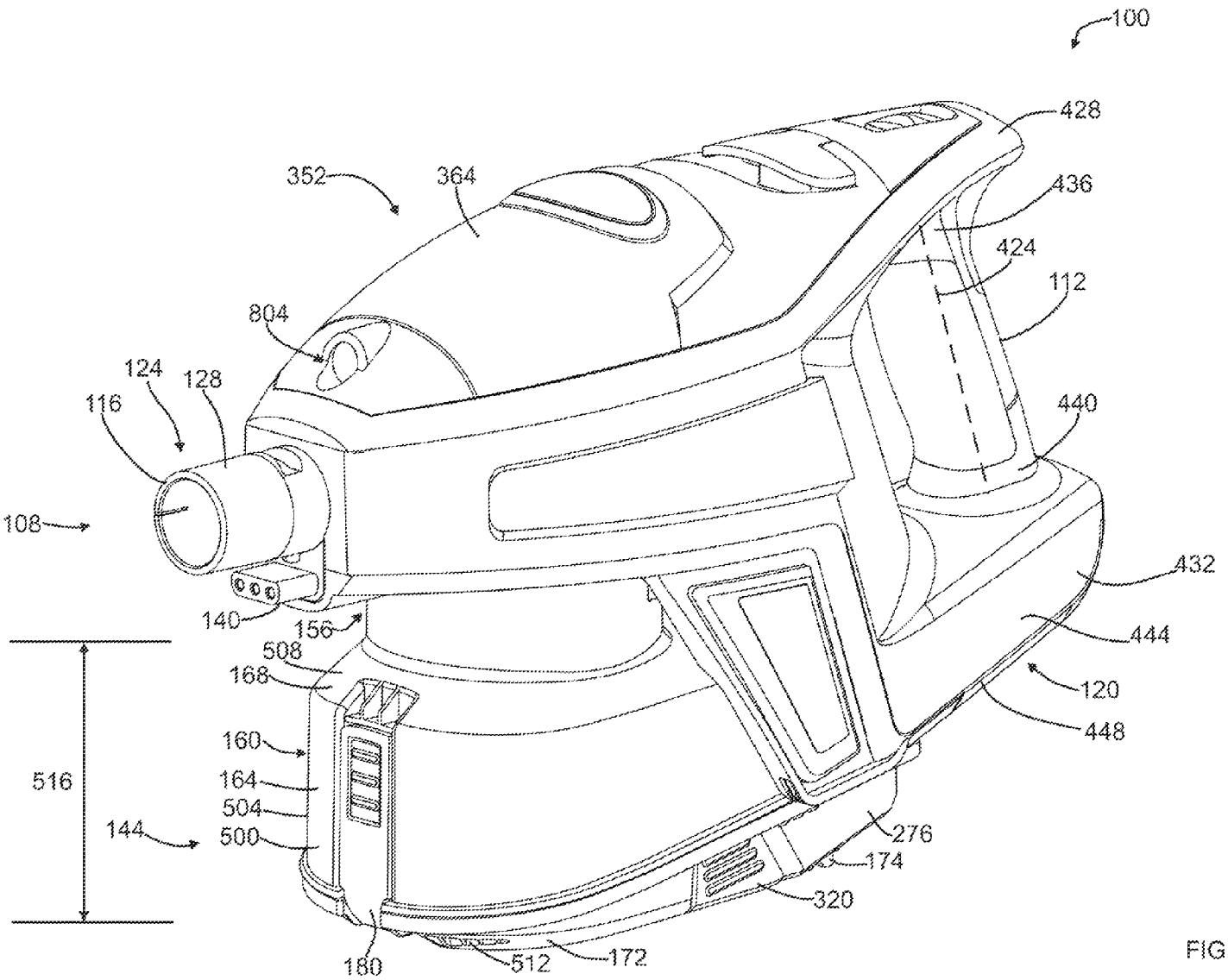
FIG. 1 is a front perspective view of a hand carryable surface cleaning apparatus, in accordance with at least one embodiment.

Referring to FIG. 1, an embodiment of a surface cleaning apparatus 100 is shown. In the embodiment illustrated, the surface cleaning apparatus 100 is a hand carriable or hand-held vacuum cleaner. It will be appreciated that surface cleaning apparatus 100 could be carried by a hand of a user, a shoulder strap or the like and could be in the form of a pod or other portable surface cleaning apparatus. Surface cleaning apparatus 100 could be a vacuum cleaner, an extractor or the like. All such surface cleaning apparatus are referred to herein as a hand carriable surface cleaning apparatus. Optionally, surface cleaning apparatus 100 could be removably mounted on a base so as to form, for example, an upright vacuum cleaner, a canister vacuum cleaner, a stick vac, a wet-dry vacuum cleaner and the like. Power can be supplied to the surface cleaning apparatus 100 by an electrical cord (not shown) that can be connected to a standard wall electrical outlet. Alternatively, or in addition, the power source for the surface cleaning apparatus can be an onboard energy storage device, including, for example, one or more batteries.

The surface cleaning apparatus 100 comprises a main body 108 having a handle 112, a dirty air inlet 116, a clean air outlet 120 (see for example FIG. 3) and an air flow path extending therebetween. In the embodiment shown, the dirty air inlet 116 is the inlet end 124 of conduit 128. Optionally, the inlet end 124 can be used to directly clean a surface. Alternatively, the inlet end 124 can be connected to the downstream end of any suitable hose, cleaning tool or accessory, including, for example a wand 132 that is pivotally connected to a surface cleaning head 136 (FIG. 2), a nozzle and a flexible suction hose. In the configuration illustrated in FIGS. 2 and 3, the surface cleaning apparatus 100 can be used to clean a floor or other surface in a manner analogous to conventional upright-style vacuum cleaners.

Referring again to FIG. 1, conduit 128 may provide a suitable connector that is operable to connect to, and preferably detachably connect to, a hose, cleaning tool or other accessory. It will be appreciated that, alternately, the connector may be provided on main body 108. Optionally, main body 108 may further include an electrical connection. Providing an electrical connection may allow cleaning tools and accessories that are coupled to conduit 128 to be powered by the surface cleaning apparatus 100. For example, the surface cleaning apparatus 100 can be used to provide both power and suction to a surface cleaning head, or other suitable tool.

In the illustrated embodiment, main body 108 includes an electrical coupling in the form of a female socket member 140 positioned proximate conduit 128 for receiving a corresponding male prong member of a hose, cleaning tool and/or accessory that is connected to inlet end 124. Providing the female socket 140 on the electrified side of the electrical coupling may help prevent a user from inadvertently contacting the electrical contacts. In other embodiments, socket member 140 may include male connectors. In such a case, it is preferred that the male connectors are de-energized when exposed (i.e., when they are not plugged into a female connector). It will be appreciated that any other electrical connector may be provided. For example, main body may have a socket for receiving a plug that is connected, e.g., by a wire, to an electrically operable accessory.

The air flow path extends from dirty air inlet 116 through an air treatment member. The air treatment member may be any suitable member that can treat the air in a desired manner, including, for example, removing dirt particles and debris from the air. In the illustrated example, the air treatment member includes a cyclone bin assembly 144. Alternatively, the air treatment member can comprise a bag, a filter, an additional cyclonic cleaning stage and/or other air treating known in the art. In the illustrated embodiment, the cyclone bin assembly 144 is removably mounted to main body 108 of surface cleaning apparatus 100. A suction motor 148 (see FIG. 4) is mounted within a motor housing 152 (see FIG. 5) of main body 108 and is in fluid communication with cyclone bin assembly 144. In this configuration, suction motor 148 is downstream from cyclone bin assembly 144, and clean air outlet 120 is downstream from suction motor 148.

Cyclone Bin Assembly

The following is a description of a cyclone bin assembly that may be used by itself in any surface cleaning apparatus or in any combination or sub-combination with any other feature or features disclosed herein. The cyclone bin assembly comprises a cyclone chamber wherein entrained particulate matter is separated from an incoming dirty air stream. Separated particulate matter may be stored in a dirt collection chamber. As is known in the art, the dirt collection chamber may be provided as part of the cyclone chamber (e.g., a lower portion of the cyclone chamber) and/or in a separate dirt collection chamber that is in communication with a cyclone chamber via a dirt outlet (e.g., it may surround all or a portion of the cyclone chamber or be positioned below a cyclone chamber and separated therefrom other than the cyclone chamber dirt outlet)

Referring to FIGS. 4, and 6-9, in the illustrated embodiment, the cyclone bin assembly 144 includes a cyclone chamber 156 and a dirt collection chamber 160. As exemplified, the dirt collection chamber 160 is positioned outside (i.e. exterior to) and substantially below the cyclone chamber 156. Preferably, at least a portion, if not all, of the dirt collection chamber 160 is below the cyclone chamber 156. The dirt collection chamber 160 comprises a sidewall 164, a first end wall 168 and an opposed second end wall 172.

The dirt collection chamber 160 may be emptyable by any means known in the art. For example, the dirt collection chamber may be removable by itself or as part of the cyclone bin assembly. In such a case, the dirt collection chamber may be emptyable by inverting the dirt collection chamber (e.g., inverting a cyclone bin assembly having an open upper end). Alternately or in addition, the dirt collection chamber may be openable concurrently with the cyclone chamber 156 or alternately by itself.

Figure 8:
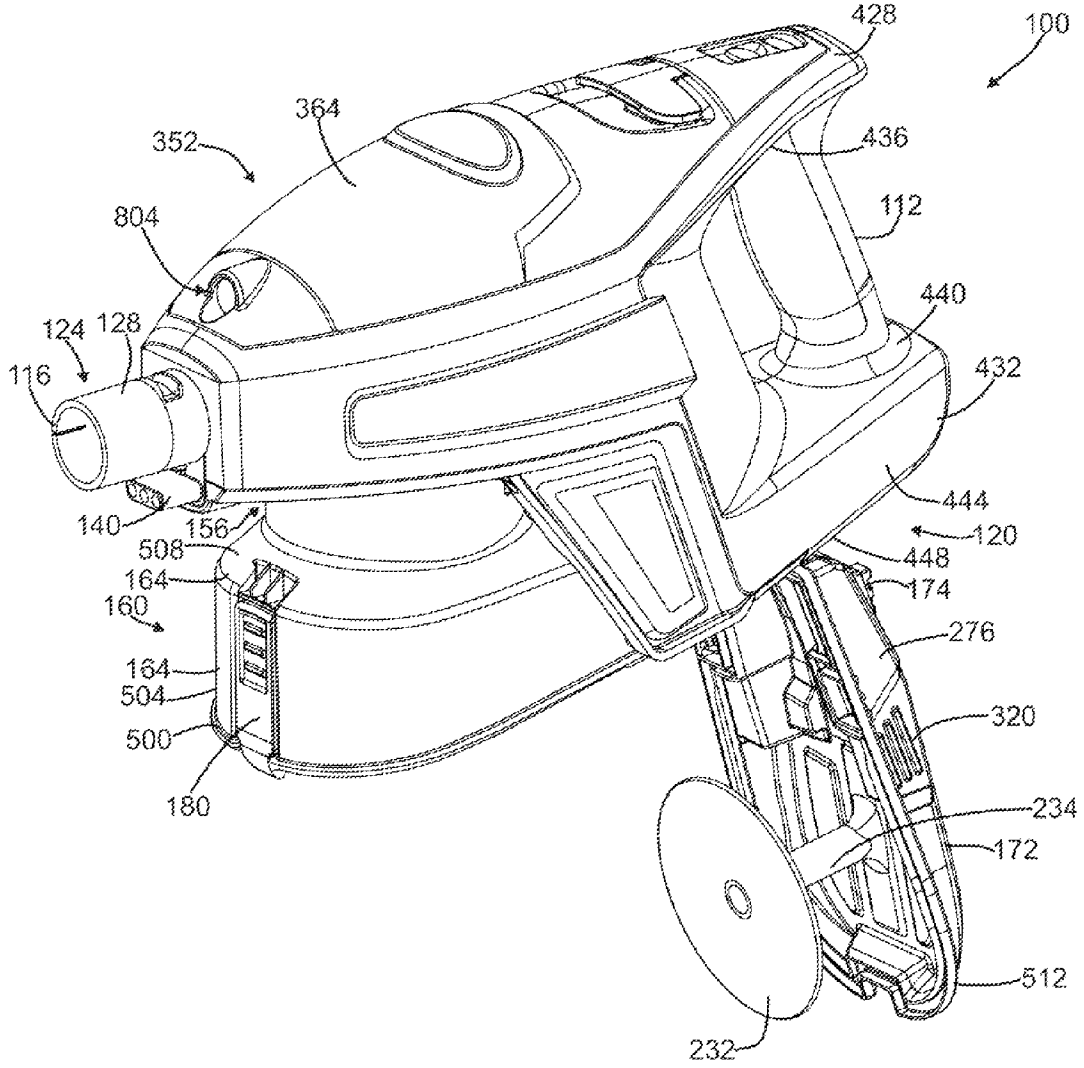
FIG. 8 is a front perspective view of the surface cleaning apparatus of FIG. 1 with a lower wall of the cyclone bin assembly in an open position.
Figure 9:
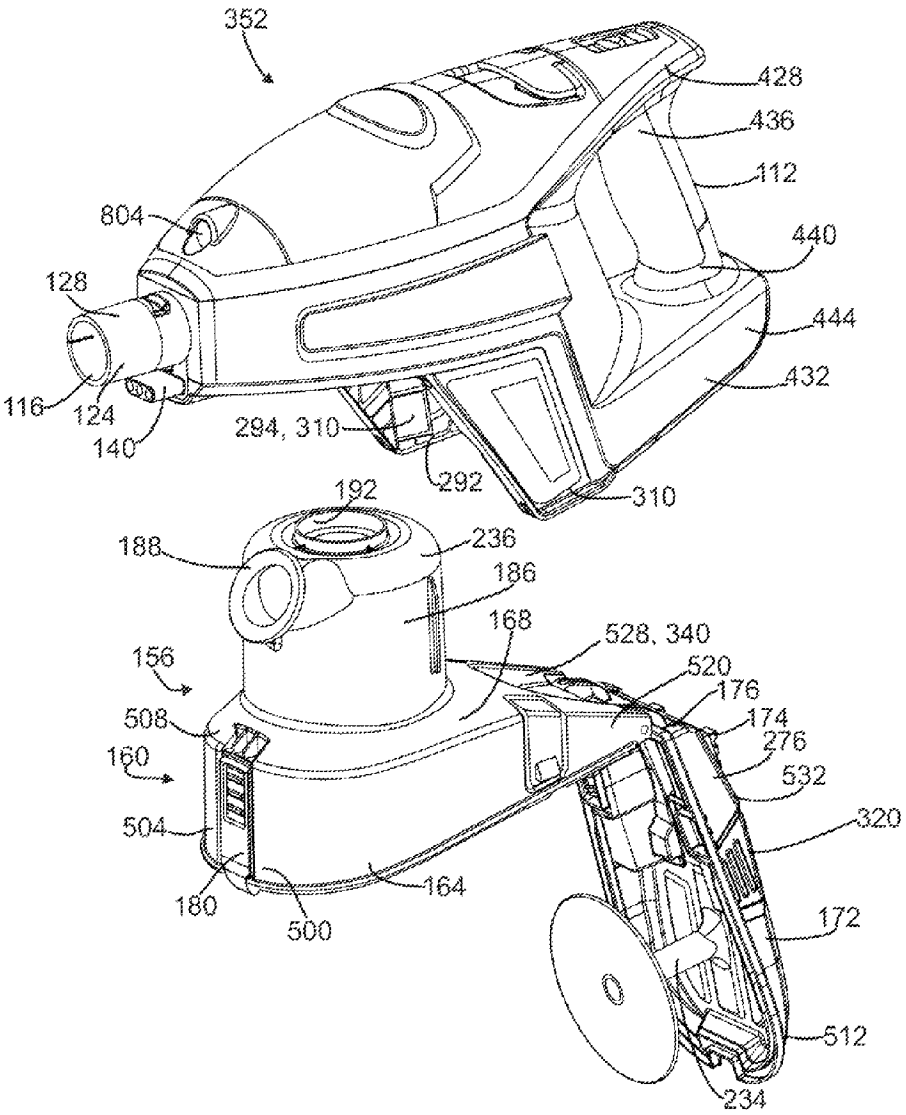
FIG. 9 is a front perspective view of the surface cleaning apparatus of FIG. 1 with the main body separated from the cyclone bin assembly, and the lower wall of the cyclone bin assembly in an open position.

As exemplified, the second dirt collection chamber end wall 172 is moveably (e.g., pivotally) connected to e.g., the dirt collection chamber sidewall 164, for example using hinge 176. In this configuration, the second end wall 172 of dirt collection chamber 160 functions as an openable door to empty the dirt collection chamber 160 and can be opened as shown in FIGS. 8 and 9 to empty dirt and debris from the interior of the dirt collection chamber 160. The second dirt collection chamber end wall 172 can be retained in the closed position by any means known in the art, such as by a releasable latch 180. In the illustrated example, the hinge 176 is provided on a back edge of the end wall 172 and the latch 180 is provided at the front of the end wall 172 so that the door swings backwardly when opened. Alternatively, the hinge and latch may be in different positions, and the door may open in a different direction or manner. Optionally, instead of being pivotal or openable, the end wall may be removable.

In some embodiments, end wall 172 may include a stand 174 for supporting surface cleaning apparatus 100 in an upright position.

In the embodiment shown, the cyclone chamber 156 extends along a cyclone axis 184 and is bounded by a sidewall 186. The cyclone chamber 156 includes an air inlet 188 and an air outlet 192, and a dirt outlet 196 in communication with the dirt collection chamber 160. The air inlet 188, air outlet 192 and dirt outlet 196 may be of any design known in the art. Preferably, the air inlet 188 is generally tangentially oriented relative to the sidewall 186, so that air entering the cyclone chamber 156 will tend to swirl and circulate within the cyclone chamber 156, thereby disentraining dirt and debris from the air flow, before leaving the chamber via the air outlet 192. The air inlet 188 extends along an inlet axis 200 that may differ from the cyclone axis 184 by an angle 204. For example, axis 200 of air inlet 188 may be perpendicular to cyclone axis 184.

In the illustrated example, the cyclone air outlet 192 comprises a conduit member or vortex finder 208. Optionally, a screen 212 can be positioned over the vortex finder 208 to help filter lint, fluff and other elongate debris. Preferably, the screen 212 can be removable. Optionally, the screen 212 can be tapered such that the distal, inner or free end 216 of the screen 212 has a smaller diameter 220 than the diameter 224 at the base 228 of the screen 212 and/or the air outlet 192.

In the example illustrated the cyclone chamber 156 is arranged in a generally vertical, inverted cyclone configuration. In this configuration, the air inlet 188 and the air outlet 192 are provided at an upper end of the cyclone chamber 156 and the dirt outlet is at the lower end. However, alternate configurations may be used.

The dirt outlet from the cyclone chamber may be any dirt outlet known in the art, such as one or more slot outlets or an annular gap between an end wall of the cyclone chamber and a spaced apart facing wall. As exemplified, an end wall, deflector or arrestor plate 232 is positioned at the dirt outlet end or lower end of the cyclone chamber 156. The arrestor plate 232 may be of any size and configuration and may be sized to cover substantially all of the lower end of the cyclone chamber 156. As exemplified, the plate 232 abuts the lower end of the cyclone sidewall 186 to form a lower end wall of the cyclone chamber 156. When the arrestor plate 232 abuts the lower ends of the sidewall 186 it helps define the gap or slot that forms the dirt outlet 196. In this configuration, the dirt outlet slot 196 is bounded on three sides by the cyclone chamber sidewall 186 and on a fourth side by the arrestor plate 232. Alternatively, plate 232 may be spaced from sidewall 186 of the cyclone chamber such that the dirt outlet slot 196 may be a continuous gap that extends between the sidewall 186 and the arrestor plate 232. In the illustrated example the dirt outlet 196 is vertically spaced apart from the air inlet 188 and air outlet 192, and dirt outlet 196 is positioned at the opposite, lower end of the cyclone chamber 156.

In the illustrated embodiment, the arrestor plate 232 forms the bottom of the cyclone chamber 156 and may be of any suitable configuration known in the art. Optionally the arrestor plate 232 may be fixed in its position adjacent the sidewall 186 or in a fixed spaced relation, or it may be moveable or openable. Providing an, openable arrestor plate 232 may help facilitate emptying of the cyclone chamber 156.

Figure 9B:
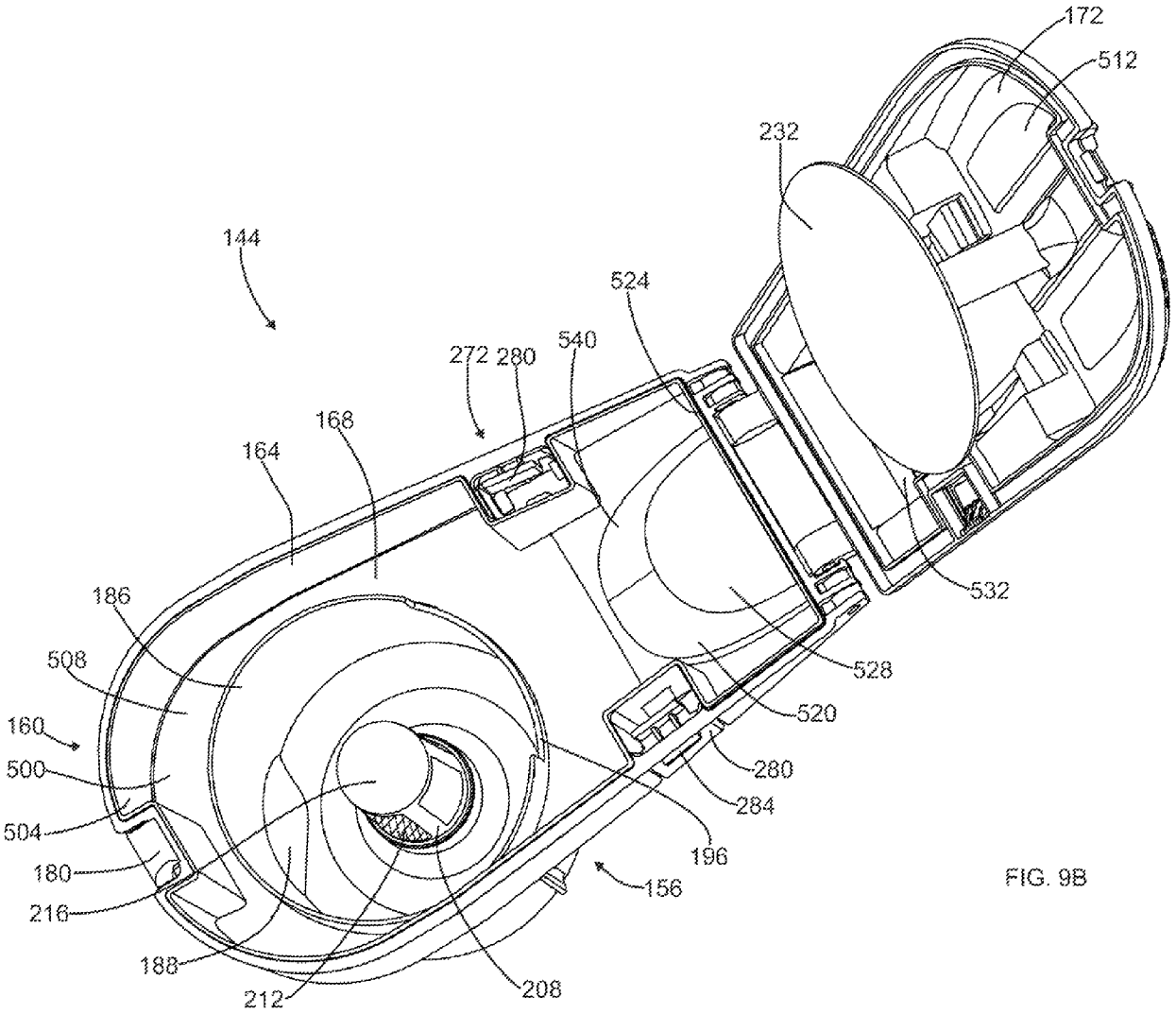
FIG. 9B is a bottom perspective view of the cyclone bin assembly of FIG. 6, with the lower wall in an open position.

Optionally, as exemplified herein, the arrestor plate 232 may be openable concurrently with another portion of the surface cleaning apparatus, including, for example, the dirt collection chamber 160. For example, in the illustrated embodiment, the arrestor plate 232 is mounted to and supported spaced from the openable wall 172 of the dirt collection chamber by a support member 234. The support member 234 may be of any suitable configuration and may be formed from any suitable material that is capable of supporting the arrestor plate 232 and resisting stresses exerted on the arrestor plate 232 by the air flow in the cyclone chamber or dirt particles exiting the cyclone chamber 156. In this configuration, the arrestor plate 232 is openable concurrently with the end wall 172, so that opening the end wall 172 simultaneously opens the dirt collection chamber 160 and the cyclone chamber 156 (see FIG. 9B). Alternatively, the arrestor plate 232 may be mounted to the sidewall 186 (or other portion of the surface cleaning apparatus 100) and need not open in unison with the end wall 172.

Nesting of the Cyclone Bin Assembly

The following is a description of nesting of the cyclone bin assembly that may be used by itself in any surface cleaning apparatus or in any combination or sub-combination with any other feature or features disclosed herein. In accordance with this aspect, cyclone bin assembly 144 may be detached without having to disconnect an accessory or wand from the cyclone bin assembly and, if an electrified cleaning tool is used, without having to disconnect an electrical cord from the cyclone bin assembly. This may permit cyclone bin assembly 144 to be quickly and easily removed, emptied, and replaced, and for cleaning with apparatus 100 to resume. Accordingly, the portion of the cyclone bin assembly that includes the air inlet to the cyclone bin assembly (e.g., the cyclone air inlet) may be nested inside the main body. An advantage of this design is that a wand, cleaning tool or the like may be attached to an inlet conduit on the main body and the cyclone bin assembly is removable as a sealed unit without having to disconnect a wand, cleaning tool of the like from the air inlet to the cyclone bin assembly. Accordingly, detaching cyclone bin assembly 144 does not require any additional reconfiguration of surface cleaning apparatus 100.

Cyclone bin assembly 144 may be removably mounted to main body 108 so as to at least partially nest inside main body 108 in any suitable fashion. For example, a portion of main housing 108 may have a cavity or recess having an open end through which the cyclone bin assembly is inserted. The cyclone bin assembly may be receivable by travel along a linear or an arcuate path. Accordingly, the main body may have a cavity having an open side (e.g., an open lower end) in which a portion (e.g., the portion having the air inlet) of the cyclone bin assembly is removably receivable. The cyclone bin assembly may slide into the cavity and be secured therein by a mechanical restraining member, e.g., a snap fit, male and female engagement members, a securing arm or the like.

In accordance with this embodiment, cyclone bin assembly 144 may be releasably secured to main body 108 in any suitable fashion. For example, cyclone bin assembly 144 and/or main body 108 may include a locking mechanism including one or more of a latch, snap, hook and loop fastener, zipper, magnet, friction fit, bayonet mount, or any other suitable locking member.

The open end of the cavity may be any side of main body. The portion of the cyclone bin assembly that is inserted preferably has the air inlet to the cyclone bin assembly and the air outlet from the cyclone bin assembly. Therefore, for example, the cyclone air inlet and the cyclone air outlet may be at the same end (e.g., an upper end) of the cyclone bin assembly. Accordingly, the open end is positioned so as to receive, and optionally slidably receive, the portion of the cyclone bin assembly that has the air inlet to the cyclone bin assembly and the air outlet from the cyclone bin assembly. Accordingly, if the air inlet to the cyclone bin assembly and the air outlet from the cyclone bin assembly are provided at an upper end of the cyclone bin assembly, the open end is provided at a lower end of the main body. If the open end is provided at a front end of the main body, the cyclone bin assembly may be insertable by positioning the upper end of the cyclone bin assembly at the open end and rotating the cyclone bin assembly rearwardly so that the lower end of the cyclone bin assembly travels along an arc.

An advantage of this design is that it may provide surface cleaning apparatus 100 with a comparatively reduced size relative to the volume of cyclone bin assembly 144 while permitting the cyclone bin assembly to be removed for emptying without disconnecting a cleaning tool from inlet end 124.

For example, as exemplified in FIGS. 1, 4-7, and 10, cyclone bin assembly 144 includes an upper portion 236, and main body 108 includes a cavity or recess 240 in a lower side thereof. Recess 240 is defined in part by an upper wall 244, sidewalls 248*a* and 248*b*, a rear wall 252, and a front wall 256. Upper portion 236 is at least partially receivable inside recess 240 when cyclone bin assembly 144 is connected to main body 108. In the example shown, upper portion 236 includes the cyclone chamber 156 air inlet and outlet. Recess 240 is sized to receive upper portion 236 of cyclone chamber 156 so that when cyclone bin assembly 144 is mounted to main body 108, an upper end 260 of cyclone bin assembly 144 is positioned in recess 240 surrounded by walls 244, 248, 252, and 256, and a lower end 264 of cyclone bin assembly 144 extends below and exterior to recess 240. Side walls 310 may also be provided to partially surround parts of the cyclone bin assembly so as to protect it from impact during use.

In alternative embodiments, more or less of cyclone bin assembly 144 may be nested inside main body 108 when cyclone bin assembly 144 is mounted to main body 108. For example, recess 240 may be sized to receive most or all of cyclone bin assembly 144. It will be appreciated that if a substantial portion of the cyclone chamber and/or the dirt collection chamber are positioned inside main body 108, then portions of the main body may be transparent so that a user may see the air circulate in the cyclone chamber and/or the level of dirt in the dirt collection chamber.

Figure 4:
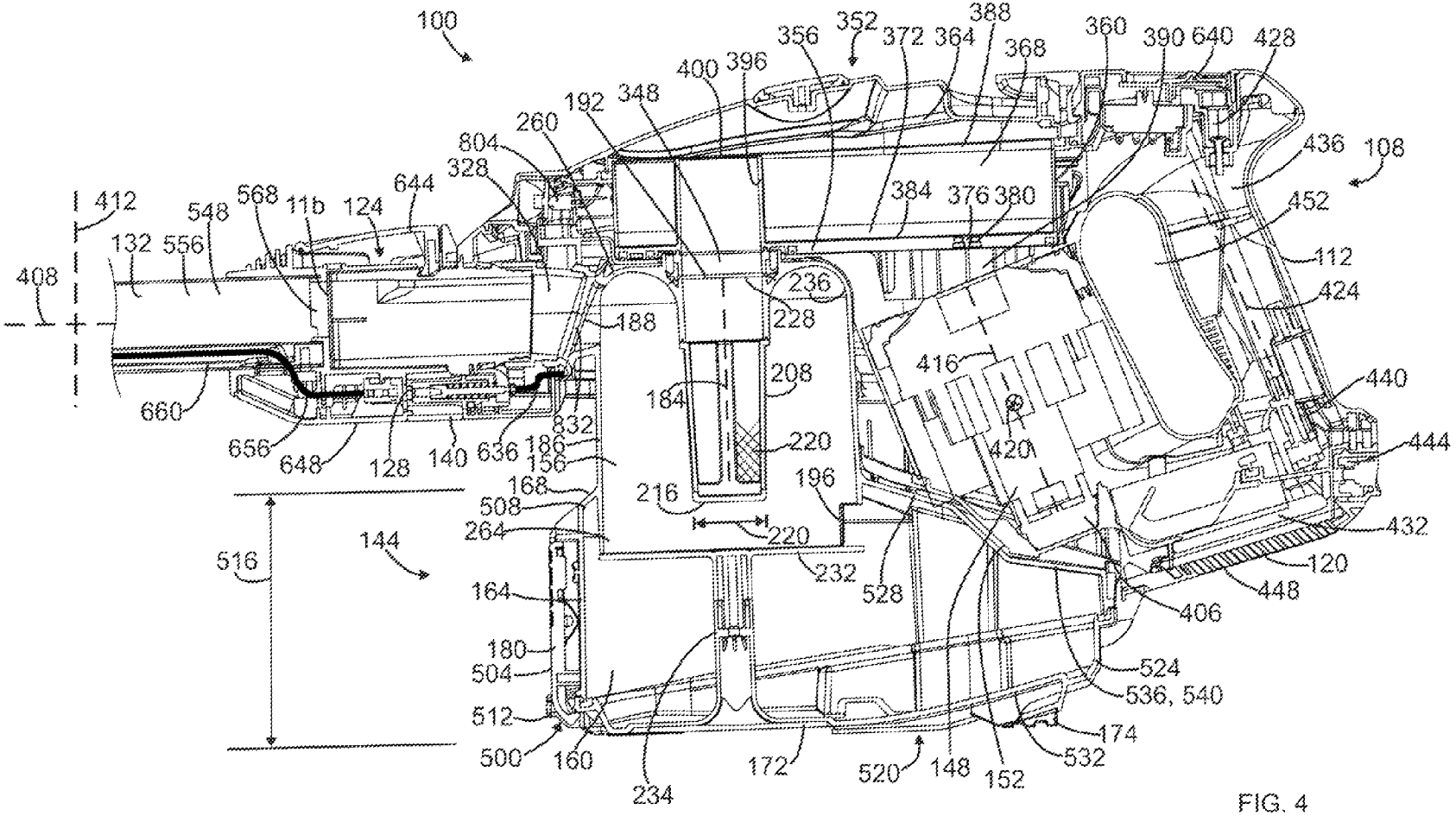
FIG. 4 is a partial cross-sectional view taken along line 4-4 in FIG. 2.
Figure 5:
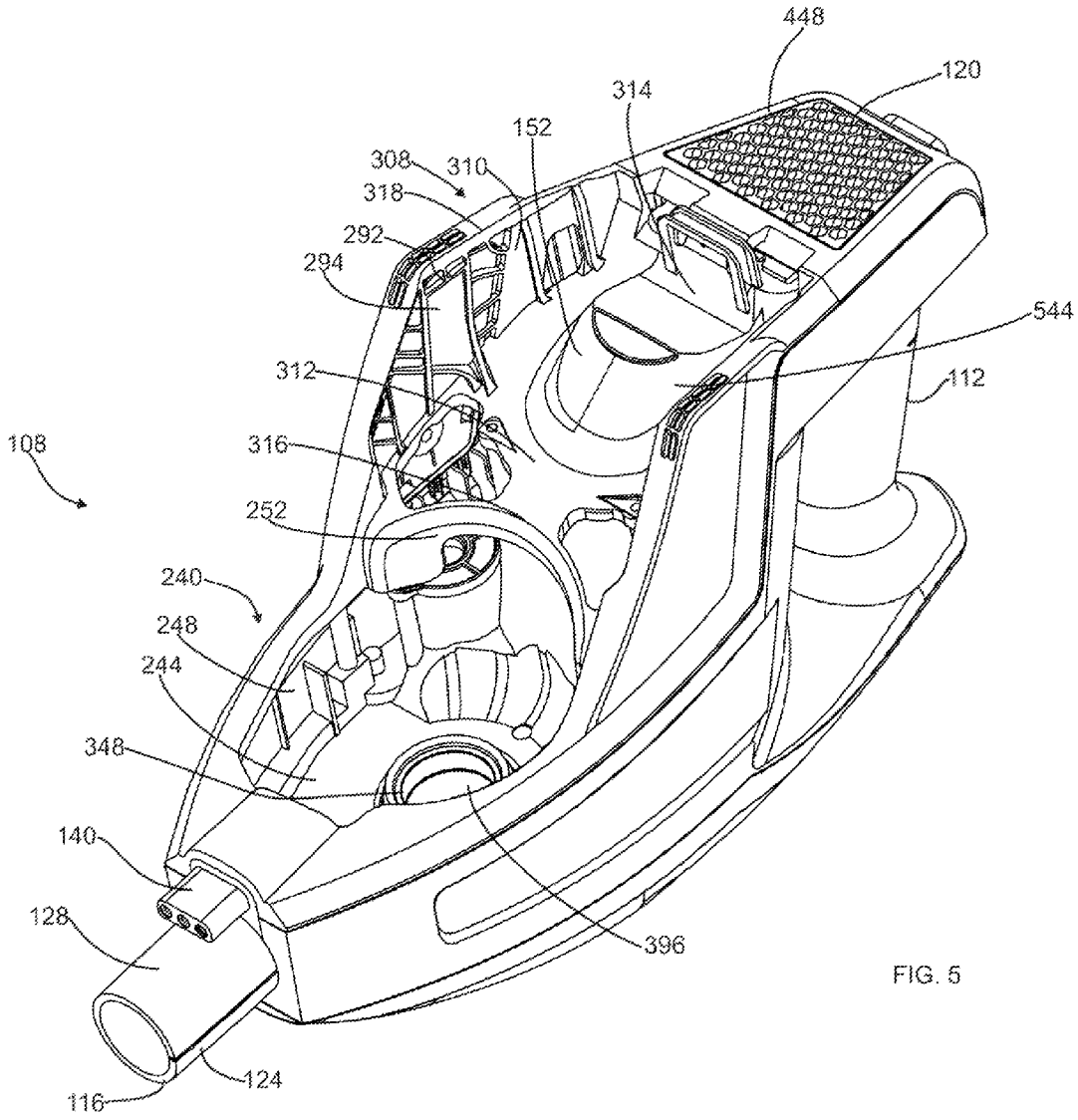
FIG. 5 is a bottom perspective view of a main body of the surface cleaning apparatus of FIG. 1 wherein the cyclone bin assembly has been removed.
Figure 7:
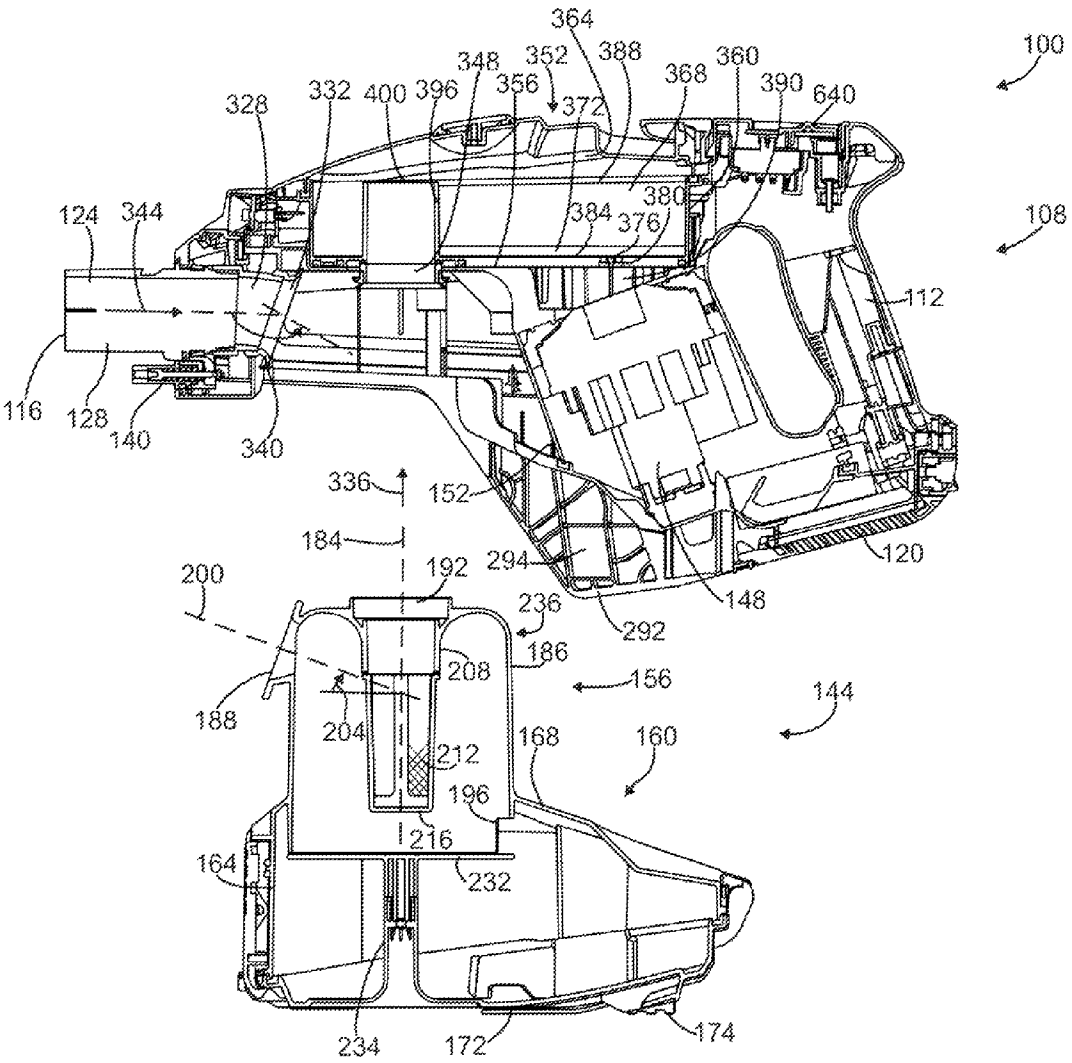
FIG. 7 is a cross-sectional view taken along line 7-7 in FIG. 6.
Figure 10:
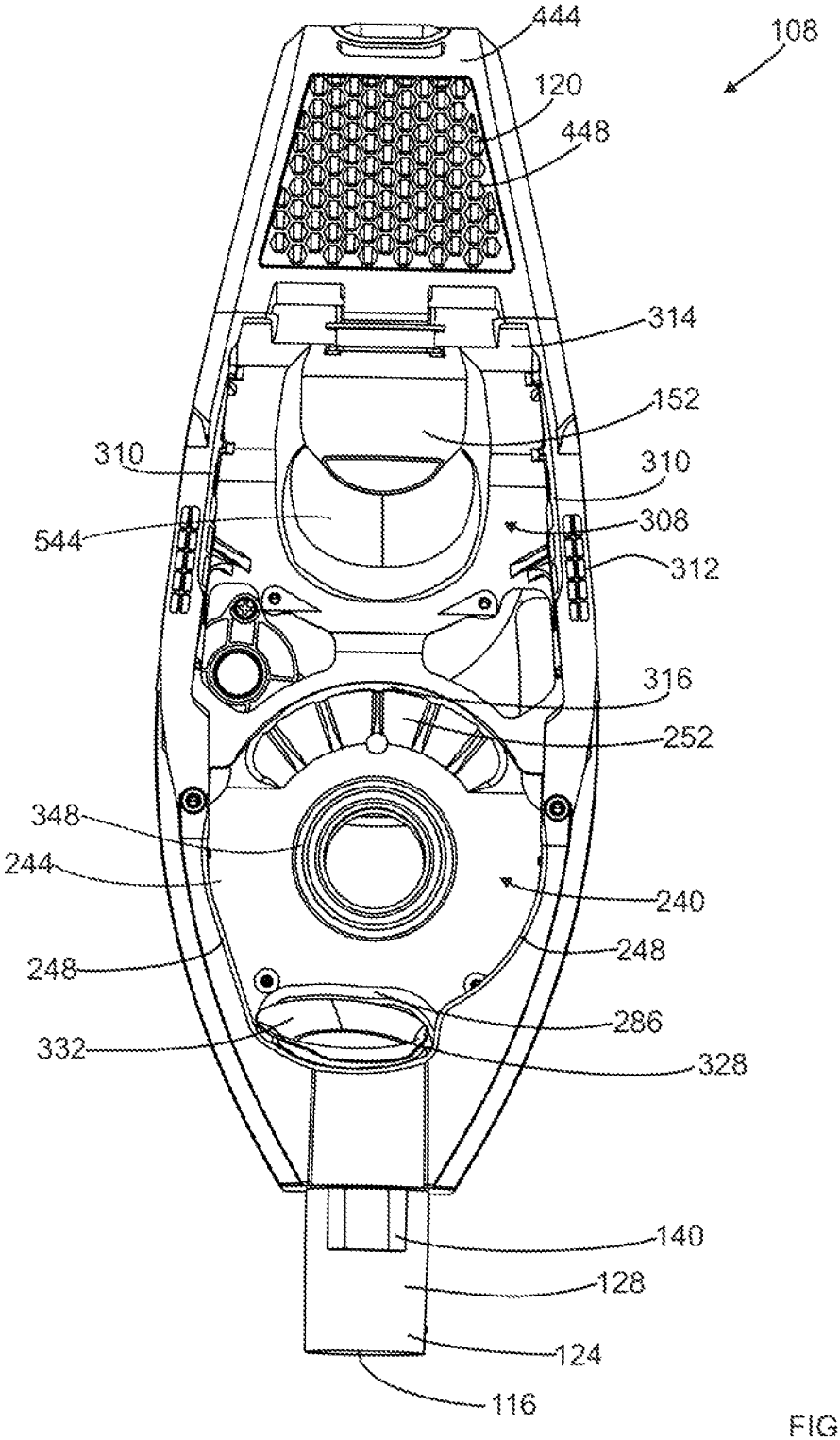
FIG. 10 is a bottom plan view of the main body of the surface cleaning apparatus of FIG. 1 wherein the cyclone bin assembly has been removed.
Figure 11:
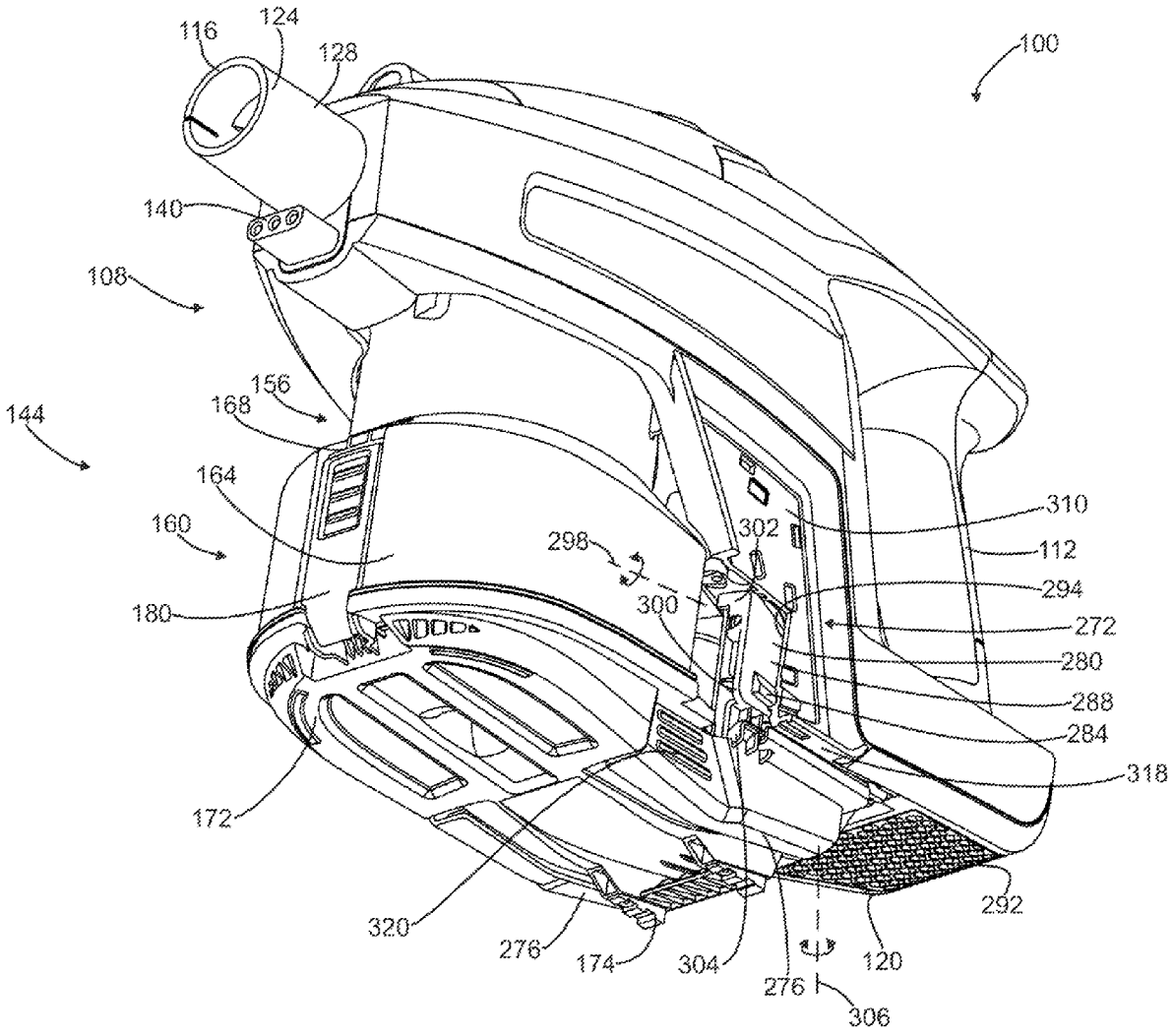
FIG. 11 is a bottom front perspective view of the surface cleaning apparatus of FIG. 1 including a partial cutaway to show a locking mechanism in a locked position.
Figure 11B:
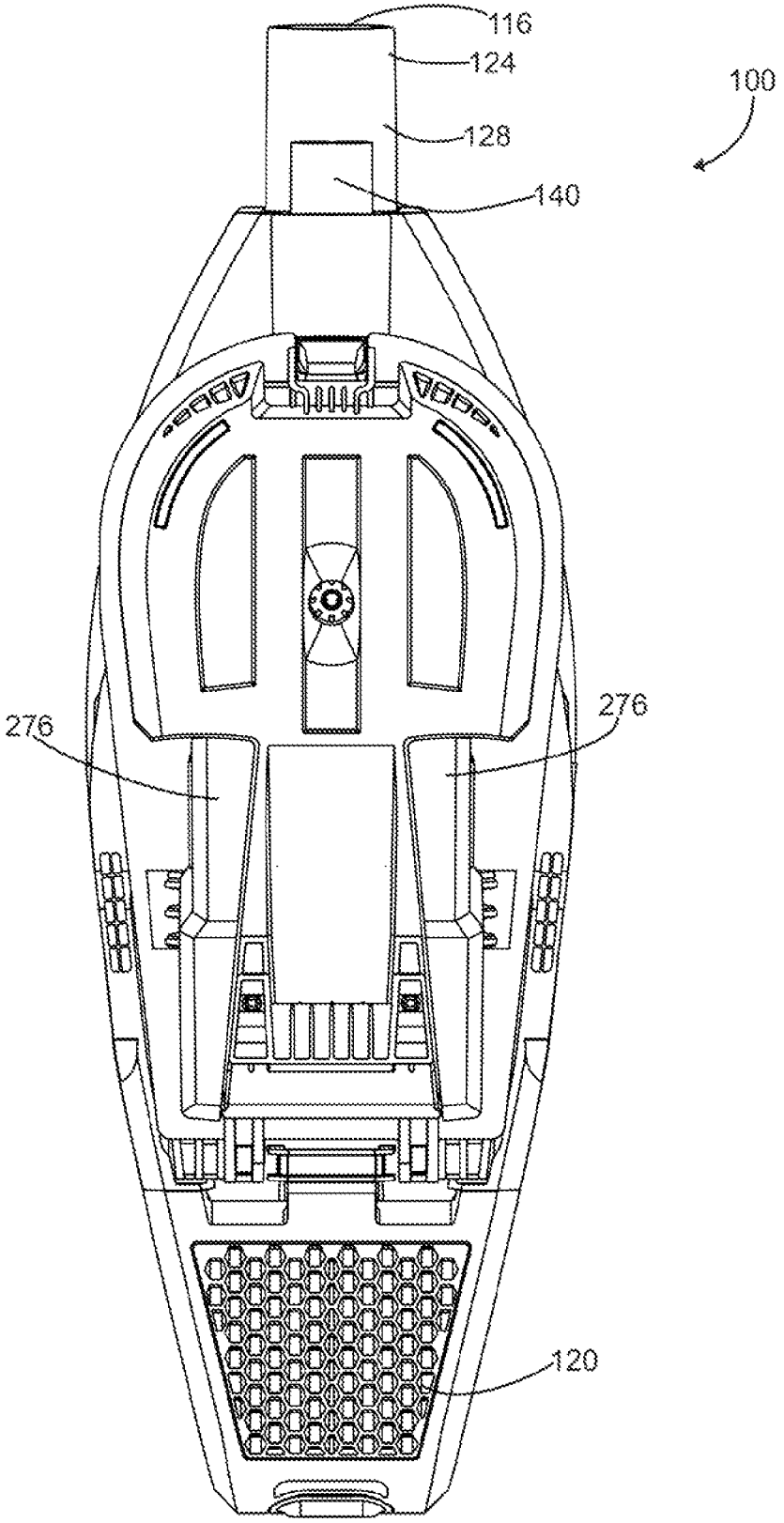
FIG. 11B is a bottom plan view of the surface cleaning apparatus of FIG. 1 with actuators of the locking mechanism in the locked position.
Figure 12:
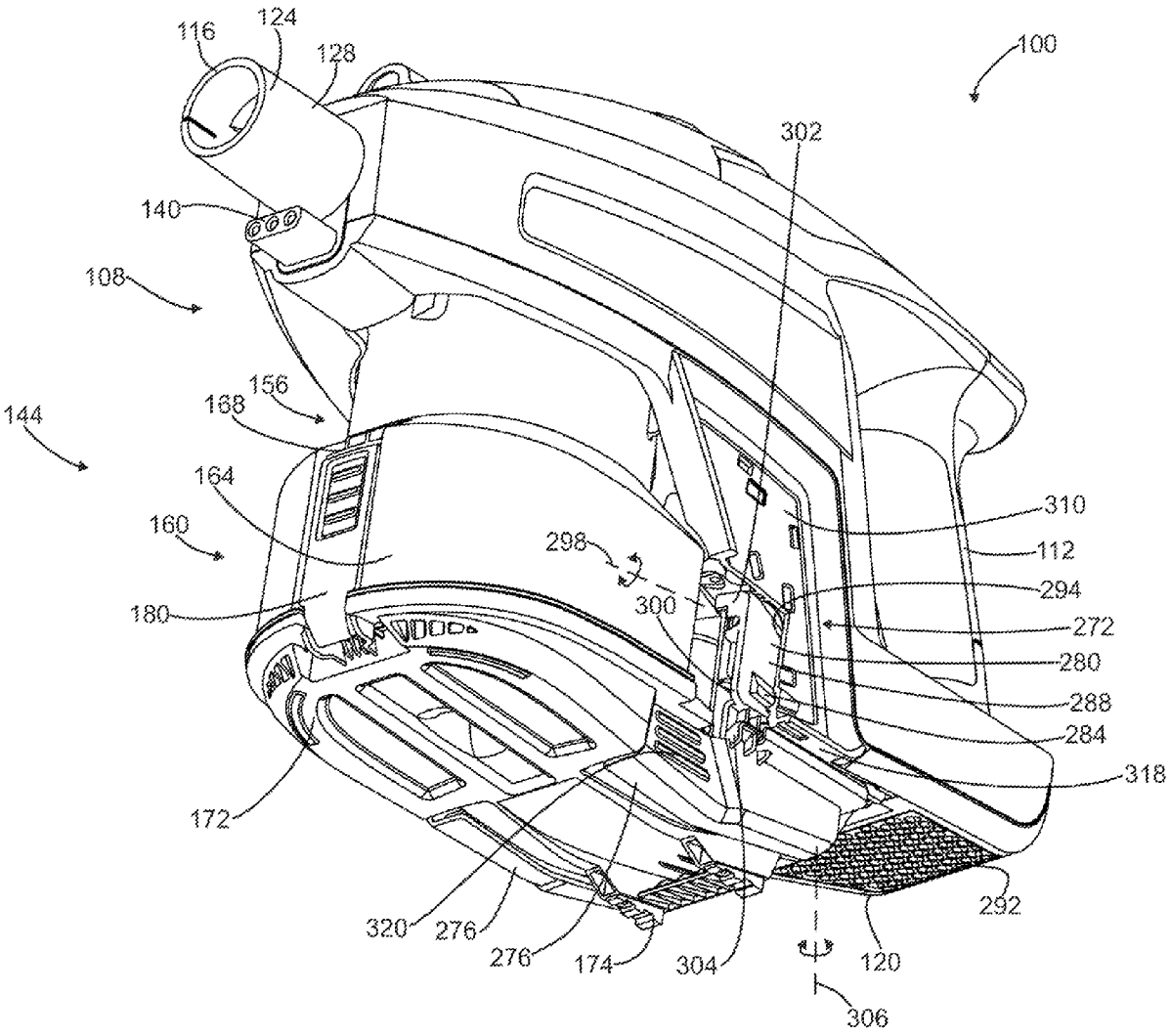
FIG. 12 is a bottom perspective view of the surface cleaning apparatus of FIG. 1 including the partial cutaway to show the locking mechanism in an unlocked position.
Figure 12B:
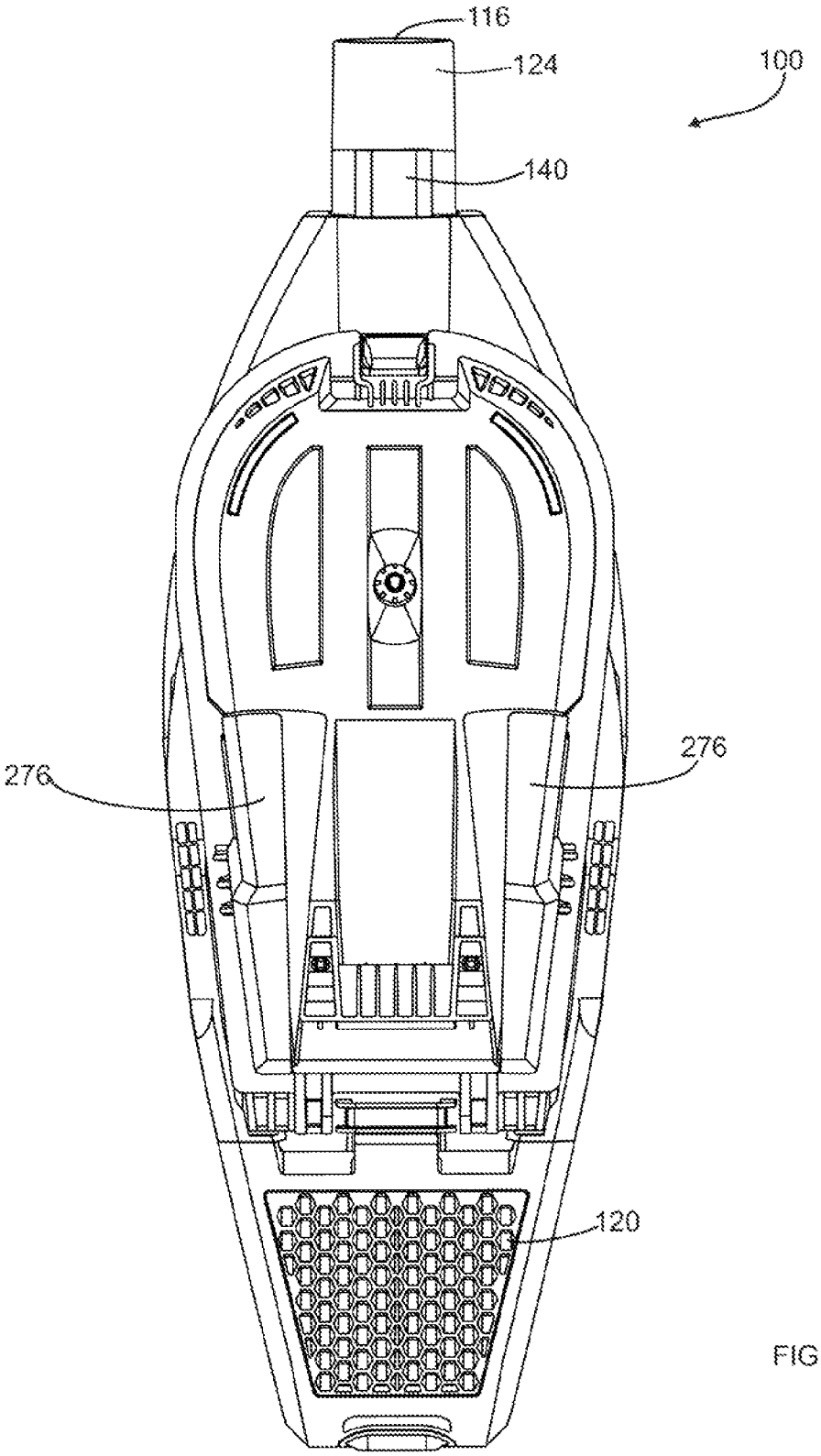
FIG. 12B is a bottom plan view of the surface cleaning apparatus of FIG. 1 with the actuators of the locking mechanism in the unlocked position.

As exemplified in FIGS. 4, 7, and 10, cyclone bin assembly 144 cooperates with main body 108 to form an airflow path from dirty air inlet 116 to clean air outlet 120, when cyclone bin assembly 144 is mounted to main body 108. Accordingly, as cyclone bin assembly 144 is inserted into main body 108, air inlet 188 of cyclone chamber 156 is optionally automatically connected in air flow communication with upstream dirty air inlet 116, and air outlet 192 of cyclone chamber 156 is optionally automatically connected in air flow communication with downstream clean air outlet 120.

In the illustrated example, a conduit 128 extends linearly from dirty air inlet 116 rearwardly to define an airflow path from dirty air inlet 116 to conduit air outlet 328. Therefore, when cyclone bin assembly 144 is mounted to main body 108, cyclone chamber air inlet 188 is brought into contact with conduit air outlet 328. Preferably, cyclone chamber inlet 188 and conduit air outlet 328 form a substantially air tight connection. This may mitigate the escape of dirty air, e.g. into recess 240 of main body 108, and a consequent loss of suction. For example, cyclone chamber inlet 188 may be urged into firm contact with conduit air outlet 328 when cyclone bin assembly 144 is mounted to main body 108. Optionally, one or both of conduit air outlet 328 and cyclone chamber inlet 188 may include a sealing member 332 (e.g. a gasket or an O-ring) which may be compressed between conduit air outlet 328 and cyclone chamber inlet 188 to enhance the air-tight characteristic of the connection.

Optionally, the interface between cyclone chamber inlet 88 and conduit air outlet 328 may be at a (non-zero) angle to the direction 336 of insertion of cyclone bin assembly 144 into main body 108. This may enhance the reciprocal force applied by cyclone chamber air inlet 188 to conduit air outlet 328. In turn, this may enhance the air-tight character of the connection between cyclone chamber air inlet 188 and conduit air outlet 328. In the illustrated example, conduit air outlet 328 extends at a (non-zero) angle 340 to the direction 344 of airflow through conduit 128. Further, cyclone chamber air inlet 188 is shown extending at a mating angle 204.

Preferably, cyclone chamber air outlet 192 is fluidly coupled to the downstream airflow path as cyclone bin assembly 144 is mounted to main body 108. For example, main body 108 may include an air inlet that mates with cyclone chamber air outlet 192. In the illustrated example, upper wall 244 of recess 240 includes an air inlet 348. Recess air inlet 348 may be positioned and aligned to form a fluid connection with cyclone chamber air outlet 192 as cyclone bin assembly 144 is mounted to main body 108. In the example shown, both of cyclone chamber air outlet 192 and recess air inlet 348 extend vertically in the direction 336 of insertion.

Preferably, recess air inlet 348 and cyclone chamber air outlet 192 form a substantially air tight connection. This may mitigate an escape of air, and corresponding loss of suction at dirty air inlet 116. For example, mounting cyclone bin assembly 144 with main body 108 may urge cyclone chamber outlet 192 into firm contact with recess air inlet 348. Optionally, one or both of recess air inlet 348 and cyclone chamber outlet 192 may include a sealing member (e.g. a gasket or an O-ring) which may be compressed between recess air inlet 348 and cyclone chamber outlet 192 to enhance the air-tight characteristic of the connection.

Figure 14:
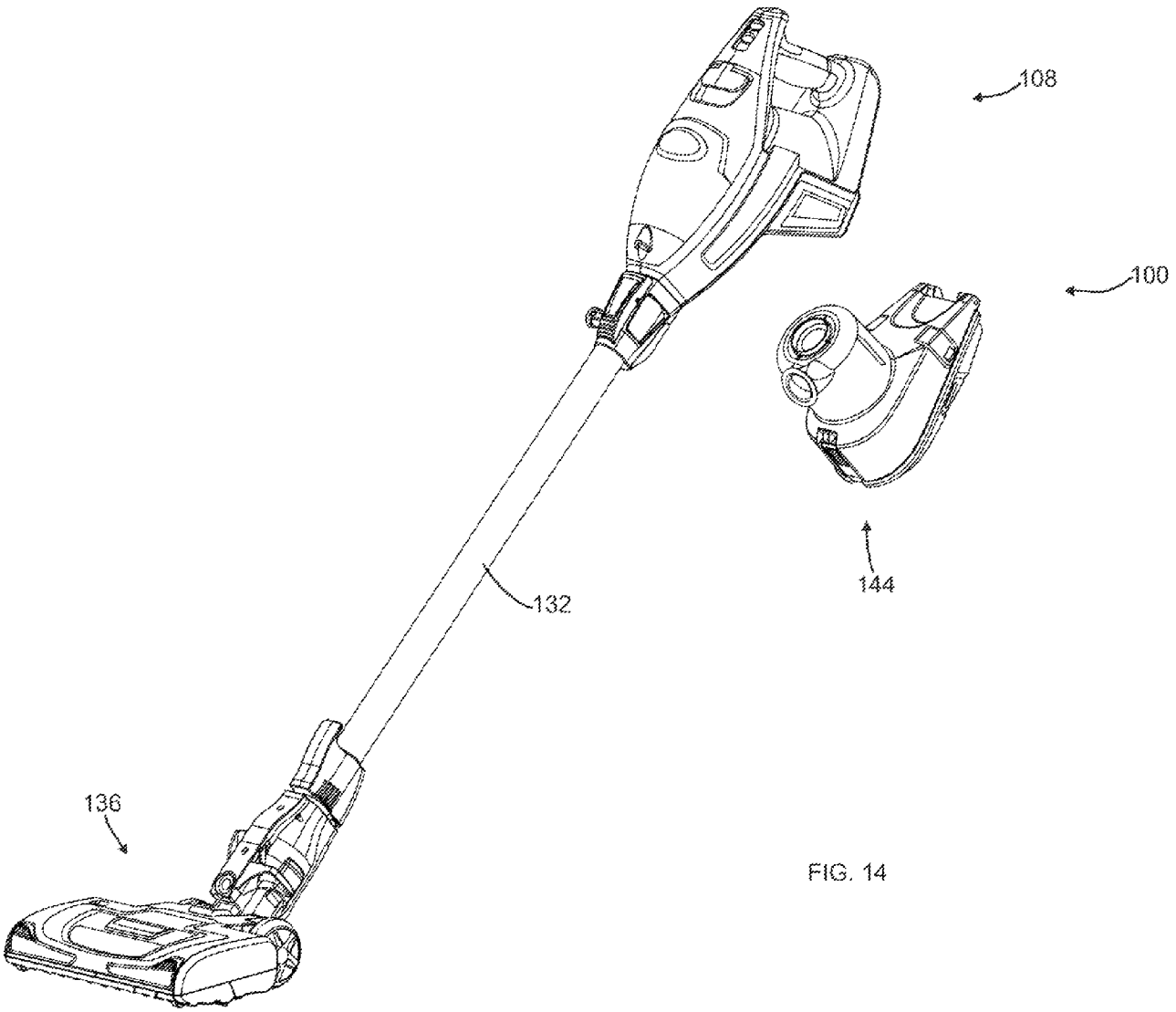
FIG. 14 is a front perspective view of the surface cleaning apparatus of FIG. 1 in the upright floor cleaning configuration of FIG. 2 with the cyclone bin assembly separated from the main body.

Accordingly, as the cyclone bin assembly is inserted into the recess, an air flow connection is made with both the outlet of conduit 128 and the inlet to the main body. Accordingly, as exemplified in FIG. 14, cyclone bin assembly 144 can be removed from main body 108 and replaced while one or more accessories, such as wand 132 and surface cleaning head 408, remain connected with main body 108. This may make removing cyclone bin assembly 144 hassle-free for users.

It will be appreciated that dirt collection chamber 160 may be emptyable while cyclone bin assembly 144 is mounted to main body 108 as well as when removed therefrom. This may permit a user to empty dirt collection chamber 160 without detaching cyclone bin assembly 144 from main body 108. For example, the release arm which retains lower wall 172 in the closed position may be accessible while cyclone bin assembly 144 is nested inside main body 108. In the illustrated example, latch 180, which releasably retains lower wall 172 in the closed position, is positioned outside recess 240 when cyclone bin assembly 144 is mounted to main body 108. This may permit a user to actuate latch 180 to release lower wall 172 and access an interior of cyclone bin assembly 144 (e.g. for emptying/cleaning) while cyclone bin assembly is mounted to main body 108 (see FIG. 8).

Figure 6:
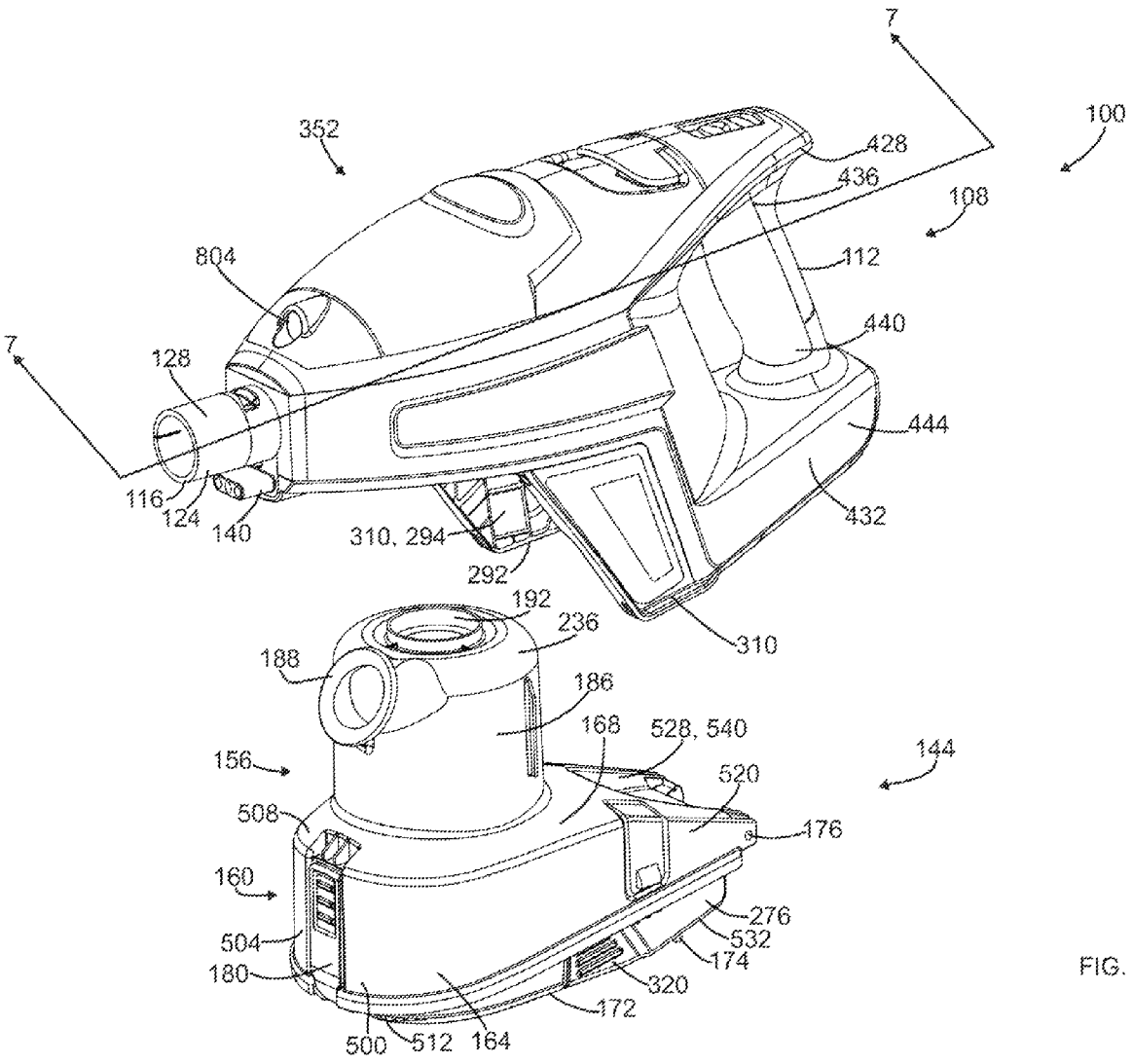
FIG. 6 is a front perspective view of the surface cleaning apparatus of FIG. 1 with the main body separated from a cyclone bin assembly.

Preferably, as shown in FIG. 6, cyclone bin assembly 144 may be detached from main body 108 as a substantially sealed unit (except for air inlet 188 and air outlet 192). This may permit cyclone bin assembly 144 to be separately transported to, e.g. a garbage receptacle, where latch 180 may be activated to pivot lower end wall 172 into the open position (see FIG. 9) and the contents of cyclone bin assembly 144 emptied into the garbage receptacle.

As exemplified, handle 112 may form part of main body 108 such that handle 112 remains with main body 108 when cyclone bin assembly 144 is detached. A user may grasp handle 112 while pulling on cyclone bin assembly 144, which may make separating cyclone bin assembly 144 from main body 108 easier.

It will be appreciated that any mounting structure may be used with other aspects of this disclosure.

Cyclone Bin Assembly Locking Mechanism

The following is a description of a locking mechanism for releasably securing a cyclone bin assembly that may be used by itself in any surface cleaning apparatus or in any combination or sub-combination with any other feature or features disclosed herein.

In accordance with this aspect, the locking mechanism includes a lock release actuator provided on the cyclone bin assembly. An advantage of this design is that the user may use the same hand to hold the cyclone bin assembly and actuate the lock release actuator, while using their other hand to hold the main body (e.g. by its handle). Thus, the user may simultaneously release and remove the cyclone bin assembly from the main body. It will be appreciated that, in accordance with this aspect, the lock release actuator may provide a structure suitable for a user to hold the cyclone bin assembly when removed from main body 108. For example, the lock release actuator may comprise two members provided on opposed sides of the cyclone bin assembly. It will be appreciated that, in one embodiment, the cyclone bin assembly may be as exemplified herein and may be removed as a sealed unit other than the air inlet and outlet. In other embodiments, the cyclone bin assembly may be removable is an open configuration (e.g., the cyclone bin assembly which is removed may have an open top) or only the dirt collection chamber may be removable. If only the dirt collection chamber is removable, it is preferably removable as a sealed unit other than the dirt inlet. However, in another embodiment, it may be removed with, e.g., an open top.

The cyclone bin assembly 144 may be releasably secured to main body 108 in any suitable fashion which enables the release actuator to be provided on the cyclone bin assembly 144. Accordingly, a locking mechanism 272 is provided which has an actuator on the cyclone bin assembly and a member to secure cyclone bin assembly 144 to main body 108. Alternately, if only the dirt collection chamber is removable, then the actuator may be provided on the dirt collection chamber and the member may secure the dirt collection chamber to the main body and/or the cyclone chamber. In some embodiments, the member may be part of the actuator or a separate part that is drivenly connected to the actuator.

As exemplified in FIGS. 6, 11, 11B, 12, and 12B, apparatus 100 includes a locking mechanism 272 which has a locked position in which cyclone bin assembly 144 is secured to main body 108, and an unlocked position in which cyclone bin assembly 144 is removable (e.g. freely removable) from main body 108.

As exemplified, locking mechanism 272 comprising two actuators 276 each of which is drivingly connected to a movable engagement member such as a release arm 280. Actuators 276 are operable to move the engagement members into and optionally out of engagement with main body 108 to selectively place locking mechanism 272 in the locked and unlocked positions. The movable engagement members are movable into engagement with main body 108 for securing cyclone bin assembly 144 to main body 108 in the locked position of locking mechanism 272, and movable to disengage from main body 108 for releasing cyclone bin assembly 144 from main body 108 in the unlocked position of locking mechanism 272. Accordingly, actuator may have a first portion that is operated, e.g., pressed, by a user and a second portion that engages release arm 280 and release arm 280 may have a first portion that is driven by the second portion of the actuator and a second portion that engages or lock to the main body 108.

It will be appreciated that locking mechanism 272 may include one or more actuators and a similar number of release arms 280. It will also be appreciated that one or both of the actuators and the engagements members may be biased into the locked position. For example, actuator 276 may be biased to the locked position and may be drivingly connected to release arm 180 to move release arm into both the locked and the unlocked position. Alternately, or in addition, release arm 280 may be biased to the locked position and may be drivingly connected to actuator 276 to move actuator 276 into both the locked and the unlocked position The actuators of locking mechanism 272 may be positioned at any suitable location or locations on cyclone bin assembly 144. For example, each of the actuators 276 may be positioned on cyclone chamber 156 or dirt collection chamber 160. In some cases, it may be convenient to locate actuators 276 on a bottom of cyclone bin assembly 144. This may permit a user to easily grasp actuators 276 from beneath cyclone bin assembly 144 while cyclone bin assembly 144 is nested in main body 108.

In the illustrated example, locking mechanism 272 includes two actuators 276. As shown, actuators 276 are positioned on lower wall 172 of the dirt collection chamber 160 on opposed left and right sides of cyclone bin assembly 144. This configuration may permit a user to grasp and operate both actuators 276 simultaneously from below cyclone bin assembly 144. For example, the user may place their thumb on one actuator 276 and their other fingers on the second actuator 276 with their palm face up, and then squeeze the two actuators toward each other to operate the actuators 276 and thereby move the engagement members out of engagement with main body 108 and unlock locking mechanism 272. The user may rely upon the grip on cyclone bin assembly 144 developed from squeezing actuators 276 together to withdraw cyclone bin assembly 144 from main body 108.

Release arms 280 are provided on opposed left and right sides of cyclone bin assembly 144 (e.g., release arms 280 may be mounted on the sidewalls 164 of dirt collection chamber 160) and are positioned and configured so as to be engaged by actuator 276. Further, release arms may be located internal of main body 108 when the cyclone bin assembly is mounted to the main body and therefore release arms 280 may be protected from damage or accidental operation such as by being hit against a piece of furniture during use. As exemplified, a portion of the dirt collection chamber is positioned interior of the main body when the cyclone bin assembly is mounted to the main body. Accordingly, release arms 280 may be provided on the dirt collection chamber at a location that will result in release arms being covered by a protective wall when the cyclone bin assembly is mounted to the main body.

Each release arm 280 includes an engagement member (e.g., an outward protrusion 284 on an outer surface 288 thereof) suitable for releasable engagement with main body 108 in the locked position of locking mechanism 272. If the engagement member of release arm 280 is located internal of main body 108, then the mating engagement member on main body 108 may also be positioned internal of main body 108. As exemplified, main body 108 includes a mating engagement member (e.g., an inward protrusion 292 on an inner surface 294 of main body 108) for engagement with the locking mechanism engagement member. Outward protrusion 284 and inward protrusion (e.g. lip) 292 are examples of engagement members. Other examples of suitable engagement members include oppositely charged magnets, hook and loop fasteners, and mating male/female snap components.

It will be appreciated that the mating engagement member on main body 108 may be provided on any suitable inner surface of main body 108. For example, an engagement member may be provided on an inner surface of recess 240. In the illustrated example, recess 240 further includes a rear portion 308 for receiving a further portion of cyclone bin assembly 144. As shown, recess rear portion 308 is defined at least in part by sidewalls 310, upper wall 312, and rear wall 314. A forward end 316 of rear portion 308 is preferably contiguous with the front portion of recess 240. As illustrated, forward end 316 of rear portion 308 is coincident with rear wall 252 of the forward portion of recess 240. In the example shown, protrusions 292 extend inwardly from an inner surface 294 of each sidewall 310.

Each release arm 280 may have any suitable configuration that permits it to move from a locked position in which the release arm engagement member may engage with main body 108, and an unlocked position in which the release arm engagement member is disengaged from main body 108. In the illustrated example, release arms are located inside main body 108 when cyclone bin assembly 144 is mounted thereto. Accordingly, release arms 280 are movable in a manner that permits outward protrusion 284 to move outwardly into engagement with main body 108 to a locked position (see FIG. 11), and to move inwardly out of engagement with main body 108 to an unlocked position (see FIG. 12). In alternative embodiments, release arms 280 may movable in a manner that permits the corresponding engagement member to move in a different direction (e.g. forwardly, rearwardly, upwardly, or downwardly) into and out of engagement with main body 108.

Each release arm 280 may be mounted to cyclone bin assembly 144 in any suitable manner to permit the corresponding engagement member to move between the locked and unlocked positions. In the illustrated example, release arms 280 are pivotally mounted to cyclone bin assembly 144 for pivoting between the unlocked and locked positions. As shown, each release arm 280 can pivot about an axis of rotation 298 between the unlocked and locked positions. Protrusions 284 move outwardly to engage with main body 108 when release arms 280 pivot in one direction, and move inwardly to disengage from main body 108 when release arms pivot 280 pivot in the other direction. In alternative embodiments, a release arm 280 may be, e.g., slideably mounted to cyclone bin assembly 44 for translating between the unlocked and locked positions.

In the illustrated example, each release arm 280 extends between a drive end 300 and a body engagement end 302, and the pivot mount is located between the body engagement and drive ends 300 and 302. Preferably, one or more of release arms 280 are biased to the locked position using a biasing member. For example, a biasing member such as a linear or torsional spring (not shown) may act upon a release arm 280 to rotate the release arm 280 toward the locked position. As shown, in the locked position, body engagement end 302 of release arm 280 may contact dirt collection chamber 160 which may inhibit further rotation about axis 298 in that direction.

Preferably, each actuator 276 is drivingly connected to a corresponding release arm 280 for moving the release arm 280 to the unlocked position. For example, each actuator 276 may be drivingly connected to, e.g., in contact with, the drive end 300 of a corresponding release arm 280, and inwardly movable for urging the drive end 300 to move inwardly toward the unlocked position. In the illustrated example, each actuator 276 includes a drive end 304 positioned in overlapping relation to a release arm drive end 300, and inwardly movable for driving the drive end 300 toward the unlocked position. As shown, actuator drive end 304 is positioned outboard of release arm drive end 300, such that moving the actuator drive end 304 inward (e.g. by squeezing actuators 276 together) pushes release arm drive ends 300 inwardly (which disengages release arm protrusions 284 from main body 108).

Each actuator 276 may be movable in any manner suitable for driving release arms 280 into the unlocked and/or locked positions. Preferably, actuators 276 are hand-operable. In the illustrated example, each actuator 276 is pivotally mounted to cyclone bin assembly 144. As shown, each actuator 276 is rotatable about an axis 306 at a pivot end 305 opposite drive end 304. In use a user may drive a release arm 280 to the unlocked position by applying force between pivot and drive ends 304 and 305 of the corresponding actuator 276 to pivot the actuator 276 and its drive end 304 inwardly.

Preferably, actuators 276 are biased toward the locked position (in this case outwardly). For example, a biasing member such as a spring, may act upon each actuator 276 so that the actuator 276 is normally in the locked position. This may permit actuators 276 to return to the locked position when the user releases the actuators 276 (e.g. after replacing cyclone bin assembly 144 inside main body 108).

Preferably, at least a portion of each actuator 276 is accessible while cyclone bin assembly 144 is secured to main body 108 by locking mechanism 272. For example, at least a portion of each actuator 276 may be positioned outside of recess 240. In the illustrated example, a bottom end 318 of sidewalls 310 of recess 240 is positioned above actuators 276 so that actuators 276 are positioned outside of recess 240 and are accessible while cyclone bin assembly 144 is secured to main body 108.

Preferably, a user may manipulate actuators 276 on cyclone bin assembly 144 with one hand to disengage and detach cyclone bin assembly 144, while grasping main body 108, e.g. by handle 112, with their other hand. This may permit cyclone bin assembly 144 to be detached from main body 108 simply and quickly. In the illustrated example, cyclone bin assembly 144 includes two actuators 276 positioned on opposite sides of cyclone bin assembly 144. Optionally, actuators 276 may include a gripping portion 320 to direct users where to apply pressure to activate the actuator 276. In use, the user may position their thumb on the gripping portion 320 of one actuator 276 and their other fingers on the gripping portion 320 of the other actuator 276, and then squeeze to rotate both actuators 276 inwardly and thereby more the locking mechanism 272 to the unlocked position. Afterward, the user may rely upon the grip obtained by squeezing actuators 276 to withdraw dirt collection chamber 160 from main body 108, while continuing to grasp main body 108 with their other hand.

Preferably, all moving parts of locking mechanism 272 are positioned on cyclone bin assembly 144. In the illustrated example, inward protrusion 292 is the only component of locking mechanism 272 that is not positioned on cyclone bin assembly 144, and it is preferably a static, non-movable element.

The dirt collection chamber 160 is preferably openable for emptying cyclone bin assembly 144 while cyclone bin assembly 144 remains secured to main body 108. Accordingly, as exemplified in FIG. 8, lower wall 172 of dirt collection chamber 160 may be openable while cyclone bin assembly 144 remains secured to main body 108. Since actuators 276 are positioned on openable lower wall 172, opening lower wall 172 may move actuators 276 away from a remainder of cyclone bin assembly 144 and from main body 108. As exemplified, actuators 276 are provided on openable lower wall 172 and release arms are located on other than the openable lower wall 172 (e.g., a non-moveable portion of the cyclone bin assembly) actuators 276 disengage, and optionally automatically disengage, from release arms 280 when lower wall 172 is opened, and automatically reestablish a driving connection to release arms 280 when lower wall 172 is reclosed. In the illustrated example, each drive end 304 slides downwardly away from and out of overlapping relationship with drive end 300 when lower wall 172 is opened, and moves back toward and into overlapping relationship with drive end 300 when lower wall 172 is closed.

In this embodiment, outward protrusion 284 remains engaged with main body 108 when lower wall 172 is opened. It will be appreciated that since actuators 276 have been moved out of driving engagement with release arms 280 and that since release arms 280 are located interior of main body 108, this mitigates the risk of accidentally releasing cyclone bin assembly 144 from main body 108 when lower wall 172 is open.

It will be appreciated that, in an alternate embodiment, lower wall 172 may not be openable. In another embodiment, actuator 276 may be provided above lower openable wall 172. In any such embodiment, actuator 276 may be provided with the member that engages main body 108. For example, protrusion 284 may be provided on actuator 276 or actuator 276 and release arm 280 may be a unitary construction (e.g., they may be integrally molded together.

It will be appreciated that any locking mechanism may be used with other aspects of this disclosure.

Pre-Motor Filter

Optionally, one or more pre-motor filters may be placed in the air flow path between the cyclone bin assembly and the suction motor. Alternatively, or in addition, one or more post-motor filters may be provided downstream from the suction motor. The following is a description of a pre-motor filter housing construction that may be used by itself in any surface cleaning apparatus or in any combination or sub-combination with any other feature or features disclosed herein.

Figure 13:
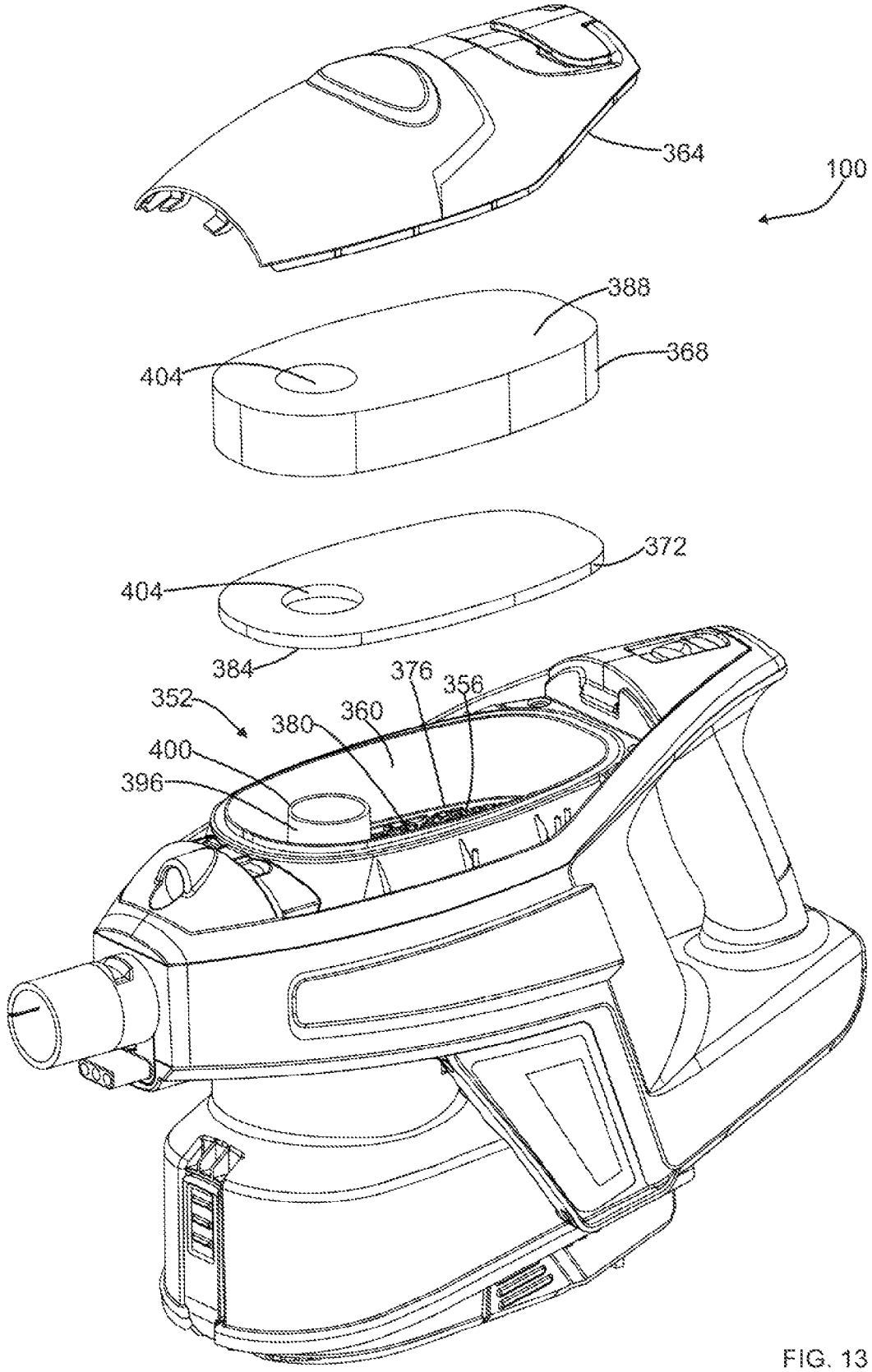
FIG. 13 is a front perspective view of the surface cleaning apparatus of FIG. 1 wherein the pre-motor filter assembly is shown in an exploded configuration.

Referring to FIGS. 4 and 13, in the illustrated embodiment a pre-motor filter chamber (i.e. housing) 352 is provided as a portion of main body 108 of surface cleaning apparatus 100, above recess 240 that receives cyclone bin assembly 144. As shown, pre-motor filter chamber 352 is bounded by a bottom wall 356, a sidewall 360 and an upper wall 364. In the illustrated example the upper wall 364 is provided by an upper cover 368. Preferably, at least one of the bottom wall 356, sidewall 360 and upper cover 368 are openable to allow access to the interior of the pre-motor filter chamber. In the illustrated embodiment, the upper cover 368 is removable (FIG. 13) to provide access to the interior of chamber 352. Alternatively, instead of being removable the upper cover 368 may be pivotally openable or otherwise moveably coupled to the main body.

One or more filters may be positioned within the pre-motor filter chamber 352 to filter fine particles from the air stream entering recess air inlet 348, before it flows into the inlet of the suction motor 148. The filters may be of any suitable configuration and formed from any suitable materials. In the illustrated embodiment, a foam filter 368 and a downstream felt filter 372 are positioned within the pre-motor filter chamber 352. As shown, pre-motor filter chamber 352, as well as filters 368 and 372, are positioned above recess 240.

In the illustrated example, the bottom wall 356 includes a plurality of upstanding support ribs 376 to support the filters 368 and 372 positioned within the chamber 352. The support ribs 376 may hold the filters 368 and 372 above the surface of the bottom wall 356 to define a lower header or headspace 380, to allow for air to flow laterally between the bottom surface 384 of filter 372 and the bottom wall 356.

In the illustrated embodiment, the upstream side 388 of the foam filter 368 is provided facing the openable lid. Accordingly, air flows generally downwardly through the filters 368 and 372 to suction motor inlet 390. The upper cover 368 is optionally shaped so that when it is closed (FIG. 4) an upper or upstream headspace or header 392 is provided between the inner surface of the upper cover 364 and the upstream side 388 of the foam filter 368. To provide air flow communication between the cyclone air outlet 192 and the upstream headspace 392, it is preferred that the vortex finder 396 or an extension thereof extends through the pre-motor filters 368 and 372 and preferably extends into the interior of the pre-motor filter chamber 352, through the filters 368 and 372 therein, and has an outlet end 400 that is located within the upstream head space 392 above filters 368 and 372. To accommodate the extension of the vortex finder 396, each filter 368 and 372 includes a correspondingly shaped conduit aperture 404 (FIG. 13). It will be appreciated that other flow paths may be used to connect vortex finder 396 in air communication with upstream headspace 392.

As exemplified, the pre-motor filter chamber 352, and the filters therein 368 and 372, are positioned above the cyclone chamber 156 and the suction motor. An advantage of this design is that the upstream face of the pre-motor filter may have a larger cross sectional area. A further advantage is that the pre-motor filter chamber 352 may also essentially function as an air flow passage from the cyclone to the suction motor (e.g., as exemplified, lower header 380 has an outlet leading down into the suction motor).

When surface cleaning apparatus 100 is in use, air exiting cyclone chamber air outlet 192 may flow into recess air inlet 348 and through vortex finder 396 into upstream head space. Within the upstream headspace 392 the air can flow laterally across the upstream surface 388 of the foam filter 368, and down through filters 368 and 372 into downstream head space 380 toward suction motor inlet 390. As shown, suction motor inlet 390 may be positioned in an upper end 428 of main body 108, and suction motor outlet 406 may be positioned in a lower end 432 of main body 108.

Position and Orientation of the Suction Motor

The following is a description of position and orientation of the suction motor that may be used by itself in any surface cleaning apparatus or in any combination or sub-combination with any other feature or features disclosed herein.

Figure 20:
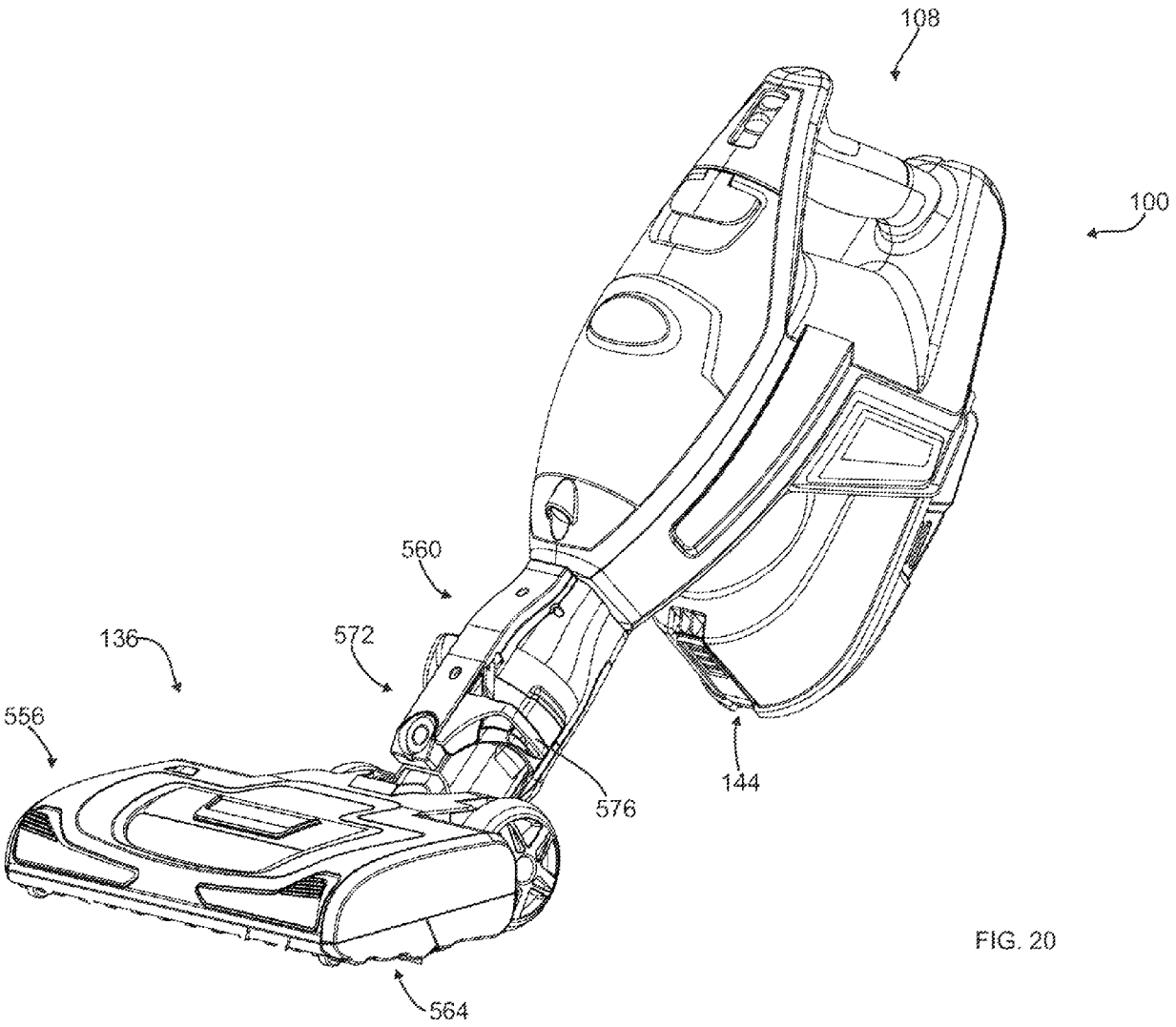
FIG. 20 is a perspective view of the surface cleaning apparatus of FIG. 1 directly connected to the surface cleaning head.
Figure 22:
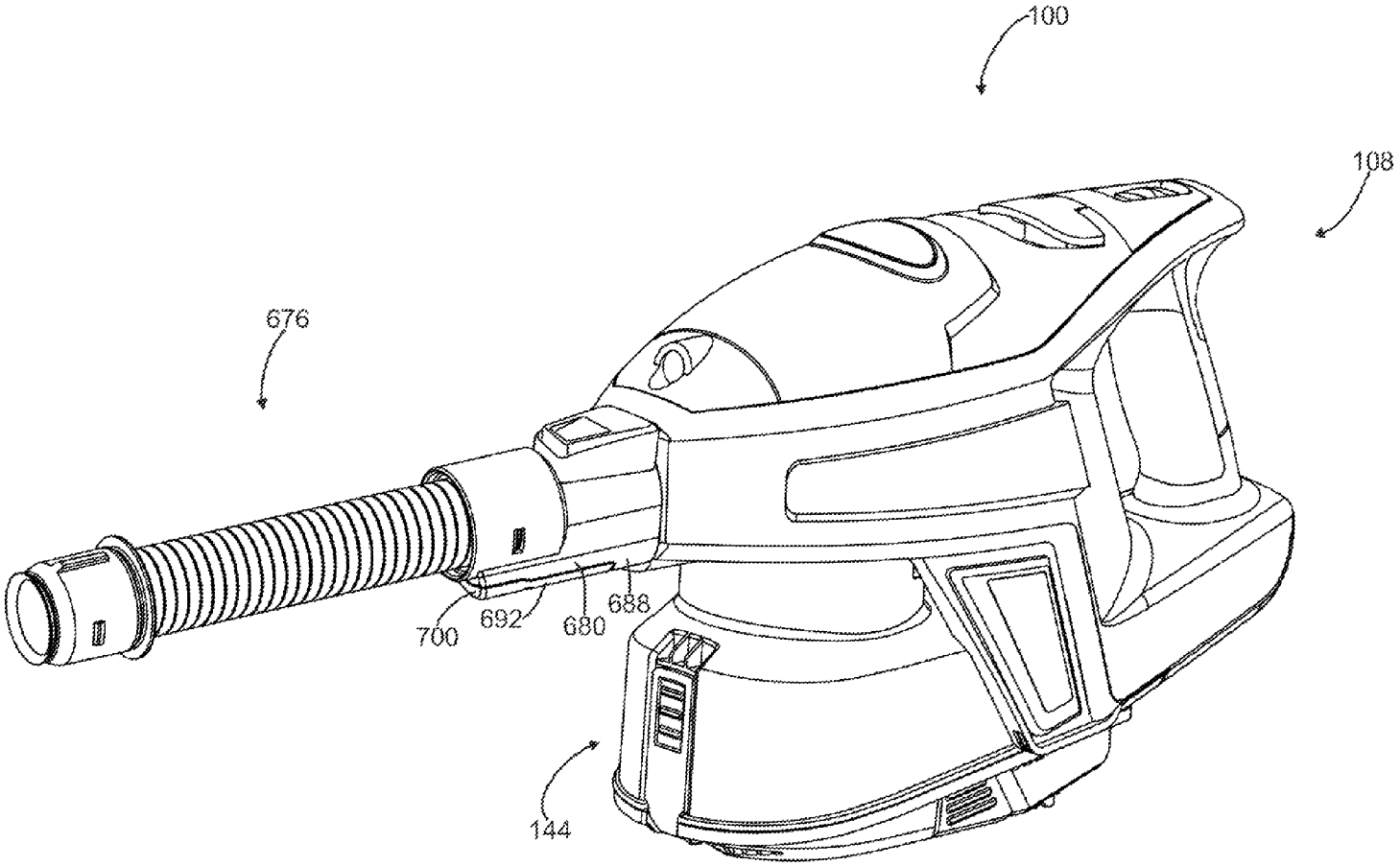
FIG. 22 is a front perspective view of the surface cleaning apparatus of FIG. 1 with an attached hose accessory.

In accordance with this aspect, suction motor 148 is positioned and oriented relative to handle 112 in manner which may improve the balance of surface cleaning apparatus 100 when it is used in a hand held mode as exemplified in FIG. 20 and FIG. 22. A large proportion of the weight of surface cleaning apparatus 100 may be attributed to suction motor 148. Accordingly, the position and orientation of suction motor 148 may significantly influence the balance and hand weight of surface cleaning apparatus 100 when handled by a user. In accordance with this aspect, the suction motor is positioned proximate handle 112. It will be appreciated that the closer the suction motor is to handle 112, the smaller the moment arm between the handle and the center of gravity of the suction motor. As a result, a user will have to exert less force to maintain surface cleaning apparatus 100 at a desired orientation while in a hand held cleaning mode.

In order to reduce the moment arm between the handle and the center of gravity of the suction motor, suction motor 148 may be positioned forward or rearward of handle 112 but proximate thereto so as to reduce the forward/rearward moment arm. Similarly, suction motor 148 may be positioned generally between the top and bottom of handle 112 so as to reduce the vertical moment arm. In such a configuration, the center of gravity of suction motor is between the top and bottom of handle 112.

Handle 112 has a handle axis 424. The angle of handle axis 424 may be selected to enhance the operating ergonomics of the vacuum cleaner (e.g., the handle may be oriented to so that the wrist of a user is at a desired orientation, such as a neutral orientation to the user's arm, when using the vacuum cleaner). Accordingly, while handle axis 424 may be oriented at any suitable angle to horizontal and vertical axes 408 and 412, handle axis 424 may be angled at between 5 to 45 degrees from vertical axis 412 and, more preferably, at about 30 degrees.

Handle 112 may generally extend along handle axis 424 at any suitable location on main body 108. For example, handle 112 may be mounted between upper and lower ends 428 and 432 of main body 108. In the illustrated example, handle 112 includes an upper end 436 mounted to main body upper end 428, and a lower end 440 mounted to main body lower end 432. Further, as shown, handle 112 is mounted to the rear end 444 of main body 108. In the illustrated example, motor center of gravity 420 is positioned between upper and lower end 436 and 440 of handle 112.

The angle of suction motor 148 relative to the horizontal and vertical axes 408 and 412 may be selected to position the center of gravity of suction motor 148 as close to handle 112, and optionally as close to handle 112 as possible, to thereby improve the balance of surface cleaning apparatus 100 in some modes of operation. As exemplified, motor axis 416 is approximately parallel to handle 112. Therefore, as with handle 112, motor axis 416 may be angled forwardly between 5 degrees and 45 degrees from vertical axis 412 of apparatus 100. In the illustrated example, motor axis 416 is angled forwardly approximately 30 degrees from vertical axis 412. Accordingly, handle axis 424 and motor axis 416 are parallel and angled approximately 30 degrees to vertical axis 412.

In this orientation, the distance between handle 112 and suction motor 148 remains generally constant. An advantage of this design is that the mass of suction motor 148 is maintained as close as possible to handle 112 as permitted by the geometry of main body 108. For example, as exemplified in FIG. 4, handle 112 is spaced from motor housing 152 so as to define a gap 452 in which a user may place the user's fingers while gripping handle 112. Motor housing 152 is located in main body 108 on the opposite side of gap 452 from handle 112. Therefore, the center of gravity 420 of suction motor 148 is located forward of and as close as possible to handle 112 allowing for gap 452.

As exemplified, the center of gravity 420 of suction motor 148 is also located generally between the top and bottom of handle 112. Accordingly, the vertical moment arm is reduced. It some embodiments, it will be appreciated that part of the suction motor may extend above the top of handle 112 and/or below the bottom of handle 112. For example, if the suction motor is longer than the handle, the suction motor may be positioned along handle 112 such that the center of gravity is between the top and bottom of handle 112 and preferable such that the center of gravity 420 of suction motor 148 is located proximate a midpoint of handle 112 between the top and bottom of handle 112.

In the exemplified embodiment, it will also be appreciated that the center of gravity 420 of suction motor 148 is also located below the upper end 256 of cyclone bin assembly 144.

In other embodiments, it will be appreciated that suction motor 148 may be oriented inside main body 108 at any angle to horizontal axis 408 and vertical axis 412 of surface cleaning apparatus 100.

Clean air outlet 120 may be positioned on a lower end 432 of main body 108. For example, clean air outlet 120 may be positioned on a lower surface 448 of main body 108. In the example shown, clean air outlet 120 is positioned directly beneath handle 112.

It will be appreciated that any position and orientation of the suction motor may be used with other aspects of this disclosure.

Enhanced Dirt Collection Capacity

The following is a description of a dirt collection chamber that may be used by itself in any surface cleaning apparatus or in any combination or sub-combination with any other feature or features disclosed herein.

In accordance with this aspect, the capacity of a dirt collection chamber for a cyclone may be increased by extending the dirt collection chamber outwardly from beneath cyclone chamber 156 to occupy space generally beneath main body 108. For example, dirt collection chamber 160 may extend forwardly and/or rearwardly of cyclone chamber 156.

In accordance with this aspect, suction motor 148 may be angled. Accordingly, the vertical distance occupied by the suction motor (i.e., the vertical extent between the top and bottom of suction motor 148) is reduced and this may enable part of the dirt collection chamber to extend under suction motor 148. An advantage of this design is that enhanced dirt collection capacity may be provided with a small increase in the footprint of the vacuum cleaner 100. Accordingly, surface cleaning apparatus 100 may collect more dirt before emptying, and yet still be maneuverable and easy to handle.

Figure 15:
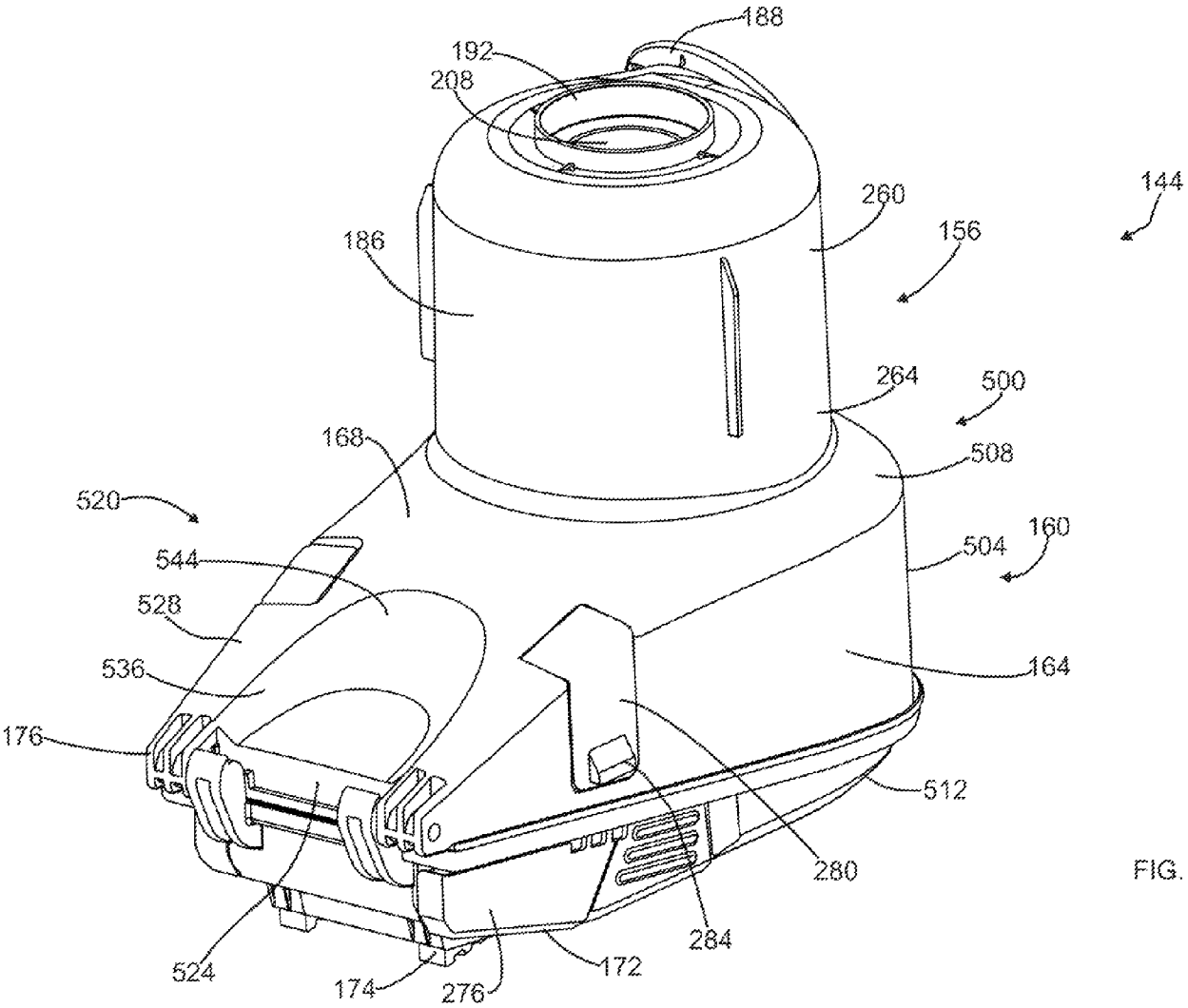
FIG. 15 is a rear perspective view of the cyclone bin assembly.
Figure 16:
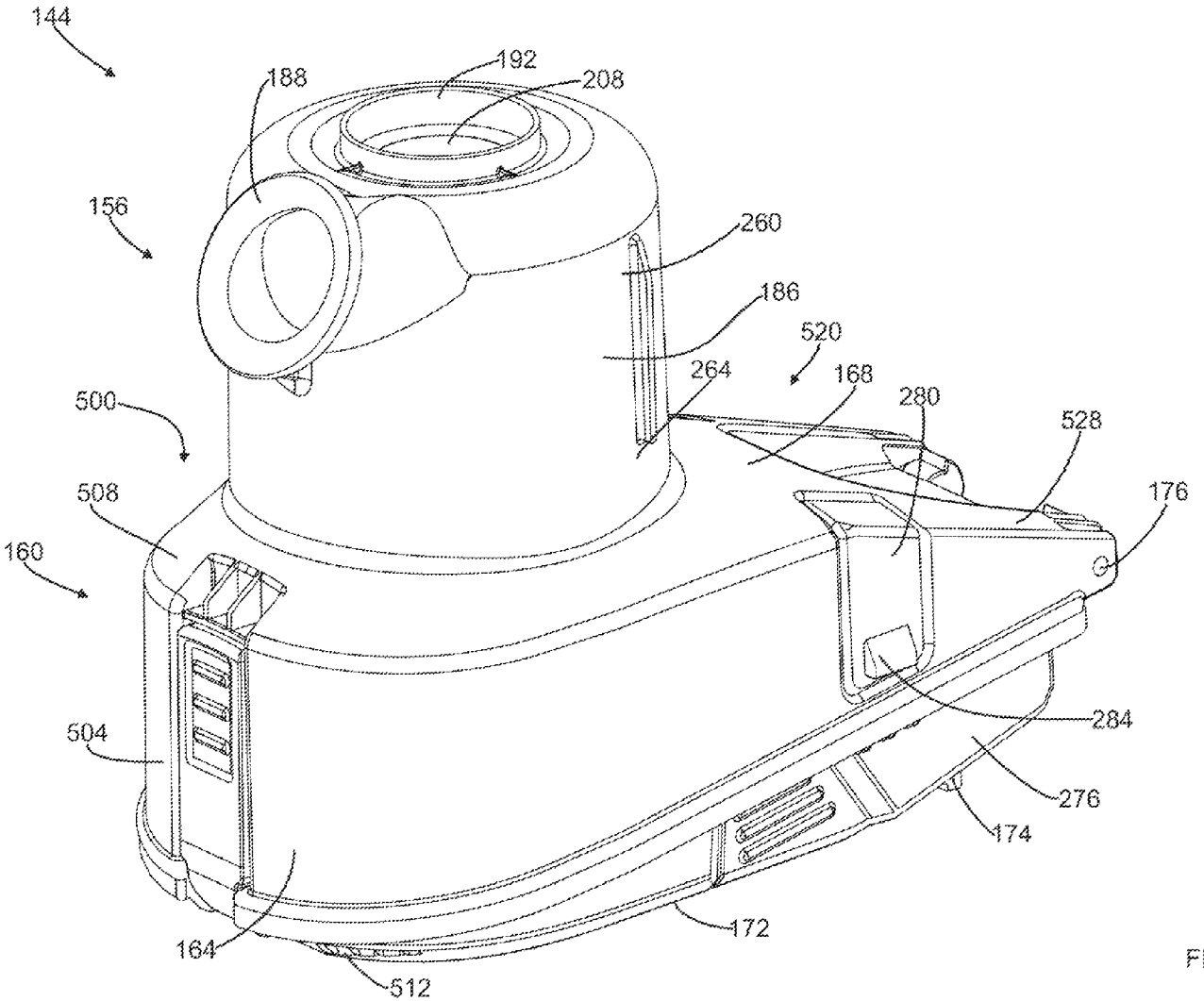
FIG. 16 is a front perspective view of the cyclone bin assembly.

FIGS. 4, 15, and 16 exemplify a surface cleaning apparatus 100 that has a compact design with a high capacity dirt collection chamber. In the illustrated example, dirt collection chamber 160 extends both forwardly and rearwardly of cyclone chamber 156. As shown, dirt collection chamber 160 includes a forward portion 500 positioned forward of cyclone chamber 156, and a rear portion 520 positioned rearward of cyclone, chamber 156.

Forward portion 500 is bounded by a front wall 504, a forward portion 508 of upper wall 168, and a forward portion 512 of lower wall 172, all of which is positioned forward of cyclone chamber 156. Forward portion 500 may provide additional volume to dirt collection chamber 160, and/or may permit dirt collection chamber 160 to provide the same volume with a lesser height 516. In alternative embodiments, dirt collection chamber 160 may not extend forward of cyclone chamber 156.

Rear portion 520 is bounded by a rear wall 524, a rear portion 528 of upper wall 168, and a rear portion 532 of lower wall 172. Rear portion 520 may provide additional volume to dirt collection chamber 160, and/or may permit dirt collection chamber 160 to provide the same volume with a lesser height 516. In alternative embodiments, dirt collection chamber 160 may not extend rearward of cyclone chamber 156.

Dirt collection chamber 160 may extend under at least a portion of suction motor 148. For example, suction motor 148 may be positioned rearward of cyclone chamber 156 and at least part of rear portion 520 of dirt collection chamber 160 may be positioned under at least a portion of suction motor 148. Optionally, rear portion 520 of dirt collection chamber 160 may be positioned under all of suction motor 148.

Preferably, dirt collection chamber 160 may be shaped to efficiently occupy the space available under main body 108. For example, dirt collection chamber 160 may include one or more walls shaped to generally follow the contours of one or more walls of main body 108. In some embodiments, dirt collection chamber 160 may include a recess for receiving at least a portion of the suction motor housing. In the illustrated example, rear portion 528 of upper wall 168 includes a recess 536 for receiving a lower portion of suction motor 148. More specifically, rear portion 528 of upper wall 168 has a surface 540 angled downwardly toward rear end 444 of apparatus 100 to define recess 536. Downwardly angled surface 540 may generally correspond with the downwardly angled outer surface 544 of motor housing 152. This may permit rear portion 520 of dirt collection chamber 160 to partially surround motor housing 152 to occupy the space below and around motor housing 152 for additional storage capacity.

Cyclone chamber 156 includes one or more dirt outlets in communication with the dirt collection chamber. The cyclone chamber dirt outlet may be positioned to preferentially direct dirt toward the furthest wall of dirt collection chamber 160. In the illustrated example, dirt collection chamber 160 extends farther rearwardly of cyclone chamber 156 than it does forwardly of cyclone chamber 156 and dirt outlet 196 is positioned in a rear side of cyclone chamber sidewall 186. In use, dirt may be propelled rearwardly from cyclone chamber 156 through rear dirt outlet 196 to the rear portion 520 of dirt collection chamber 160.

It will be appreciated that any dirt collection chamber structure may be used with other aspects of this disclosure.

Wand Release

The following is a description of a wand release mechanism that may be used by itself in any surface cleaning apparatus or in any combination or sub-combination with any other feature or features disclosed herein.

In accordance with this aspect, a wand release is provided that may be operated by a user while cleaning using surface cleaning apparatus 100 so that a user need not shut of the surface cleaning apparatus to reconfigure the surface cleaning apparatus to, e.g., an above floor cleaning configuration. Accordingly, the wand release may be operable by a user's foot, such as by a foot pedal. The user may step on the wand release to release the wand while continuing to operate the surface cleaning apparatus 100.

Figure 14B:
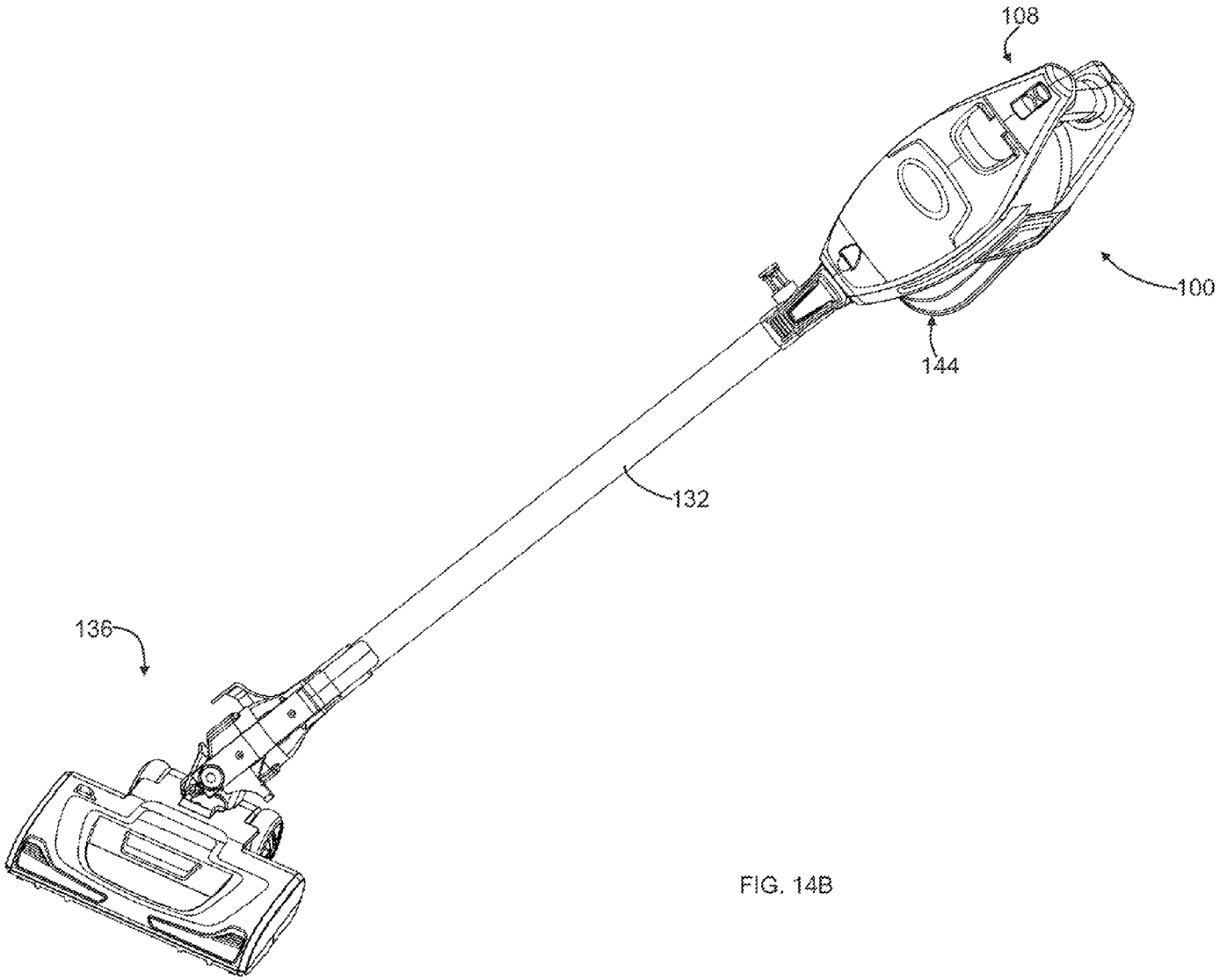
FIG. 14B is a front perspective view of the surface cleaning apparatus of FIG. 1 in the upright floor cleaning configuration of FIG. 2 with a surface cleaning head maneuvered to one side.

As exemplified in FIGS. 2, and 17-19 inlet end 124 of surface cleaning apparatus 100 may be connected, and preferably releasably connected, in air flow communication with a surface cleaning head 136, such as via a wand 132 that is pivotally connected to surface cleaning head 136. When surface cleaning apparatus 100 is mounted to the downstream end of wand 132 and wand 132 is connected to surface cleaning head 136, surface cleaning apparatus 100 may be used to clean a floor or other surface in a manner analogous to conventional upright-style vacuum cleaners. Accordingly, surface cleaning apparatus 100 may be pivoted from an upright storage position (FIG. 2) to an in-use position, and then manipulated to maneuver surface cleaning head 136 over a surface for cleaning (FIG. 14B).

In the illustrated example, wand 132 includes an upper end 548 removably mounted to conduit 128, and a lower end 552 removably mounted to surface cleaning head 136. Preferably, surface cleaning head 136 includes an upstream portion 556 pivotally connected to a downstream portion 560. Surface cleaning head 136 may be any surface cleaning head known in the art. Accordingly, upstream portion 556 may include a rotatably mounted brush roll, a brush roll motor and wheels. In the illustrated example, upstream portion 556 includes a cleaning head dirty air inlet 564, and downstream portion 560 includes an air outlet 568.

In use, the surface cleaning apparatus 100 may be manipulated to selectively pivot downstream portion 560 relative to upstream portion 556 for maneuvering upstream portion 556 (and dirty air inlet 116) over a surface for cleaning. Wand 132 may also be rotatably or otherwise moveably mounted to downstream portion 560 so as to be steeringly coupled to surface cleaning head 136.

In some embodiments, surface cleaning apparatus 100 may be directly connected to surface cleaning head 136. For example, conduit 128 may directly connect to surface cleaning head 136 (see FIG. 20).

Figure 17:
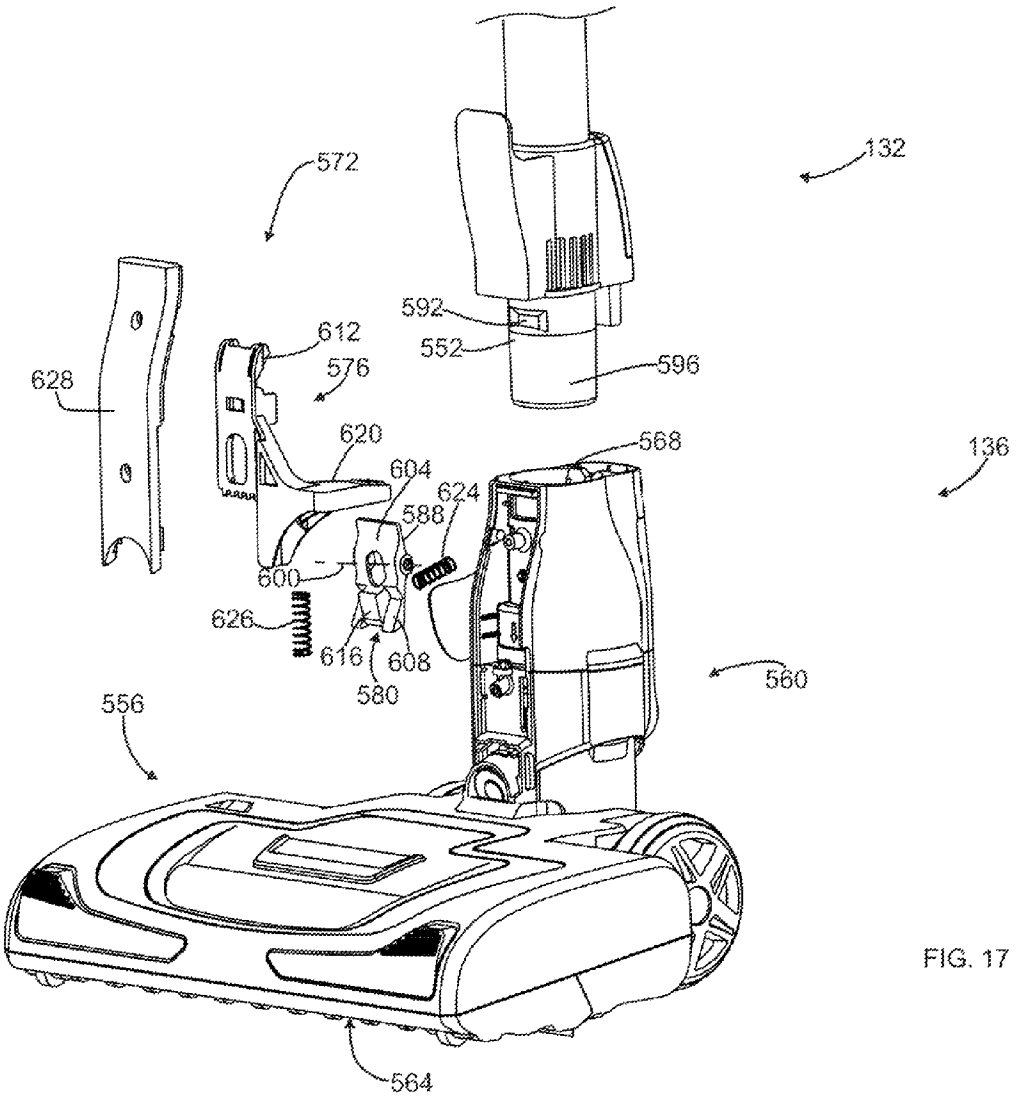
FIG. 17 is a partial exploded front perspective view of the surface cleaning head and a wand.
Figure 18:
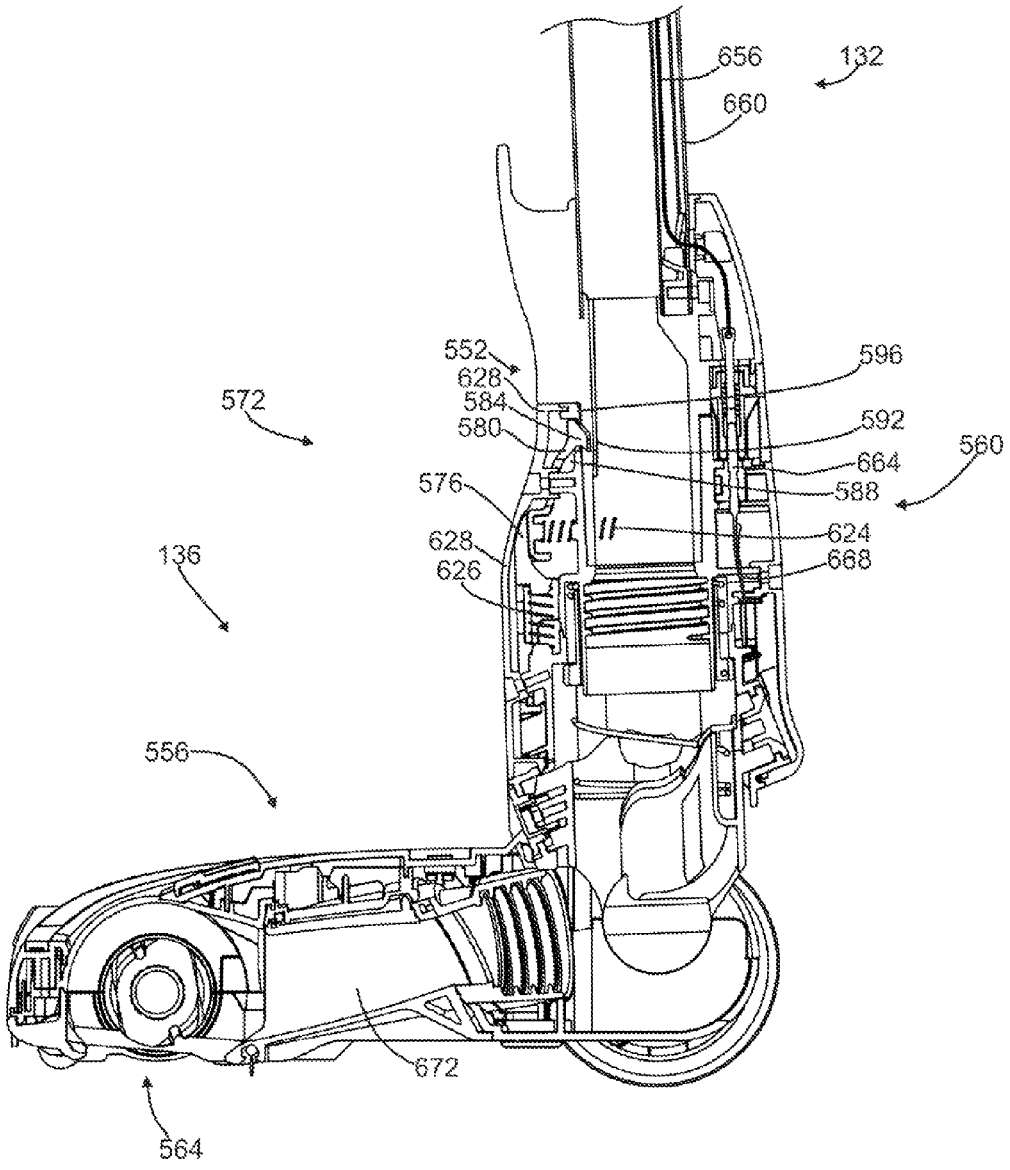
FIG. 18 is a partial cross-sectional view taken along line 18-18 in FIG. 2 with a locking mechanism in a locked position.
Figure 19:
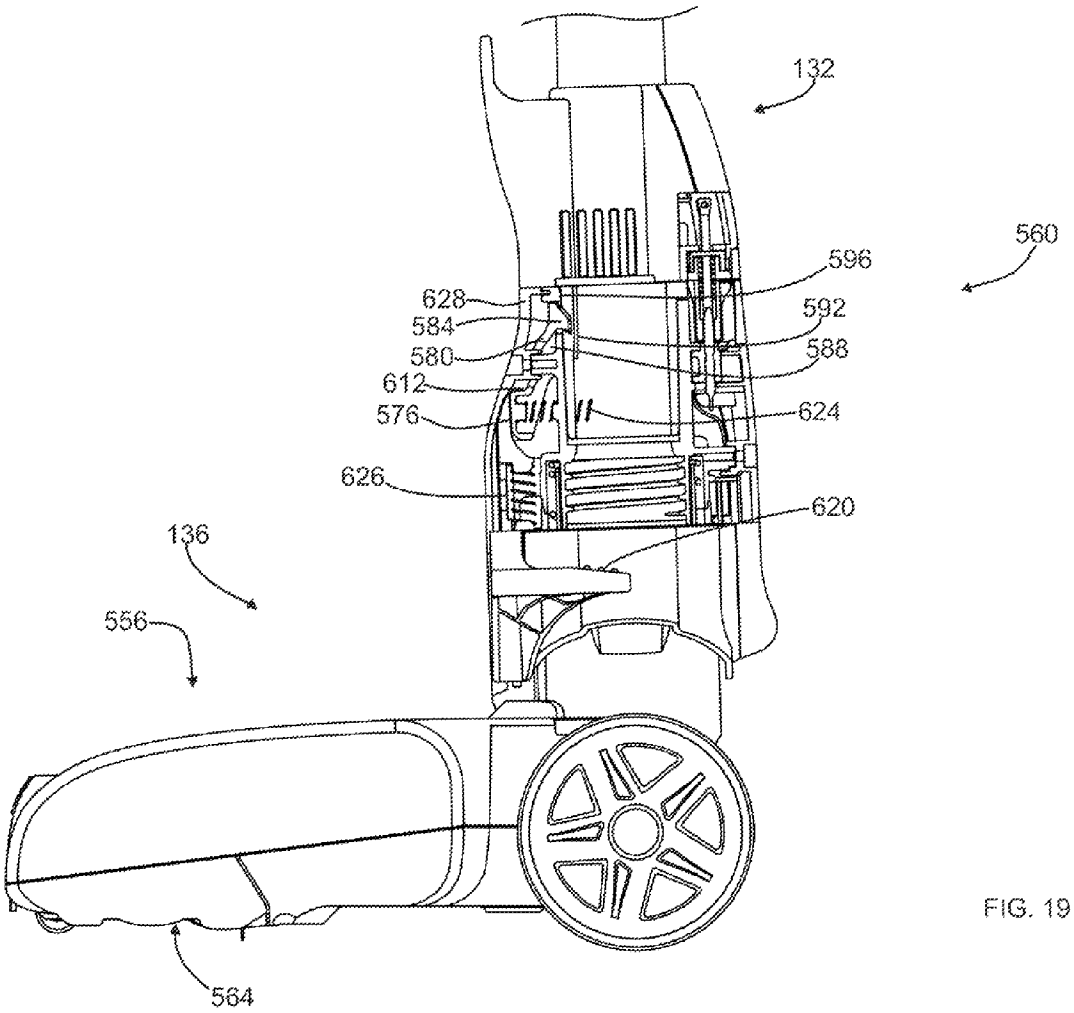
FIG. 19 is a partial cross-sectional view taken along line 18-18 in FIG. 2 with the locking mechanism in an unlocked position.

As exemplified in FIGS. 17 and 18, locking mechanism 572 is described with respect to surface cleaning head 136 and wand 132. However, it is expressly contemplated that, alternatively or in addition, conduit 128 may include the same or analogous elements/structure of wand 132 which relate to locking mechanism 572. For example, conduit 128 may be substituted for wand 132 in the following paragraphs.

Locking mechanism 572 is reconfigurable between a locked position in which wand 132 is secured to downstream portion 560 of the surface cleaning head, and an unlocked position in which wand 132 is removable (e.g. freely removable) from downstream portion 560. Locking mechanism 572 may include one or more foot operable actuators for manually moving locking mechanism 572 from the locked position to the unlocked position, and/or vice versa. The actuator may be positioned in any suitable location on surface cleaning head 136 or wand 132. For example, the actuator may be positioned on one of the upstream or downstream portions 556 and 560 of surface cleaning head 136. In the illustrated example, actuator 576 comprises a single foot pedal positioned on downstream portion 556 of surface cleaning head 136.

Actuator 576 may directly engage wand 132 and secure wand 132 in position, Alternately, as exemplified, locking mechanism 572 may include one or more release arms 580 that are drivenly connected to actuator 576. The release arms may be positioned on one of surface cleaning head 136 and wand 132, and releasably engage the other of surface cleaning head 136 and wand 132 when locking mechanism 572 is in the locked position. For example, a release arm on surface cleaning head 136 may include an engagement member that in the locked position releasably engages an engagement member on wand 132. In the example shown, locking mechanism 572 includes one release arm 580. Release arm 580 is shown including an inward protrusion 584 on an inner surface 588 thereof that releasably engages a recess 592 on an outer surface 596 of wand lower end 596. Inward protrusion 584 and recess 592 are examples of engagement members. Other examples of engagement members include oppositely charged magnets, hook and loop fasteners, and mating male/female snap components, latches and the like.

In the illustrated example, actuator 576 includes a pedal surface 620 which extends exterior to downstream portion 560 for operation by a user's foot. In use, a user may step onto pedal surface 620 to slide actuator 576 downwardly and unlock locking mechanism 572 as described above. Alternately, actuator 576 may be a button, lever, or the like that is foot operable.

Actuator 576 may be moveably mounted to surface cleaning head 136 for movement between an unlocked position and a locked position. In the unlocked position, actuator 576 may either release control of release arm 580 (e.g. a biasing member such as a spring to move release arm 580 to the unlocked position) or urge release arm 580 into the unlocked position. Preferably, actuator 576 is biased to the locked position. For example, a biasing member such as a linear spring 626 may act upon actuator 576 to urge actuator 576 to the locked position. In the example shown, a linear spring 626 is positioned below actuator 576 for urging actuator 576 upwardly to the locked position. This may permit actuator 576 to automatically (i.e. without additional user action) return to the locked position when the user ceases to apply force (e.g. with their foot) to actuator 576.

Release arm 580 may have any suitable configuration and may be mounted to surface cleaning head 136 in any suitable manner for movement between a locked position in which the release arm engages wand 132 (e.g. when wand 132 is suitably received in surface cleaning head downstream portion 560), and an unlocked position in which the release arm 580 disengages from wand 132. In the illustrated example, inward protrusion 584 of release arm 580 is inwardly movable to a locked position, and outwardly movable to an unlocked position. In the illustrated example, release arm 580 is pivotally mounted to surface cleaning head 136 for pivoting about an axis of rotation 600 between the unlocked and locked positions.

As exemplified, release arm 580 includes a body engagement end 604 and a drive end 608. Body engagement end 604 includes inward protrusion 584. Release arm 580 is pivotally mounted to surface cleaning head 136 between body engagement and drive ends 604 and 608. Actuator 576 is drivingly connected to the drive end 608 of release arm 580 for moving the release arm 580 to the unlocked position. In the illustrated example, actuator 576 includes an engagement surface 612 and drive end 608 of release arm 580 includes an angled engagement surface 616. Surfaces 612 and 616 are aligned such that when actuator 576 moves downwardly, actuator engagement surface 612 cams against drive end engagement surface 616 which urges drive end 608 to move inwardly. This pivots release arm 580 moving release arm 580 outwardly to the unlocked position.

Preferably, release arm 580 is biased to the locked position. For example, a biasing member such as a linear spring 624 or a torsional spring may act upon release arm 580 to rotate the release arm 580 toward the locked position. In the example shown, a linear spring 624 is positioned to urge drive end 608 of release arm 580 outwardly to pivot release arm 580 to the locked position. This may permit release arm 580 to automatically (i.e. with additional user action) engage wand 132 upon insertion of wand 132 into surface cleaning head downstream portion 560.

Preferably, all moving parts of locking mechanism 572 are positioned on surface cleaning head 136. This may make adapting accessories that are compatible with locking mechanism 572 less complicated. In the illustrated example, recess 592 is the only component of locking mechanism 572 not positioned on surface cleaning head 136, and is preferably a static, non-movable element. Compatibility with locking mechanism 572 may require only an upstream conduit sized to fit into downstream portion 560 and a recess 592 for engagement by release arm 580. Optionally, surface cleaning head 136 may include a cover 628 for concealing one or more components (such as release arm 580) of locking mechanism 572.

It will be appreciated that any release mechanism may be used with other aspects of this disclosure.

Electrical Connector Guard

The following is a description of an electrical connector guard that may be used by itself in any surface cleaning apparatus or in any combination or sub-combination with any other feature or features disclosed herein.

In accordance with this aspect, surface cleaning apparatus 100 has an electrical connector to which an accessory tool, such as an electrified cleaning wand or motorized cleaning head may be connected. In some cases, the accessory tool may not require an electrical connection (e.g., a crevice tool). In such a case, the accessory tool may be mounted to conduit 128 without needing, to connect to the electrical connector. In such a case, the electrical connector may be exposed. If the electrical connector is live, a user might be exposed to an electrical shock risk from the exposed electrical connector. In accordance with this aspect, the accessory tool is provided with a cover or cowl to cover or surround the electrical connector. The cowl protects the electrical connector from damage (e.g., by hitting a piece of furniture during use of the surface cleaning apparatus) and inhibits a user being exposed to an electrical shock risk from the exposed electrical connector.

Referring to FIG. 4, surface cleaning apparatus 100 may include an electrical connector, such as socket 140, for providing electrical power to a powered accessory, such as a motor-driven brush or a light. Electrical connector 140 may be a male or female connector including any number of electrical wires (e.g. one to five wires). In the illustrated example, connector 140 is a female socket including three wires. Three-wire connector 140 may form part of an electrical circuit that controls the power and/or operation mode of a connected accessory. For example, electrical wires 636 may connect three-wire connector 140 to multi-position switch 640. The position of switch 640 may toggle power to a connected accessory, and/or control the mode of operation of the accessory (e.g., suction motor on, brush of; suction motor on, brush low speed; suction motor on, brush high speed).

Figure 21:
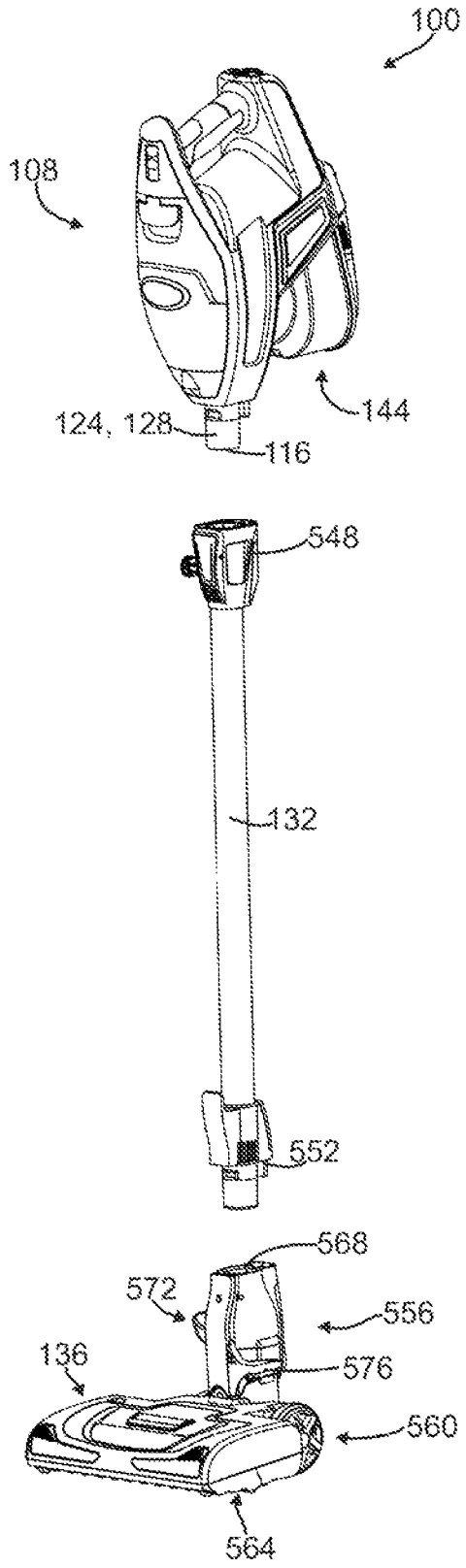
FIG. 21 is an exploded front perspective view of the surface cleaning apparatus of FIG. 1 in the upright floor cleaning configuration of FIG. 2.

Electrical connector 140 may be positioned in any suitable location on surface cleaning apparatus 100. Preferably, electrical connector 140 is positioned proximate inlet end 124. This may permit electrical connector 140 to join with a mating accessory connector when the accessory is fluidly coupled to inlet end 124. Reference is now made to FIGS. 4 and 21. In the illustrated example, wand 132 includes a downstream end 548 that is releasably securable to inlet end 124. For example, conduit 128 may be receivable inside wand downstream end 548, and releasably secured in position by locking mechanism 644 (e.g. a latch). Further, wand 132 is shown including a downstream connector 648 at downstream end 548. Preferably wand downstream connector 648 mates with main body connector 140 substantially concurrently as wand downstream end 548 is secured to conduit 128.

As shown, wand 132 further includes an upstream connector 652 at wand upstream end 552. Electrical wires 656 extend from wand downstream connector 648 to wand upstream connector 652 for transmitting electricity therebetween. Preferably, electrical wires 656 are isolated from the airflow path extending between the upstream and downstream ends 548 and 552 of wand 132. For example, wand 132 may include an isolated conduit 656 in an interior thereof for housing wires 656.

Referring to FIG. 18, an accessory such as surface cleaning head 136 may include an electrical connector 664 for mating with upstream connector 652. In use, wand 132 may transmit power from surface cleaning apparatus 100 to the electrical connector of an accessory for providing power to that accessory (e.g. to power a motor or a light). In the illustrated example, electrical wires 668 extend from surface cleaning head connector 664 to a power brush motor 672.

In some cases, an accessory may not require power from surface cleaning apparatus 100 when connected thereto. For example, the accessory may have its own source of power or may not be powered at all. This may leave electrical connector 140 disconnected. Preferably, such an accessory may protect electrical connector 140 against exposure to dirt and damage.

Figure 23:
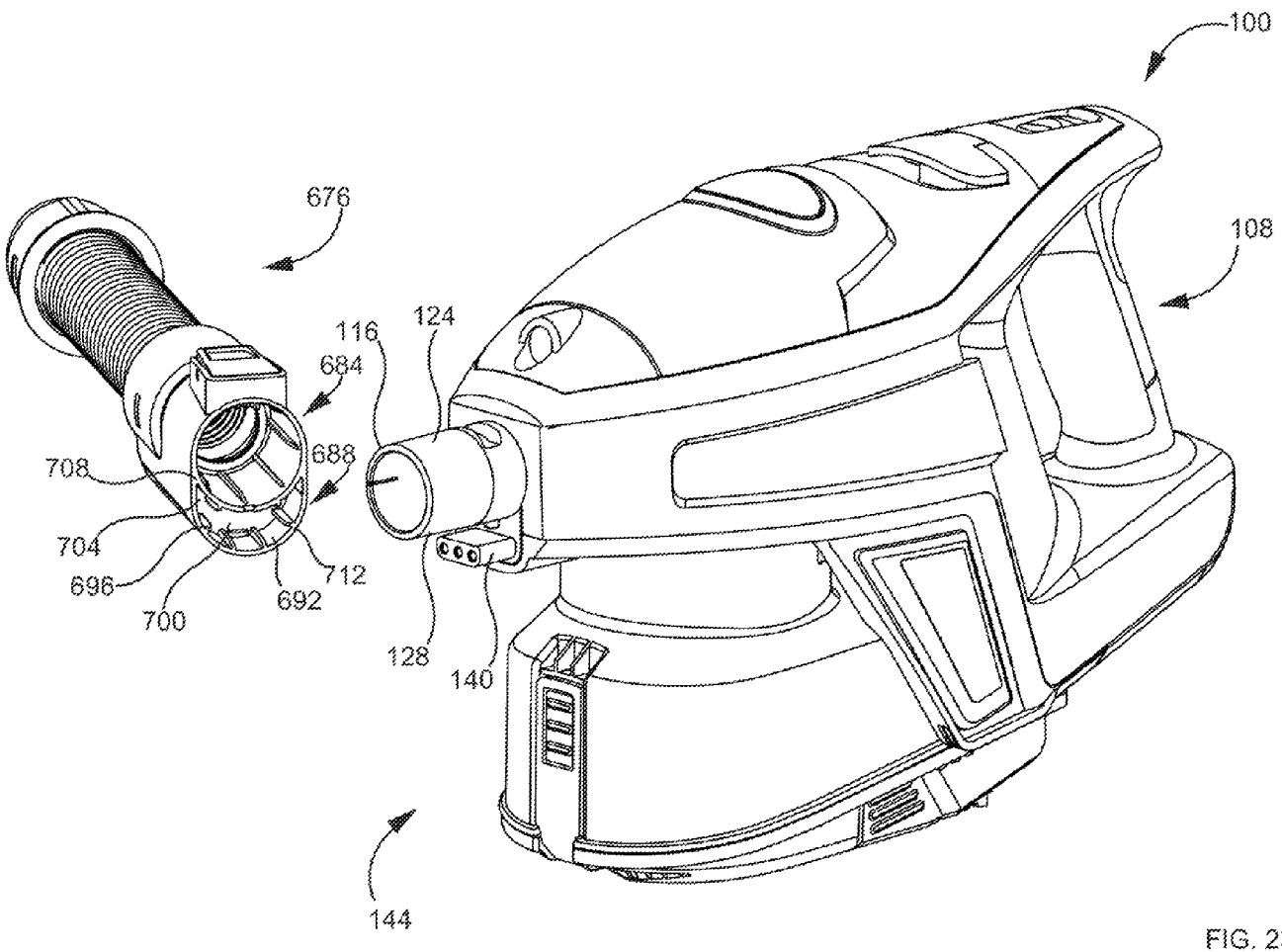
FIG. 23 is a front perspective view of the surface cleaning apparatus of FIG. 2 with the hose accessory detached.

Reference is now made to FIGS. 22 and 23. In the illustrated example, a hose 676 is shown connected to main body 108. Hose 676 includes a downstream end 680 which may be releasably secured to main body 108 in any suitable way. For example, downstream end 680 may include a cylindrical receptacle 684 for receiving conduit 128 of main body 108. Downstream end 680 may also provide protection for electrical connector 140 against exposure to dirt and damage. In the illustrated example, downstream end 680 includes a connector guard 688 for receiving electrical connector 664 when downstream end 680 is connected to main body 108.

Connector guard 688 may take any suitable form. In the illustrated example, connector guard 688 includes sidewalls 692 and 696, and an end wall 700, which collectively define a cavity 704 for receiving electrical connector 140. Cavity 704 is preferably sized to substantially enclose electrical connector 140 when downstream end 680 is secured to main body 108. As illustrated, inner sidewall 696 may be a sidewall of receptacle 684 or an independent sidewall. Optionally, opening 708 to receptacle 684 and the opening to connector guard 688 lie in substantially the same plane, as shown. This may permit connector guard 688 to effectively cover electrical connector 664 against debris and damage.

It will be appreciated that, in other embodiments, connector guard 688 may be of any design that overs the inlet end of electrical connector 140 and need not cover all of electrical connector 140.

Powered Accessories

The following is a description of a control arrangement for powered accessories that may be used by itself in any surface cleaning apparatus or in any combination or sub-combination with any other feature or features disclosed herein.

Preferably, surface cleaning apparatus 100 may be connected to a plurality of different accessories. Some accessories may have more operational modes than others. For example, some accessories may have a single operational mode (i.e. on), whereas other accessories may have multiple operational modes (e.g., high and low). As used herein and in the claims, off is not considered an "operational mode" and is common to all accessories. According to some electrical circuits, a two-wire connection between apparatus 100 and an accessory may be sufficient to provide control over a single operational mode, and a three-wire connection may be used to provide control over multiple operational modes.

Surface cleaning apparatus 100 is provided with a multi-position switch 640 which may have more than two positions (other than off). For example switch 640 may be moveable between an "off" position in which all of the wires in electrical connector 140 are de-energized and suction motor 148 is de-energized; "a suction motor on, brush low speed" position in which electrical connector 140 is energized to provide a first lower level of power and suction motor 148 is energized; and, a "suction motor on, brush high speed" position in which electrical connector 140 is energized to provide a second higher level of power and suction motor 148 is energized.

Preferably, the same electrical connector 140 is used to connect with accessories having limited operational modes, and with accessories having many operational modes. For example, electrical connector 140 may be a three-wire electrical socket that is connectable with both two and three wire mating accessory electrical plugs.

Figure 24:
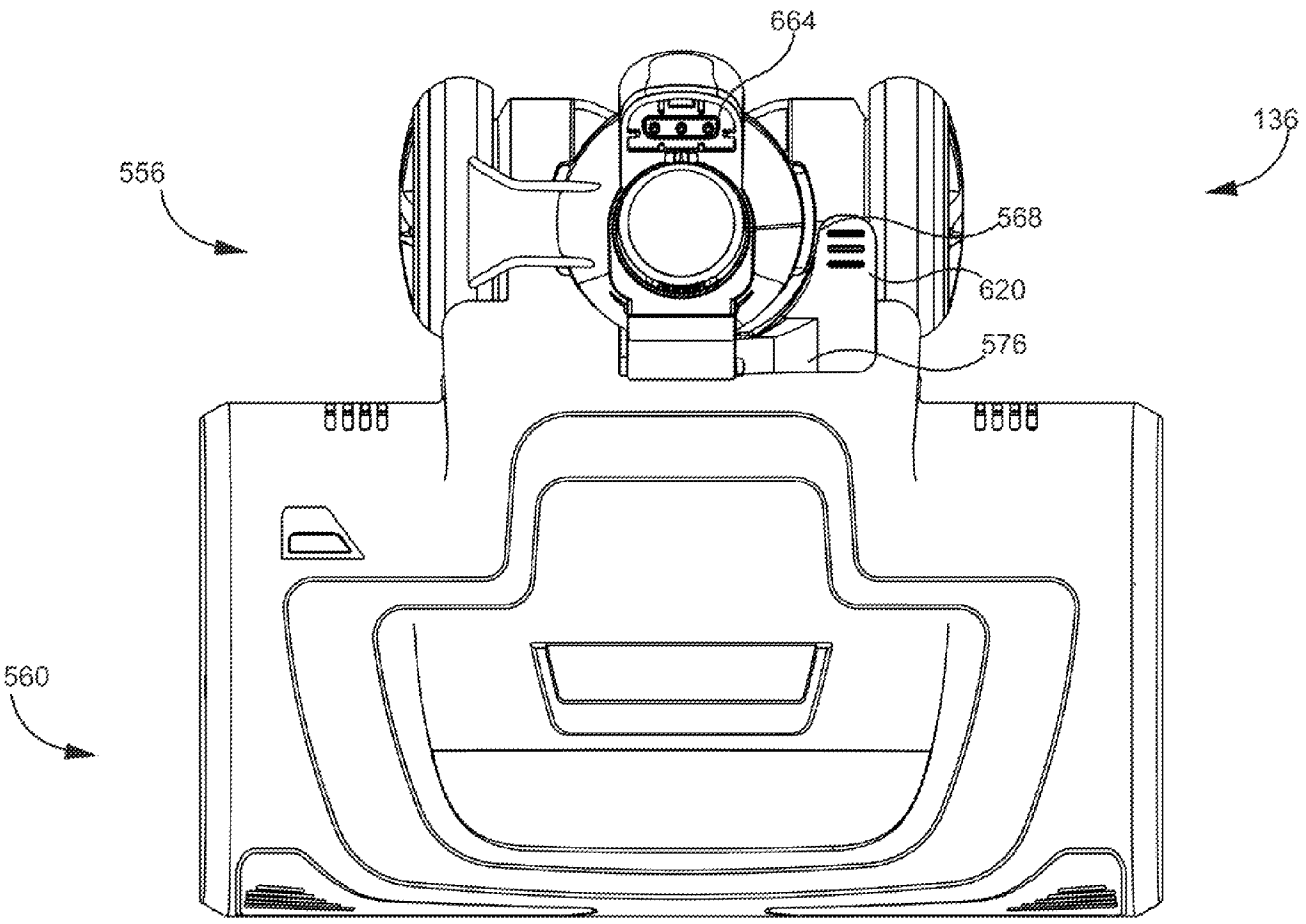
FIG. 24 is a top plan view of the surface cleaning head.
Figure 25:
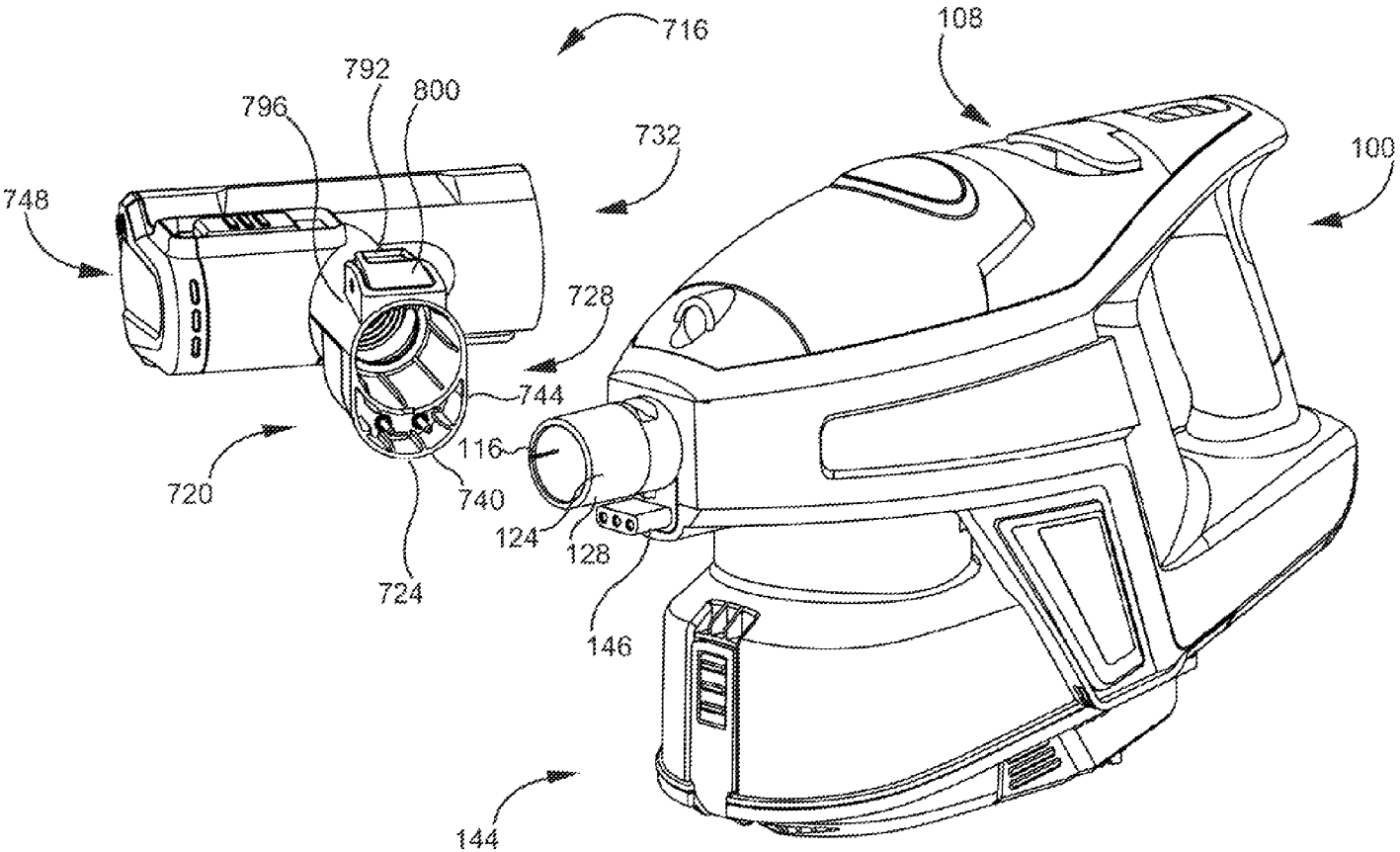
FIG. 25 is a front perspective view of the surface cleaning apparatus of FIG. 1 with an upholstery cleaner accessory detached.
Figure 26:
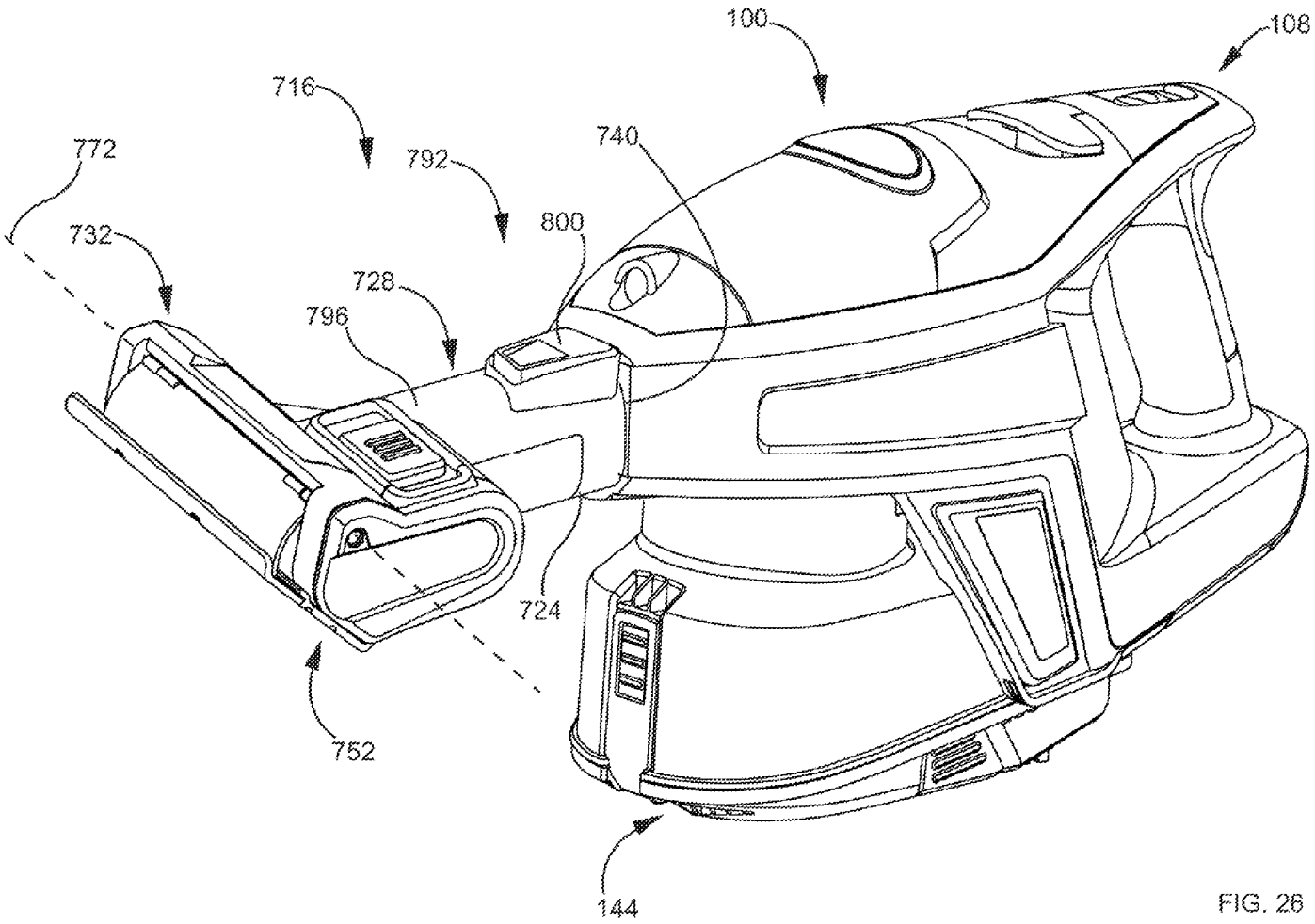
FIG. 26 is a front perspective view of the surface cleaning apparatus of FIG. 1 with the upholstery cleaner attached.

Reference is now made to FIGS. 24-26. In the illustrated example, surface cleaning head 136 includes three-wire electrical connector 664. This may permit a user actuating a switch on surface cleaning apparatus 100 to select an operational mode for surface cleaning head 136 and also to actuate suction motor 148. For example, surface cleaning head 136 may include two modes of operation—high brush speed and low brush speed. In use, a user may selectively position a control actuator, such as multi-position switch 640, between an off position, a first (or low brush speed) position wherein the suction motor is also actuated, and a second (or high brush speed) position wherein the suction motor is also actuated.

FIGS. 25-26 illustrate an exemplary upholstery cleaner 716 which has only one mode of operation, i.e., upholstery cleaner 716 has a power brush that may only be turned on or off. As shown, upholstery cleaner 716 may include an electrical connector 720 having just two wires. The two wires of upholstery cleaner electrical connector 720 may connect with two of the three wires of main body electrical connector 140. In this case, the third wire of main body electrical connector 140 may remain disconnected. When electrical connectors 720 and 140 are connected, switch 640 may be operable to turn upholstery cleaner 716 on and off (i.e. to selectively provide power to upholstery cleaner 716). In such a case, the additional control position is redundant. For example, the motor of upholstery cleaner 716 may be energized at the same power level in positions of switch 640 in which suction motor 148 is energized or it may be energized in only one of the positions of switch 640 in which suction motor 148 is energized.

Optionally, electrical connector 720 of upholstery cleaner 716 may include a connector guard 724. Connector guard 724 is substantially similar to connector guard 688 described above. Connector guard 724 may surround electrical connector 140 to protect at least the disconnected third wire from exposure to dirt and damage.

Alternatively, the first position of switch 640 may provide power to surface cleaning apparatus 100, and second/further positions of switch 640 may provide power to both surface cleaning apparatus 100 and the connected accessory. This may permit the accessory to be selectively activated while powering surface cleaning apparatus 100.

In alternate embodiments, a separate on/off switch may be provided for suction motor 148.

It will be appreciated that any control mechanism may be used with other aspects of this disclosure.

Openable Cleaning Tool

The following is a description of an openable cleaning tool that may be used by itself in any surface cleaning apparatus or in any combination or sub-combination with any other feature or features disclosed herein.

In accordance with this aspect, a cleaning tool has a cleaning member that may require occasional cleaning. For example, the cleaning tool may include a brush that may collect hairs or other elongate material, e.g., a rotatable bush. In such a case, the user may occasional desire to clean the brush by removing the elongate material therefrom. Accordingly, the cleaning tool may have an openable member which is situated so as to permit a user to clean the brush while the brush is still mounted in the cleaning tool. Preferably, the openable member increases the size of the dirty air inlet of the cleaning tool. Accordingly, one part of the housing defining the dirty air inlet may be moveable mounted (e.g., pivotally, slideable, etc.) to the rest of the housing.

Figure 26B:
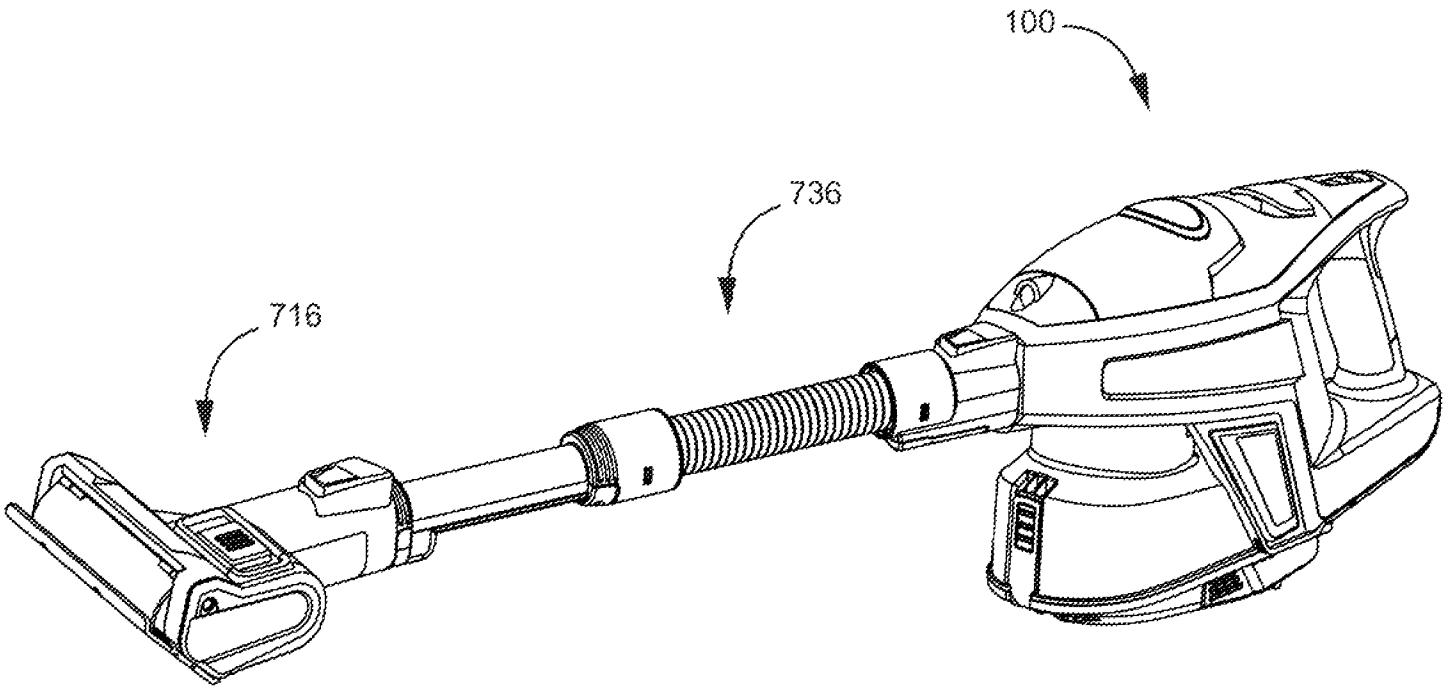
FIG. 26B is a front perspective view of the surface cleaning apparatus of FIG. 1 with the upholstery cleaner attached by a hose.
Figure 27:
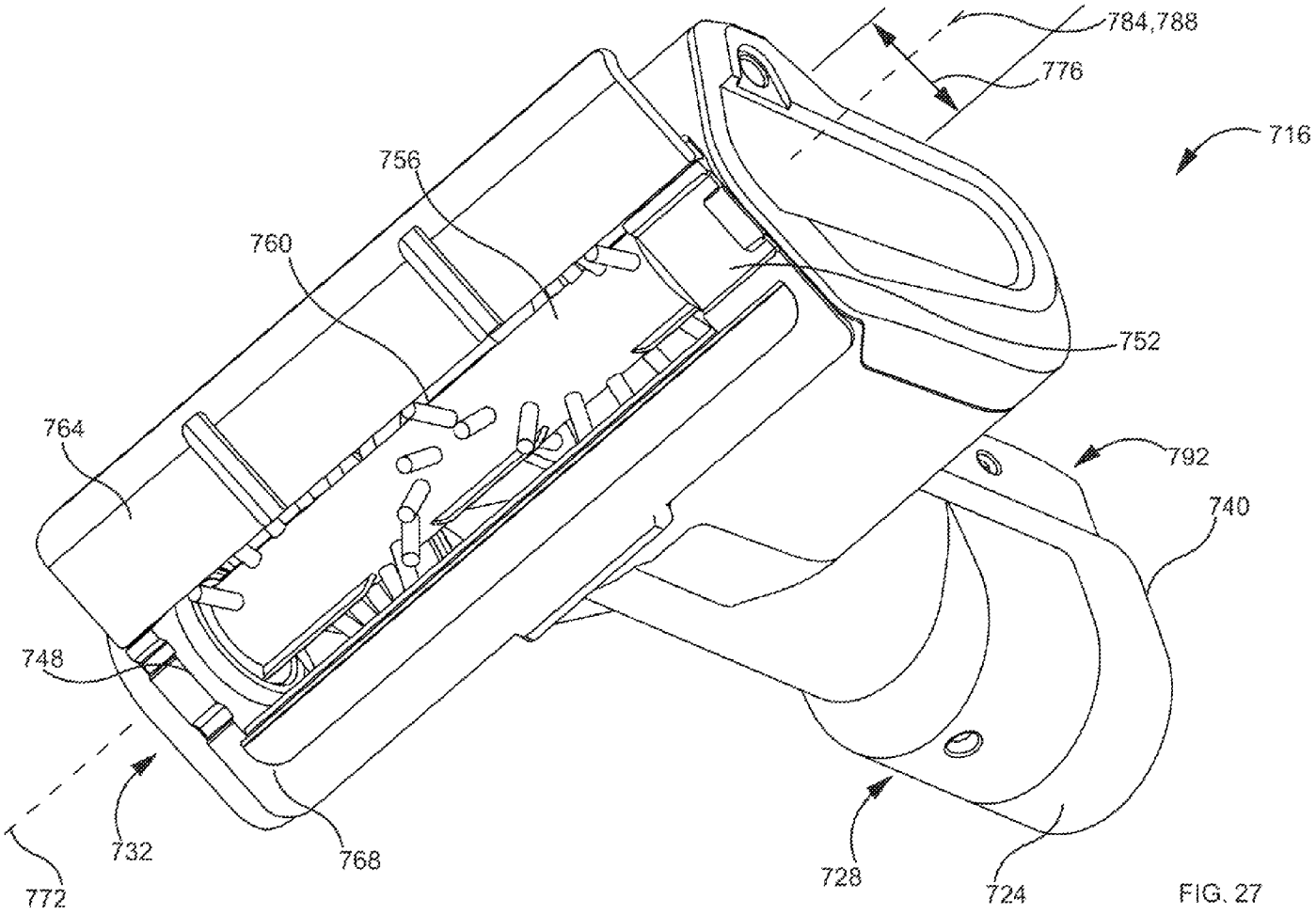
FIG. 27 is a bottom perspective view of the upholstery cleaner in a closed position.
Figure 28:
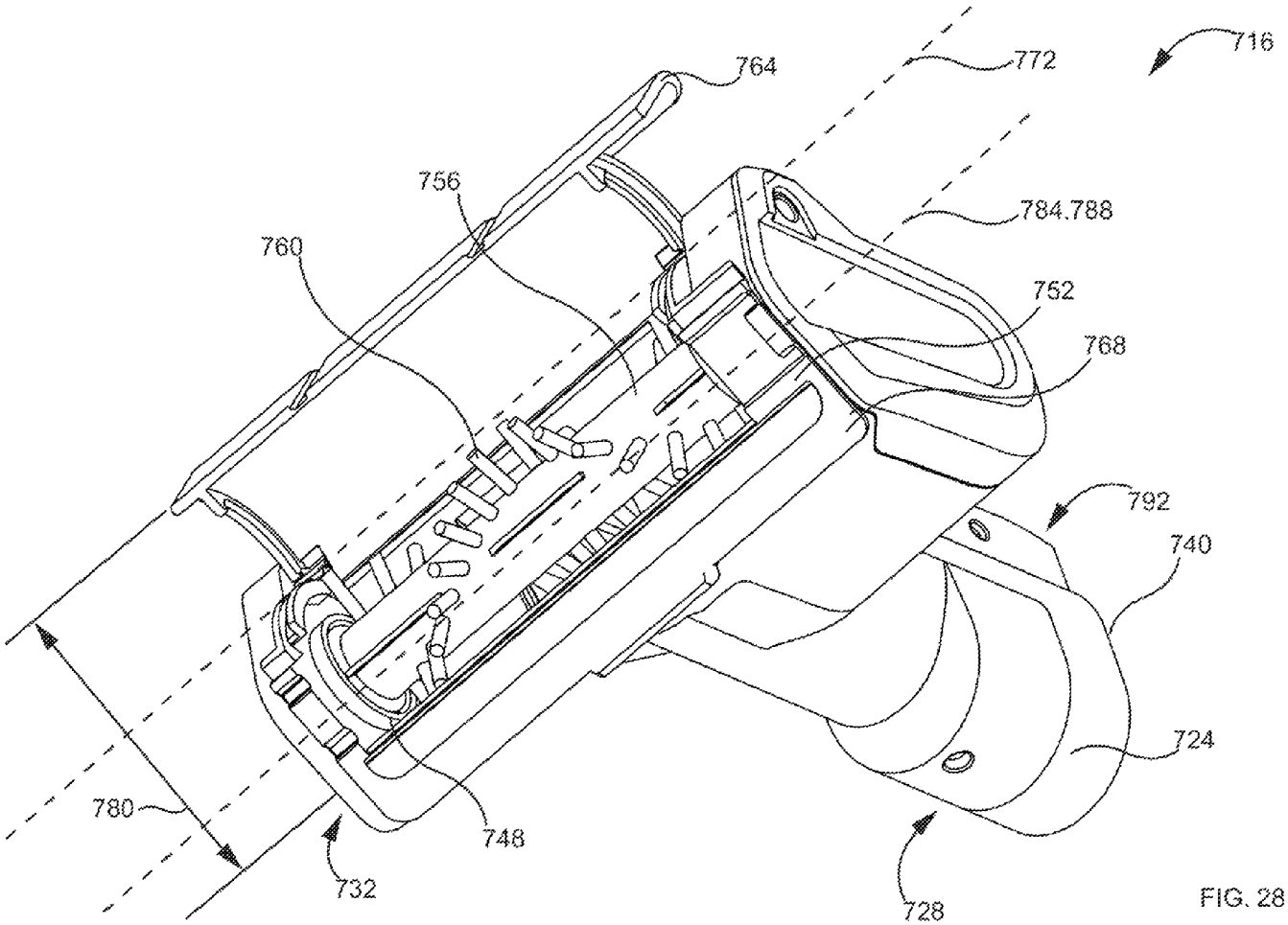
FIG. 28 is a bottom perspective view of the upholstery cleaner in an open position.

As exemplified in FIGS. 25-28, an upholstery cleaning accessory 716 has a motorized brush roll. Upholstery cleaning accessory 716 has a downstream portion 728 that may be releasably securable to inlet end 124 of surface cleaning apparatus 100 by any means known in the art. Downstream portion 728 may be releasably securable to surface cleaning apparatus 100 directly as shown in FIG. 26, or indirectly such as by way of an intermediate hose 736 (see FIG. 26B). Downstream portion 728 includes an air outlet 740 at opening 744 for receiving at least a portion of main body conduit 128 to connect air outlet 740 in air communication with dirty air inlet 116. Upstream portion 732 of accessory 716 has a dirty air inlet 748 at a lower end 752 thereof. Dirty air inlet 748 is in fluid communication with air outlet 740 to form an airflow pathway therebetween. When downstream portion 728 is connected to surface cleaning apparatus 100, a contiguous airflow pathway is formed from upholstery cleaner dirty air inlet 748 to apparatus air inlet 116 to apparatus clean air outlet 120.

Upstream portion 732 is provided with a brush 756 having bristles 760 which extend out of dirt air inlet 748 for contacting the cleaning surface and entraining dirt and hair thereon. Optionally, upholstery cleaner 716 further includes a motor (e.g., electric motor or air turbine—not shown), such as in upstream portion 732, for driving brush 756 to rotate.

In operation, brush 756 is prone to having hair and the like being wound around bristles 760. Accordingly to this aspect, lower end 752 of upstream portion 732 is adapted to provide selective access to brush 756 for cleaning. For example, lower end 752 may include one or more portions which may be moved relative to brush 756 to improve access to brush 756. In the illustrated example, lower end 752 includes a forward portion 764 and a rear portion 770 which border dirty air inlet 748. As shown, forward portion 764 may be pivotally mounted to rear portion 770 to permit forward portion 764 to rotate away from brush 756 and thereby provide improved access to brush 756. As shown, forward portion 764 may be rotated about axis 772 between a closed position (FIG. 27) in which dirty air inlet 748 has a forward length 776, and an open position (FIG. 28) in which brush dirty air inlet 748 has an enlarged forward length 780 (greater than closed forward length 776), which may provide easier access to brush 756.

Optionally, lower end 752 may be rotatably mounted to upstream portion 732. This may permit lower end 752 to rotate to maintain contact with a cleaning surface. In turn, this may improve the cleaning efficiency of upholstery cleaner 716, especially for uneven surfaces such as upholstery. In the illustrated example, lower end 752 is rotatable with respect to upstream portion 732 about an axis 784. Axis 784 may be substantially parallel to brush axis of rotation 788. More preferably, axis 784 is coincident (i.e. the same) as brush axis 788. This may permit brush 756 to maintain a constant distance to dirty air inlet 748, for contacting the cleaning surface with bristles 760, as lower end 752 is rotated into different positions.

Figure 29:
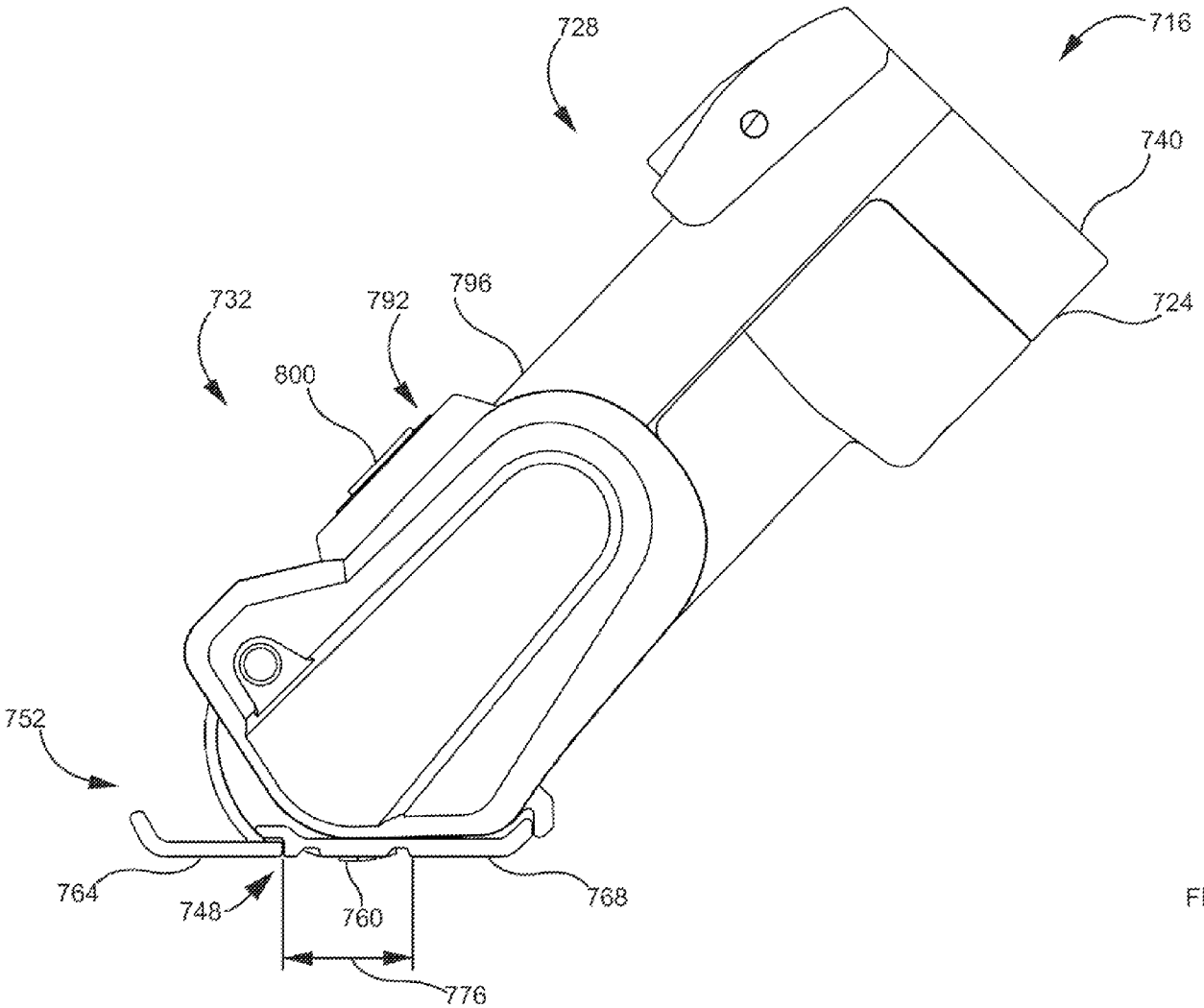
FIG. 29 is a side elevation view of the upholstery cleaner with a forward portion in a first position.
Figure 30:
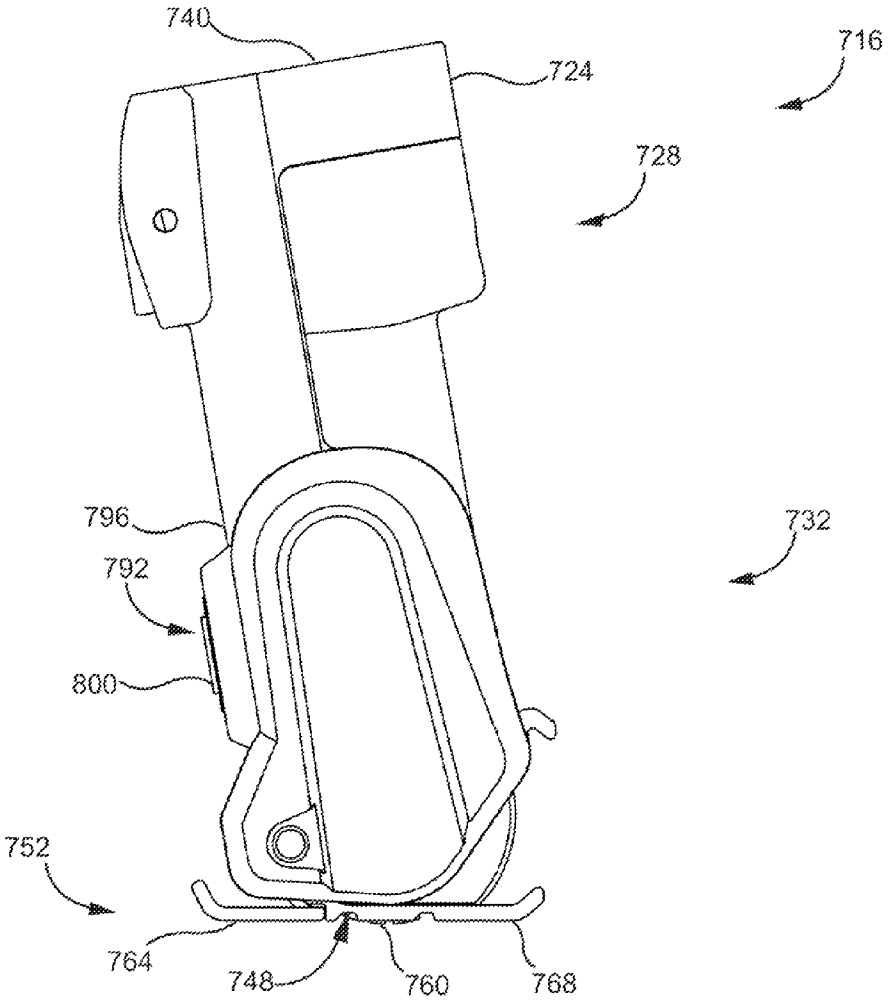
FIG. 30 is the side elevation view of FIG. 29 with the forward portion in a second position; and, FIG. 31 is a front perspective view of the surface cleaning apparatus of FIG. 1 in the floor cleaning configuration of FIG. 2 with the accessory mount and accessory tools in an exploded configuration.

Lower end 752 may be rotatable about axis 784 from a first rearward position (see FIG. 29) to a second forward position (see FIG. 30). Optionally, lower end 752 is rotatable between the first and second positions across a range of between 20 and 70 degrees, and preferably across a range of at least 30 degrees. In the illustrated example, lower end 752 is rotatable between the first and second positions across a range of approximately 45 degrees.

It will be appreciated that the accessory 716 may be provided with a rotatably mounted lower end 752 without a pivotally mounted forward portion 764.

Optionally, in any embodiment, upholstery cleaner 716 may include a bleed valve. The bleed valve may permit ambient air to enter the airflow pathway through upholstery cleaner 716 to reduce the suction developed at dirty air inlet 748. Preferably, the bleed valve is manually operable. This may permit a user to selectively open the bleed valve to reduce suction at dirty air inlet 748, which may improve cleaning efficiency over, e.g. high pile carpet. Alternatively, the bleed valve may open automatically in response to a sealed suction situation (e.g. low pressure) in the airflow pathway. This may help to prevent overheating of suction motor 148 by drawing in additional air through the bleed valve.

Bleed valve 792 may be position in any suitable location on upholstery cleaner 716. In the illustrated example, bleed valve 792 is positioned on an upper surface 796 of upstream portion 732 of upholstery cleaner 716. In alternative embodiments, bleed valve 792 may be positioned on downstream portion 728.

Bleed valve 792 is an example of a manually openable bleed valve 792. As shown, bleed valve 792 includes a slide 800 which may be selectively moved (left and right in the example shown) between opened and closed positions. In the open position, bleed valve 792 allows supplemental air to enter the airflow path, and in the closed position, bleed valve 792 does not allow supplemental air to enter the airflow path. Preferably, bleed valve 792 includes additional partially open positions between the open and closed positions. This may provide additional control over the amount of air allowed to cross bleed valve 792 into the airflow path. In turn, this may provide finer control over the suction developed at dirty air inlet 748. For example, maximum suction may be desired for hard floors, medium suction may be desired for low pile carpet, and minimum suction may be desired for high pile carpet.

Lighting

The following is a description of a lighting arrangement that may be used by itself in any surface cleaning apparatus or in any combination or sub-combination with any other feature or features disclosed herein.

Surface cleaning apparatus 100 may include one or more lights that operate to illuminate a surface to be cleaned or to illuminate components of surface cleaning apparatus 100. For example, surface cleaning apparatus 100 or an attached accessory may include one or more forward facing lights (e.g. LED, halogen, or incandescent bulbs).

Reference is now made to FIGS. 1 and 4. In the illustrated example, surface cleaning apparatus 100 includes an LED light 804. As shown, light 804 is directed forwardly to shine light onto a cleaning surface forward of inlet end 124. Preferably, light 804 is positioned on an upper end 428 of main body 108. In the example shown, light 804 is positioned above conduit 128 and dirty air inlet 116 (e.g., on an upper surface of main body 108 and at the forward end thereof). In some cases, this may permit LED light 804 to shine forwardly, over conduit 128 and an attached accessory, onto the surface to be cleaned. In turn this may permit light 804 to replace any need for a separate light on some accessories, since light 804 may be positioned to shine over the accessory onto the cleaning surface.

Light 804 may be activated in any suitable manner. For example, surface cleaning apparatus 100 may include a dedicated actuator (e.g. switch, lever, or button) for powering light 804. Alternatively, and as shown, light 804 may be powered by operation of a shared control actuator, such as switch 640. This may permit the activation of light 804 to be coordinated with the activation of other components of surface cleaning apparatus 100 such as suction motor 148. For example, when switch 640 is in the OFF position, both suction motor 148 and light 804 may be powered off. When switch 640 is in any other position (e.g. a first position), both suction motor 148 and light 804 may be powered on. In effect, light 804 may power on automatically with suction motor 148.

Alternatively, switch 640 may include a first position in which suction motor 148 is powered on while light 804 is powered off, and a second position in which both suction motor 148 and light 804 is powered on. This may permit light 804 to be selectively activated or deactivated while operating surface cleaning apparatus 100, e.g. to conserve energy.

Accessory Mount

The following is a description of an accessory mount that may be used by itself in any surface cleaning apparatus or in any combination or sub-combination with any other feature or features disclosed herein.

In accordance with this aspect, surface cleaning apparatus 100 is provided with storage for one or more accessories. Accordingly, accessories (e.g. a crevice tool, wand extension, power brush, etc.) may be conveniently stored and available when required. These accessories may be mounted to inlet end 124 for expanding the functionality of surface cleaning apparatus 100 or for improving cleaning efficiency on the particular cleaning surface. In order to reduce the footprint of surface cleaning apparatus 100 during use, the storage mount may be provided on wand 132. An advantage of this design is that the accessory tools are not located on the cleaning head, which could increase the height or width of the cleaning head and reduce the furniture under which it may fit, nor are they located on the hand vac itself. Instead, they are provided on a the wand at a position between the cleaning head and the hand vac.

It will be appreciated that the storage mount may be releasable secured to wand 132 or it may be permanently mounted thereto, such as by being molded as part thereof, or by being a separate part that is secured to wand 132 by an adhesive, a mechanical fastener such as a screw or the like.

Figure 2:
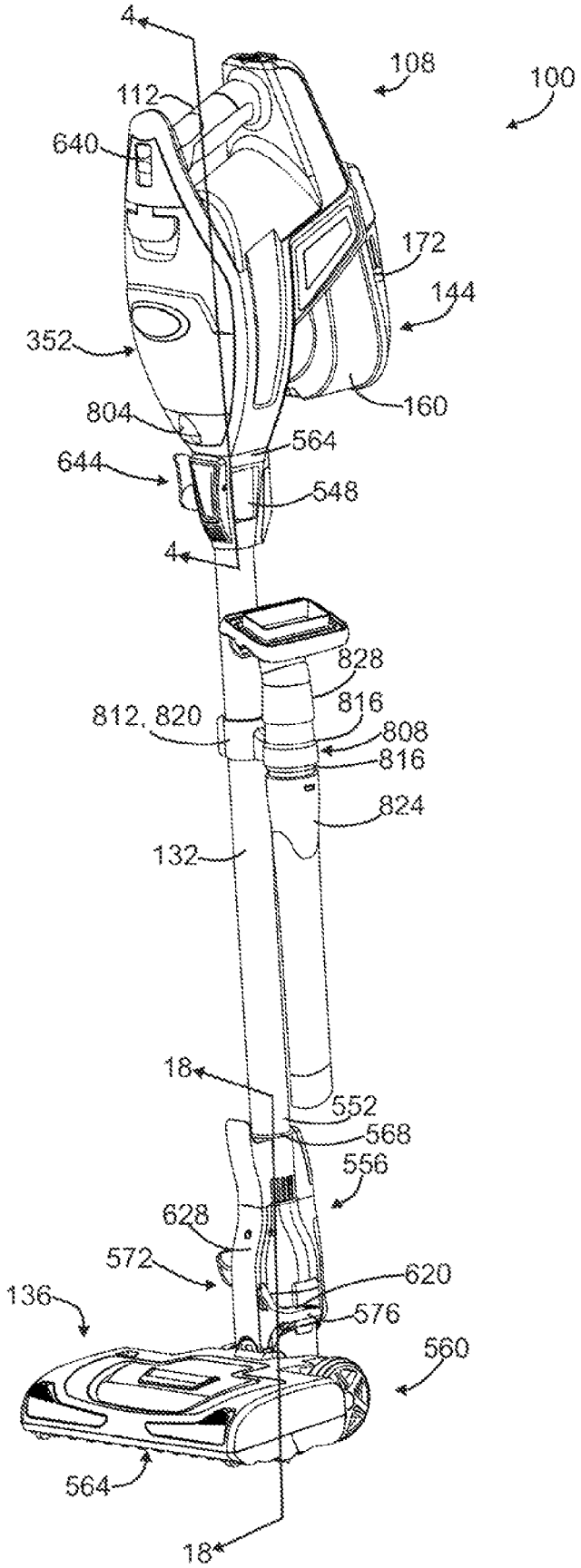
FIG. 2 is a front perspective view of the surface cleaning apparatus of FIG. 1 in an upright floor cleaning configuration.
Figure 3:
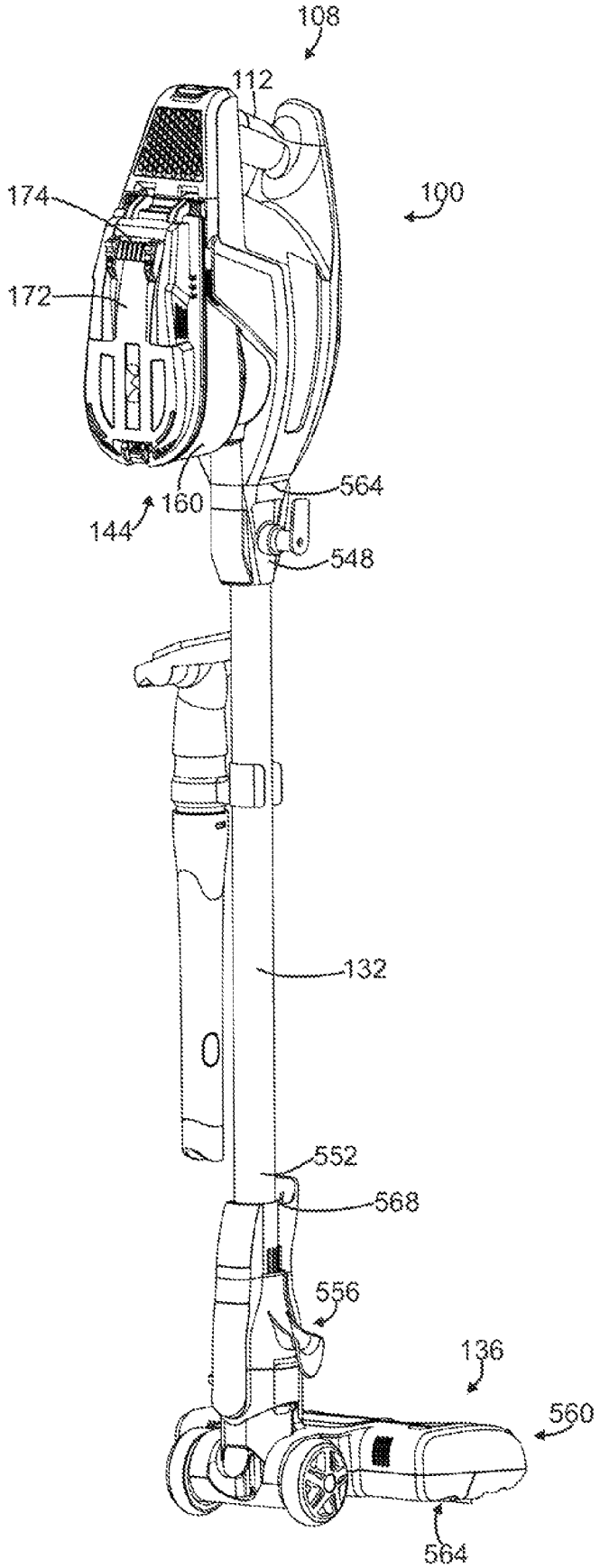
FIG. 3 is a rear perspective view of the surface cleaning apparatus of FIG. 1 in the upright floor cleaning configuration of FIG. 2.
Figure 31:
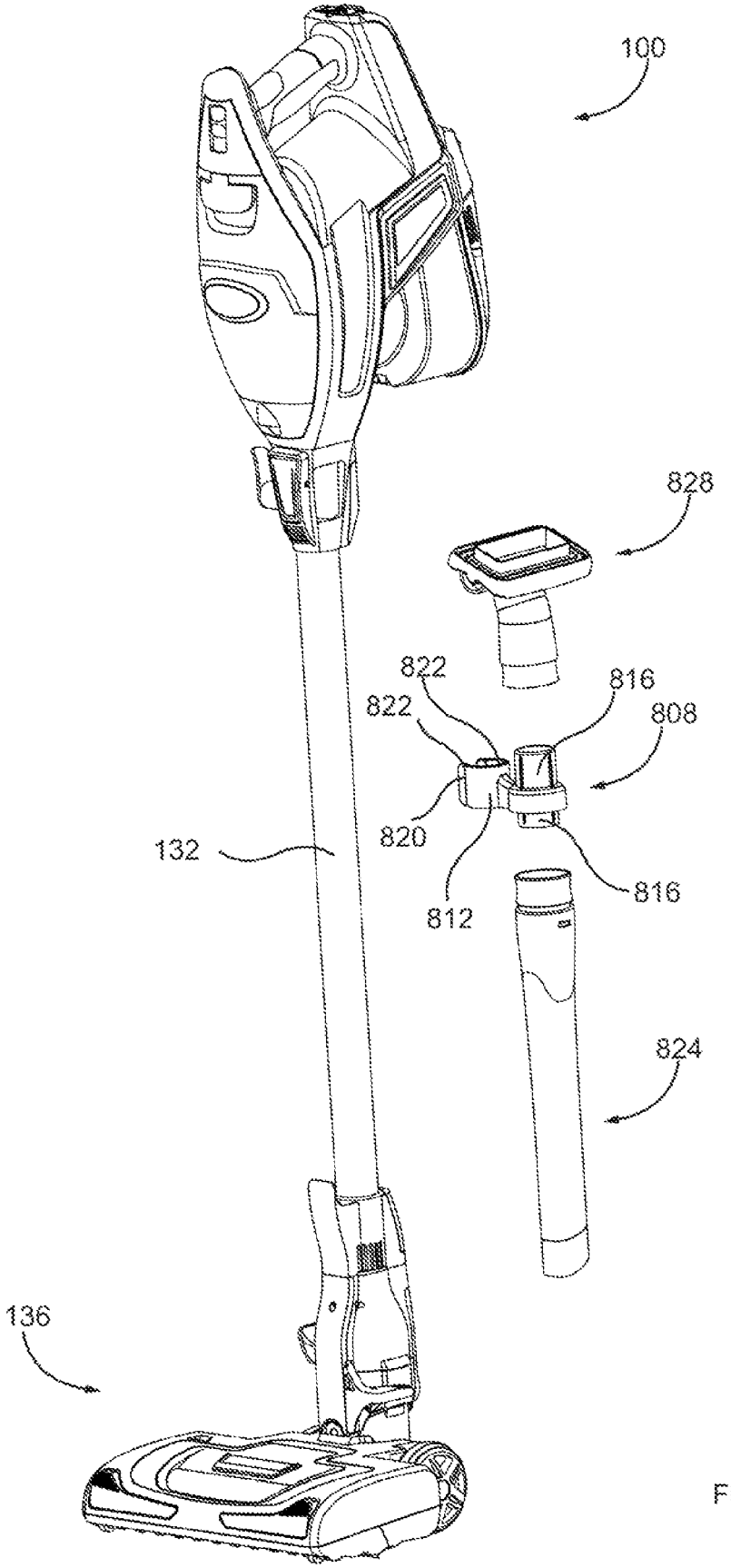

As exemplified in FIGS. 2 and 31, accessory mount 808 for carrying one or more accessories includes an engagement portion 812 for releasably securing mount 808 to wand 132 and one or more mounting portions 816. Engagement portion 812 may include any suitable retentive member such as a clip, a clamp, magnets, or hook and loop fasteners. This may permit accessory mount 808 to be selectively removed, repositioned, and replaced onto a different position on wand 132. In the illustrated example, engagement portion 812 includes a clip 820 sized to grasp wand 132. Clip 820 includes a pair of spaced apart resilient arms 822 which can be spread apart to receive wand 132 and afterward released to bear down onto wand 132.

Accessory mount 808 is shown including two mounting portions 816 laterally connected to engagement portion 812. Mounting portions 816 are positioned to support an accessory, such as crevice tool 824 or brush 828. Preferably, one or more of mounting portion 816, and more preferably both of mounting portion 816, can support an accessory oriented in parallel with the mounting surface (here wand 132) as shown. In alternative embodiments, one or more of mounting portions 816 may support an accessory oriented at an angle to the mounting surface.

In some embodiments, accessory mount 808 may include more than two mounting portions 816. For example, accessory mount 808 may include a plurality of mounting portions 816 arranged in pairs (or larger groups), which are distributed about a periphery of engagement portion 808.

Each accessory mount 808 may have any suitable configuration for supporting an accessory. For example, each accessory mount 808 may include one or more of a plug, a receptacle, a magnet, a hook or loop fastener, a snap, or another suitable mounting member for retaining an accessory. In the example shown, each accessory mount 808 includes a plug sized to form a friction frit inside an air outlet of an accessory.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand carryable surface cleaning apparatus comprising:

(a) a body housing a suction motor and comprising a dirty air inlet;

(b) a cyclone bin assembly removably mounted to the body, the cyclone bin assembly comprising a cyclone bin assembly air inlet in air flow communication with the dirty air inlet when the cyclone bin assembly is mounted to the body, a cyclone chamber and a dirt collection chamber; and, (c) an air flow path extending from the dirty air inlet to a clean air outlet and including the suction motor and the cyclone chamber wherein the cyclone bin assembly is at least partially nested in the body when the cyclone bin assembly is mounted to the body wherein a recess is provided in a lower side of the body in which the cyclone bin assembly is received.

2. The hand carryable surface cleaning apparatus of claim 1 wherein an upper portion of the cyclone bin assembly is received in the recess.

3. The hand carryable surface cleaning apparatus of claim 1 wherein the body comprises a conduit extending from the dirty air inlet to a conduit air outlet and the conduit extends linearly.

4. The hand carryable surface cleaning apparatus of claim 1 wherein the body comprises a conduit extending from the dirty air inlet to a conduit air outlet and the conduit air outlet extends at an angle to a direction of airflow through the conduit and the cyclone bin assembly air inlet extends in a mating angle.

5. The hand carryable surface cleaning apparatus of claim 1 wherein the body has a carry handle and the carry handle remains with the body when the cyclone bin assembly is removed.

6. A hand carryable surface cleaning apparatus comprising:

(a) a body housing a suction motor and comprising a dirty air inlet;

(b) a cyclone bin assembly removably mounted to the body, the cyclone bin assembly comprising a cyclone bin assembly air inlet in air flow communication with the dirty air inlet when the cyclone bin assembly is mounted to the body, a cyclone chamber and a dirt collection chamber; and, (c) an air flow path extending from the dirty air inlet to a clean air outlet and including the suction motor and the cyclone chamber wherein the cyclone bin assembly is at least partially nested in the body when the cyclone bin assembly is mounted to the body, and wherein the cyclone bin assembly air inlet is provided at an upper end of the cyclone bin assembly.

7. The hand carryable surface cleaning apparatus of claim 6 wherein a cyclone bin assembly air outlet is provided at an upper end of the cyclone bin assembly.

8. The hand carryable surface cleaning apparatus of claim 7 wherein an upper portion of the cyclone bin assembly is received in the recess, and the body comprises a pre-motor filter positioned above the recess.

9. A hand carryable surface cleaning apparatus comprising:

(a) a body housing a suction motor and comprising a dirty air inlet;

(b) a cyclone bin assembly removably mounted to the body, the cyclone bin assembly comprising a cyclone bin assembly air inlet in air flow communication with the dirty air inlet when the cyclone bin assembly is mounted to the body, a cyclone chamber and a dirt collection chamber; and, (c) an air flow path extending from the dirty air inlet to a clean air outlet and including the suction motor and the cyclone chamber wherein the cyclone bin assembly is at least partially nested in the body when the cyclone bin assembly is mounted to the body, and wherein a recess is provided in a lower side of the body in which the cyclone bin assembly is received, an upper portion of the cyclone bin assembly is received in the recess and the cyclone bin assembly air inlet is provided at an upper end of the cyclone bin assembly.

10. The hand carryable surface cleaning apparatus of claim 9 wherein a cyclone bin assembly air outlet is provided at an upper end of the cyclone bin assembly.

11. The hand carryable surface cleaning apparatus of claim 10 wherein the body comprises a pre-motor filter positioned above the recess.

12. A hand carryable surface cleaning apparatus comprising:

(a) a body housing a suction motor and comprising a dirty air inlet;

(b) a cyclone bin assembly removably mounted to a lower side of the body, the cyclone bin assembly comprising a cyclone bin assembly air inlet provided at an upper end of the cyclone bin assembly and in air flow communication with the dirty air inlet when the cyclone bin assembly is mounted to the body, a cyclone chamber and a dirt collection chamber; and, (c) an air flow path extending from the dirty air inlet to a clean air outlet and including the suction motor and the cyclone chamber, wherein the cyclone bin assembly is at least partially nested in the body when the cyclone bin assembly is mounted to the body wherein a cyclone bin assembly air outlet is provided at an upper end of the cyclone bin assembly.

13. The hand carryable surface cleaning apparatus of claim 12 wherein the body comprises a conduit extending from the dirty air inlet to a conduit air outlet and the conduit air outlet extends at an angle to a direction of airflow through the conduit and the cyclone bin assembly air inlet extends in a mating angle.

14. The hand carryable surface cleaning apparatus of claim 12 wherein the body has a carry handle and the carry handle remains with the body when the cyclone bin assembly is removed.

15. The hand carryable surface cleaning apparatus of claim 12 wherein the cyclone bin assembly is at least partially nested in a lower portion of the body when the cyclone bin assembly is mounted to the body.

16. A hand carryable surface cleaning apparatus comprising:

(a) a body housing a suction motor and comprising a dirty air inlet;

(b) a cyclone bin assembly removably mounted to a lower side of the body, the cyclone bin assembly comprising a cyclone bin assembly air inlet provided at an upper end of the cyclone bin assembly and in air flow communication with the dirty air inlet when the cyclone bin assembly is mounted to the body, a cyclone chamber and a dirt collection chamber; and, (c) an air flow path extending from the dirty air inlet to a clean air outlet and including the suction motor and the cyclone chamber, wherein the cyclone bin assembly is at least partially nested in the body when the cyclone bin assembly is mounted to the body, and wherein the body comprises a pre-motor filter positioned above the cyclone bin assembly.

17. The hand carryable surface cleaning apparatus of claim 16 wherein the cyclone bin assembly is at least partially nested in a lower portion of the body when the cyclone bin assembly is mounted to the body.

* * * * *